US008727153B2

(12) United States Patent
Willows et al.

(10) Patent No.: US 8,727,153 B2
(45) **Date of Patent: *May 20, 2014**

(54) BOTTLE, RETAINING DEVICE AND ASSOCIATED ELEMENTS FOR CARRYING CONTAINERS AND OTHER ITEMS

(75) Inventors: Keith S. Willows, Seattle, WA (US); June A. Angus, Seattle, WA (US); Antonio Del Rosario, Federal Way, WA (US)

(73) Assignee: Amphipod, Inc., Seattle, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/409,469

(22) Filed: Mar. 1, 2012

(65) Prior Publication Data

US 2012/0228345 A1 Sep. 13, 2012

Related U.S. Application Data

(63) Continuation of application No. 12/945,604, filed on Nov. 12, 2010, now Pat. No. 8,152,011, which is a continuation of application No. 11/117,261, filed on Apr. 27, 2005, now Pat. No. 7,845,506.

(60) Provisional application No. 60/566,378, filed on Apr. 28, 2004, provisional application No. 60/579,054, filed on Jun. 10, 2004.

(51) Int. Cl.
*A47K 1/08* (2006.01)
*B65D 90/02* (2006.01)

(52) U.S. Cl.
USPC ..... 215/382; 215/384; 215/395; 215/390; 248/311.2; 224/414; 119/477

(58) Field of Classification Search
USPC ..... 215/382–385, 398; 248/311.2, 313, 248/107, 175, 302, 248; 224/414; 119/477; 361/807, 808
See application file for complete search history.

(56) References Cited

U.S. PATENT DOCUMENTS

| | | | | |
|---|---|---|---|---|
| 3,212,660 | A | | 10/1965 | Adell |
| 3,533,526 | A | | 10/1970 | Adell |
| 3,537,498 | A | | 11/1970 | Amand |
| 3,964,709 | A | | 6/1976 | LaBelle et al. |
| 3,981,166 | A | | 9/1976 | Madonna |
| 4,121,797 | A | | 10/1978 | MacNeil |
| 4,150,806 | A | | 4/1979 | Dziuk |
| 4,270,231 | A | | 6/1981 | Zint |
| 4,366,922 | A | | 1/1983 | Levine et al. |
| D285,659 | S | | 9/1986 | Paulovich et al. |
| 4,723,801 | A | | 2/1988 | Musumeci et al. |
| 4,733,836 | A | | 3/1988 | Barnes |
| 5,042,770 | A | * | 8/1991 | Louthan ..... 248/311.2 |
| 5,105,958 | A | | 4/1992 | Patton |
| 5,115,952 | A | | 5/1992 | Jenkins |
| 5,123,554 | A | | 6/1992 | Arvidson et al. |
| 5,170,658 | A | | 12/1992 | Thayer |
| 5,224,614 | A | | 7/1993 | Bono et al. |
| 5,326,006 | A | | 7/1994 | Giard, Jr. |

(Continued)

*Primary Examiner* — Tri Mai
(74) *Attorney, Agent, or Firm* — Lowe Graham Jones PLLC

(57) ABSTRACT

An improved bottle, retaining device and associated elements for carrying items is disclosed. The retaining device is adapted for holding a container (or containers) or other items; the retaining device being adapted to affix the container by way of the retaining device to a person or a personal item so ready access is provided for the held container/item.

25 Claims, 80 Drawing Sheets

(56) References Cited

U.S. PATENT DOCUMENTS

| | | | |
|---|---|---|---|
| RE34,725 | E | 9/1994 | Braden |
| 5,624,064 | A | 4/1997 | McGee, Jr. |
| 5,669,329 | A | 9/1997 | Krause |
| D423,774 | S | 5/2000 | Peterson |
| 6,401,997 | B1 | 6/2002 | Smerdon, Jr. |
| 6,598,837 | B1 | 7/2003 | Howard et al. |
| 6,752,284 | B1 | 6/2004 | Akiyama et al. |
| D494,471 | S | 8/2004 | Chou |
| 6,808,149 | B1 | 10/2004 | Sendowski et al. |
| D498,357 | S | 11/2004 | Smith |
| 6,837,472 | B1 | 1/2005 | Beutz |
| D502,366 | S | 3/2005 | Strepkoff |
| 7,845,506 | B2 | 12/2010 | Willows et al. |

* cited by examiner

SECTION "A"

SECTION "B"
(BOTH SIDES)

7A

7B

SECTION "A"

SECTION "B"
(BOTH SIDES)

BOTTLE, RETAINING DEVICE AND ASSOCIATED ELEMENTS FOR CARRYING CONTAINERS AND OTHER ITEMS

PRIORITY CLAIM

This application is a continuation of U.S. patent application Ser. No. 12/945,604 filed Nov. 12, 2010, which is a continuation of U.S. patent application Ser. No. 11/117,261 filed Apr. 27, 2005, which claims the benefit under 35 U.S.C. §119(e) of U.S. Provisional Application, Ser. No. 60/566,378, filed Apr. 28, 2004 and U.S. Provisional Application, Ser. No. 60/579,054 filed Jun. 10, 2004.

FIELD OF THE INVENTION

The present invention relates to a bottle and retaining device for holding a bottle, container or containers along with optional means for carrying other desired items. More particularly the present invention relates to a bottle with features that allow it to be retained in a retaining device and a retaining device adapted for holding a bottle, container or containers and optional other desired items; the retaining device being adapted to affix the container by way of the retaining device to a person or a personal item so ready access is provided for the held container/item.

BACKGROUND OF THE INVENTION

Sport, travel and general merchandise stores commonly sell articles for holding water and hydrating fluids for use during a variety of activities to enable the user to keep one's body healthfully hydrated, ward off thirst and improve sports performance. These fluid carrying articles are used for, and during, activities from leisurely walking and everyday use to hiking and more endurance sports or activities such as running, in-line skating, triathlons and adventure racing. These articles, depending on their configuration, provide varying levels of comfort and convenience relative to the intended activity and unique/varying activity variables.

Originally, day hikers used small to large, frame-less and internal/external frame, backpacks with shoulder straps, to carry bottles of water or other containers for holding fluids in a hands-free fashion. With the increased popularity of running and fitness, waist water carriers with fabric/foam-type holsters have become popular with the need for people to carry primarily just water and basic minimal essentials. There are many variations of belts and waist packs made for carrying fluid containers readily available as well as bladder-style packs and belts. Also there are add on fabric/foam style holsters which slide on a belt with a belt loop so you can add fluid containers to an existing belt. Additionally, hand carrying a water bottle with a hand strap or just by itself is also a popular alternative to a waist pack for some people.

Although there are many solutions for carrying hydrating fluids, they suffer from drawbacks of one sort or another. Waist bottle packs with fabric, elastic and/or foam holsters in some cases have the bottle holster fixed/sewn on the belt so that the user has little ability to customize the belt and bottle position for their own particular needs. Usually the only adjustments are sizing of the belt and in order to adjust the position of the bottle or bottles on the belt the user has to rotate the whole belt around on the waist which can be a problem if a buckle or some other feature of the belt/pack ends up in an uncomfortable or unfavorable position on the user. For a bottle pack with more than one holster, moving holster positions relative to each other around the belt so that the bottle position is specific to the fit/use requirements of the user is not possible because these holsters are generally sewn in place on the waist belt. Also the fabric, foam, elastic, etc associated with creating the holster itself and integrating it into the belt/pack in a way that is comfortable for the wearer in highly active conditions can be a source of significant unwanted weight.

Add-on holsters are usually made of the same or similar material (fabric, foam, elastic, etc.) as the above mentioned bottle pack holsters in a similar manner although a belt loop or loops are provided for threading the holster onto a separate belt. As with the above mentioned bottle pack holsters the fabric, foam, elastic, etc associated with creating the holster and belt loop panel can be a source of significant unwanted weight. Also the add-on holsters generally do not integrate well with a belt itself and tend to slide, bounce and chafe.

Although bladder packs have become smaller in size than those initially available, they are still not optimal, especially for running and sports which cause the user's body to undergo jostling or up and down movement due to discomfort associated with the size of the pack, larger sweat trapping area, chafing of shoulder/waist straps, and the inconvenience for such sports as running to drink/draw water from the tube and difficulty with filling and keeping the bladder and tubing hygienic. Some bladder/built-in reservoir packs have eliminated the drinking tube altogether, but are not practical for accessing the contained fluids on-the-go because the whole belt has to be removed/unbuckled to drink from them.

Many active people completely forgo using one of the above mentioned carriers in favor of hand carrying fluid in a bottle with or without a hand strap. But, hand carrying water can be tiring on the hand and back, and cause hand cramping and generally may hinder competitive performance levels over longer periods of strenuous activity.

In addition, the above fluid carrying methods/products heretofore known, suffer from drawbacks and disadvantages in combinations in the following areas:

- cause user discomfort through bouncing and chafing;
- lack optimal ergonomics and contouring relative to the human body;
- incorporate complex use requirements or components;
- difficulty in accessing and replacement of bottle/container while in use;
- unreliable retainment or security of bottle in holster (falls out);
- require additional mechanism or extra user step to secure bottle fully in holster;
- limited bottle security for a wide range of conditions;
- lack optimum physics of carrying mass/fluid on the human body;
- employ features which present obstacles to optimal athletic or general performance;
- limited versatility for range of uses and range of users;
- difficult to use and/or inconvenient to use;
- difficult to clean and maintain hygienically;
- poorly integrated features; and
- asymmetrically weighted when in use.

A need has arisen, therefore, for a comfortable, lightweight, easy access, user configurable/adjustable, convenient, versatile, and hygienic device for carrying a container of fluids, or receptacle for containing other items or substances, on one's person or personal item as well as carrying personal items/electronics/essentials in a comfortable, versatile bounce-free manner.

OBJECTS AND ADVANTAGES

There has now been developed, and disclosed herein a new and novel bottle and device which has a number of advantages not possessed by the products of this type known to heretofore be available. A retaining device adapted for holding a bottle, container (or containers), the retaining device being adapted to affix the container by way of the retaining device to a person or a personal item so ready access is provided for the held container/item embodying the principals of the invention has a foundation/retaining device portion with means of retaining a bottle or container portion; a means of attaching the foundation/retaining device portion onto a user's body or other article or being; and a bottle, container or fluid carrying portion. A bottle embodying the principles of the invention has means for being retained in the retaining device as will be disclosed. Also disclosed and discussed there are a number of desirable optional features of the novel invention which can be used with in combination with the disclosed retaining device and associated container or the like, or alone the features in combinations together, alone, etc. incorporated into belts packs, bags, personal, item carriers/holders, military items or the like. Some of these optional disclosed features/elements include: a system/way of constructing a belt portion with stretch-limiting, bounce limiting means, a belt, strap or the like with an interchangeable closure element that can incorporated a pocket or the pocket can be alone incorporated into a belt, strap or the like. Accordingly, several objects and advantages of the present invention are:

- the system can be fabricated in a manner that is lightweight and durable;
- can be configured in a way that maximizes comfort and eliminates bouncing and chafing;
- can be user configured to fit a variety of use requirements and body types;
- can be manufactured simply and inexpensively;
- easy to access and replace the bottle/container while in motion/use;
- reliable retainment or security of bottle/container;
- versatile to affix to many different personal or other items for a wide range of uses and users;
- simple to use; and
- easy to clean and maintain hygienically.

SUMMARY OF THE INVENTION

In accordance with the present invention a retaining device adapted for holding a container (or containers), the retaining device being adapted to affix the container by way of the retaining device to a person or a personal item so ready access is provided for the held container/item embodying the principals of the invention has a foundation/retaining device portion with means of retaining a bottle or container portion; a means of attaching the foundation/retaining device portion onto a user's body or other article or being; and a bottle, container or fluid carrying portion. And, as discussed there are a number of desirable optional features of the novel invention which can be used with in combination with the disclosed retaining device and associated container or the like, or alone the features in combinations together, alone, etc. incorporated into belts packs, bags, personal, item carriers/holders, military items or the like. Some of these optional disclosed features/elements include: a system/way of constructing a belt portion with stretch-limiting, bounce limiting means, a belt, strap or the like with an interchangeable closure element that can incorporated a pocket or the pocket can be alone incorporated into a belt, strap or the like.

These and other examples of the invention will be described in further detail below.

BRIEF DESCRIPTION OF THE DRAWINGS

Preferred and alternative examples of the present invention are described in detail below with reference to the following drawings:

FIG. 7 shows two perspective views of the retaining device portion of the preferred embodiment (7A somewhat of a top perspective view and 7B, somewhat of an underside perspective view). As best seen in FIG. 7A, the clip includes a base 70 having a first arm 54 extending from the base and an opposing second arm 55 extending from the base, a third arm 56 extending from the base and an opposing fourth arm 57 extending from the base. The first arm 54 and the third arm 56 join to form a first surface for engaging the first shoulder formed in the third sidewall of the bottle, and in this case the first surface further includes a first lip 58. The second arm 55 and the fourth arm 57 join to form a second surface for engaging the second shoulder formed in the fourth sidewall of the bottle, and as illustrated the second surface comprises a second lip 59. The base of the clip includes a first elongated slot 50 between the first and second arm and an opposing second elongated slot 51 between the third and the fourth arms. A third elongated slot 52 is positioned between the first and third arms and an opposing fourth elongated slot 53 is positioned between the second and the fourth arms. Each of the foregoing slots 50-53 is formed by a pair of projections. Thus, the first slot 50 is formed by a first projection 61 formed in the base and extending from a position adjacent a juncture of the first arm and the base, and a second projection 60 formed in the base and extending from a position adjacent a juncture of the second arm and the base, the first projection extending toward the second projection and defining an opening between the first projection and the second projection to provide access to the first slot 50. The second slot 51 is formed by a third projection 64 formed in the base and extending from a position adjacent a juncture of the third arm 56 and the base, and a fourth projection 65 formed in the base and extending from a position adjacent a juncture of the fourth arm 66 and the base, the third projection extending toward the fourth projection and defining an opening between the third projection and the fourth projection to provide access to the second slot 51. The third slot 52 is formed by a fifth projection 62 formed in the base and extending from a position adjacent a juncture of the first arm 54 and the base, and a sixth projection 63 formed in the base and extending from a position adjacent a juncture of the third arm 56 and the base, the fifth projection extending toward the sixth projection and defining an opening between the fifth projection and the sixth projection to provide access to the third slot 52. The fourth slot 53 is formed by a seventh projection 67 formed in the base and extending from a position adjacent a juncture of the second arm 55 and the base, and an eighth projection 66 formed in the base and extending from a position adjacent a juncture of the fourth arm 57 and the base, the seventh projection extending toward the eighth projection and defining an opening between the seventh projection and the eighth projection to provide access to the fourth slot 53.

FIG. 12 shows a perspective view of another embodiment of the preferred retaining device. The bridge or clasping elements (upward curving opposing side cut-out arms) labeled "x" are configured to mate with a bottle configuration with opposing protrusions or the like that shown in FIG. 3 (also FIG. 6 could be configured to work).

FIG. 13 shows a perspective view of another embodiment of the preferred retaining device configured to mate with a bottle configuration like that shown in FIG. 5 (also FIG. 2 could be configured to work).

FIG. 15 shows a perspective view of another embodiment of the preferred retaining device configured to mate with a bottle configuration like that shown in FIG. 6 (also FIG. 3 could be configured to work).

FIG. 17 shows how the preferred retaining device can be trapped between the belt or the like element and another object(s) (like the user's body). It also could be glued, sewed or otherwise fixed to the retaining device in this manner although usually it is not preferable. It should also be noted that these features could be used to engage many other geometry elements like button holes, slits, slots, holes or the like configured to catch/retain these belt/pad grip elements.

FIG. 25 shows a perspective view of another embodiment (in some cases less preferable than the embodiment shown in FIG. 7) similar to FIGS. 22-24 in which the bottle or the like grip element "t" is configured with projection features "q" to lock into slot or the like features "r" resident in base part "u" which is preferably sewn, glued, ultrasonically, heat or otherwise fixed or the like to belt/strap or the like element "s" made of webbing, strapping, cut fabric or the like.

FIG. 26 shows a perspective view of another embodiment (in some cases less preferable than the embodiment shown in FIG. 7) similar to FIG. 25 in which the bottle or the like grip element "t" is configured with hole or the like features (one labeled "q" for clarification) to fix to projection or the like features (one labeled "r") resident in base part "u" which is preferably sewn, glued, ultrasonically, heat or otherwise fixed or the like to belt/strap or the like element "s" made of webbing, strapping, cut fabric or the like. Features "r" are preferably rivets that pass though holes in part "u" fixing to part "t" but also could be other fastening elements. For example they could be projections integrally molded into part "u" and then heat mushroomed down to fix part "t" to part "u". They could other fasteners like screws, plastic rivets, snaps, etc or the like.

FIG. 7 is an example of retaining device configured to fit with the bottle details disclosed in this figure, although many other retaining device examples disclosed herein could be configured to fit with these bottle details) so that the bottle (or the like) can be held firmly to the retaining device element. Specific geometry (wall thickness, radii, size, shape, etc.) of the preferably concave features varies depending on the desired grip characteristics of the bottle or the like.

FIG. 7 is an example of retaining device configured to fit with the bottle details disclosed in this figure, although many other retaining device examples disclosed herein could be configured to fit with these bottle details) so that the bottle (or the like) can be held firmly to the retaining device element. Specific geometry (wall thickness, radii, size, shape, etc.) of the preferably concave features varies depending on the desired grip characteristics of the bottle or the like.

FIGS. 1 and 2 are example of bottles configured to fit with the retaining device details disclosed in this figure, although many other bottle examples disclosed herein could be configured to fit with these retaining device details) so that the bottle (or the like) can be held firmly to the retaining device element. Specific geometry (wall thickness, radii, size, shape, etc.) of the preferably convex features varies depending on the desired grip characteristics of the bottle or the like. The bottle grip feature area shown in broken line and labeled "xy" suggests that this area could take many forms beyond the preferable form as the section examples depict.

FIGS. 1 and 2 are example of bottles configured to fit with the retaining device details disclosed in this figure, although many other bottle examples disclosed herein could be configured to fit with these retaining device details) so that the bottle (or the like) can be held firmly to the retaining device element. Specific geometry (wall thickness, radii, size, shape, etc.) of the preferably convex features varies depending on the desired grip characteristics of the bottle or the like. The bottle grip feature area shown in broken line and labeled "xy" suggests that this area could take many forms beyond the preferable form as the section examples depict.

(FIG. 7 is an example of retaining device configured to fit with the bottle details disclosed in this figure, although many other retaining device examples disclosed herein could be configured to fit with these bottle details) so that the bottle (or the like) can be held firmly to the retaining device element. The disclosed details/sections depict geometry which is preferable for a relatively flexible bottle material (LDPE, HDPE, PP, PETE, etc.). This geometry is desirable because a somewhat flexible bottle material allows the bottle to be unmated from a retaining device easily by squeezing (as shown in FIGS. 88, 91, etc.) while reliably holding the bottle in place while mated with the retaining device (examples FIGS. 64, 69, etc.). See FIG. 92 feature labeled "retaining device detent" for a desirable retaining device mating geometry for these bottle details. In some cases the feature labeled "retaining device detent" may be desirable to be less rounded on its "bull-nosed" end on one or more rounded sides which could more aggressively grip in the bottle detent features.

Figure 90:
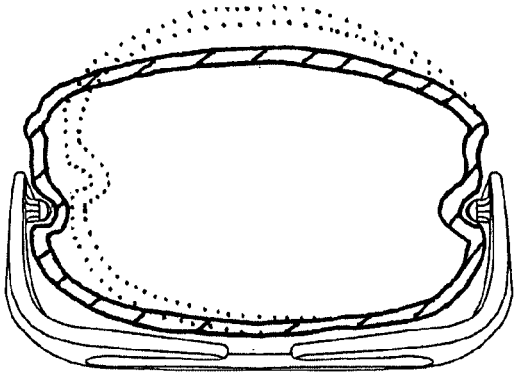
FIG. 90 shows a desirable retaining device embodiment with a desirable cross section of a bottle installed in place and dotted line shows how the bottle can be flexed/squeezed for removal.

The somewhat off-round bottle cross section shown in FIG. 90 facilitates bottle removal as it is flexed somewhat more towards a round shape cross section which does not substantially decrease the contained volume in the bottle (compressing the liquid contained in the bottle could make it hard to remove).

Figure 81:
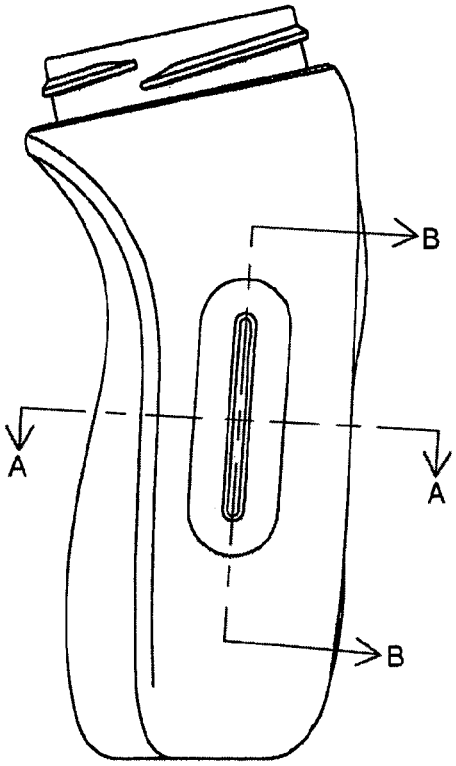
FIG. 81 shows a side view of a bottle of a desirable embodiment of the invention and two section views to show preferred features that are configured to mate with features on the disclosed retaining device
Figure 81:
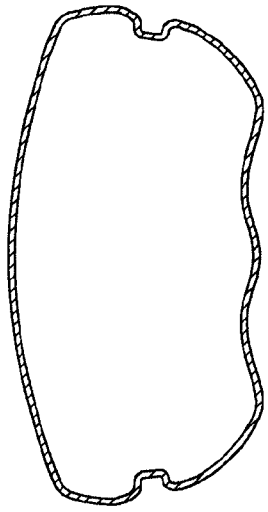
Figure 81:
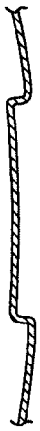
Figure 82:
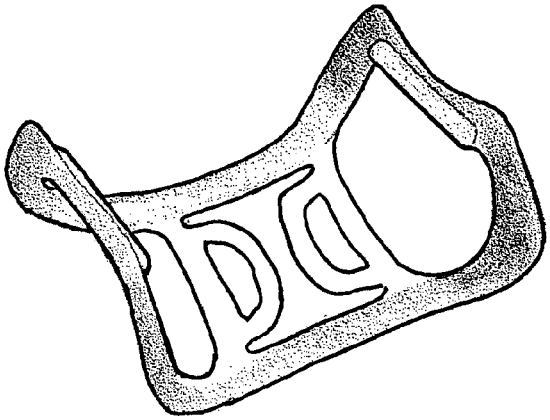
FIG. 82 shows a perspective view of another embodiment of the preferred retaining device configured to mate with a bottle configuration like that shown in FIGS. 2, 81, etc. Less preferable belt engagement features are depicted (belt can be threaded trough slot or slot-like areas). Although the retaining device configuration shown here may be preferable for some applications in some cases the embodiment shown in FIG. 7 is more preferable.
Figure 83:
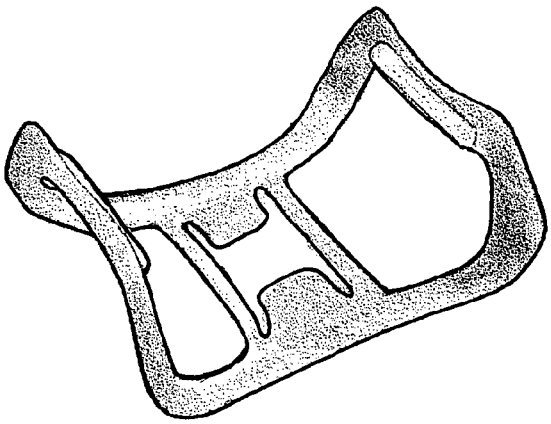
FIG. 83 shows a perspective view of another embodiment of the preferred retaining device configured to mate with a bottle configuration like that shown in FIGS. 2, 81, etc. Less preferable belt engagement features are depicted (belt can be threaded trough slot or slot-like areas). Although the retaining device configuration shown here may be preferable for some applications in some cases the embodiment shown in FIG. 7 is more preferable.
Figure 84:
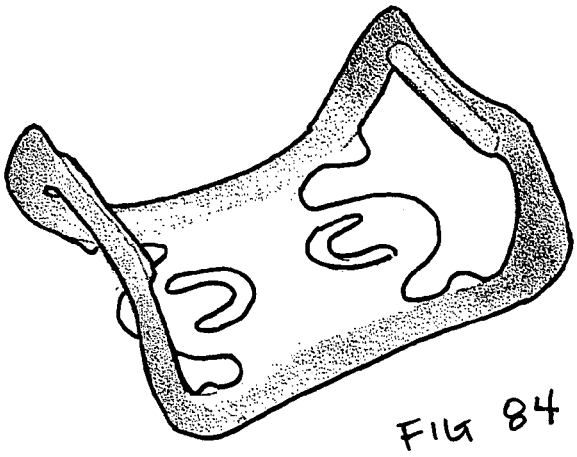
FIG. 84 shows a perspective view of another embodiment of the preferred retaining device configured to mate with a bottle configuration like that shown in FIGS. 2, 81, etc. Less preferable belt engagement features are depicted (belt can be held in place with c-shaped slots through the center, be fed trough the retaining device cutouts, etc.). Although the retaining device configuration shown here may be preferable for some applications in some cases the embodiment shown in FIG. 7 is more preferable.
Figure 85:
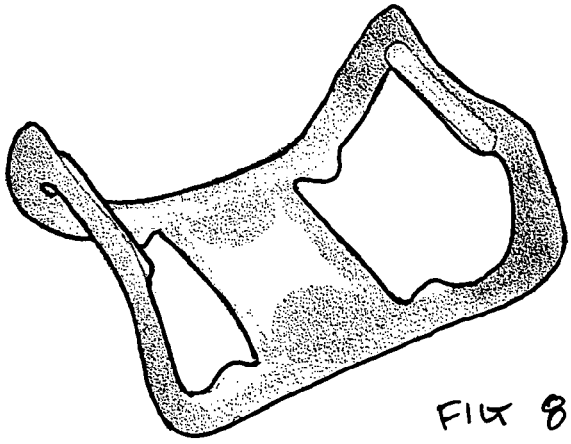
FIG. 85 shows a perspective view of another embodiment of the preferred retaining device configured to mate with a bottle configuration like that shown in FIGS. 2, 81, etc. Belt engagement features are depicted (belt can be held in place under nubs in the retaining device cutouts). Although the retaining device configuration shown here may be preferable for some applications in some cases the embodiment shown in FIG. 7 is more preferable.
Figure 86:
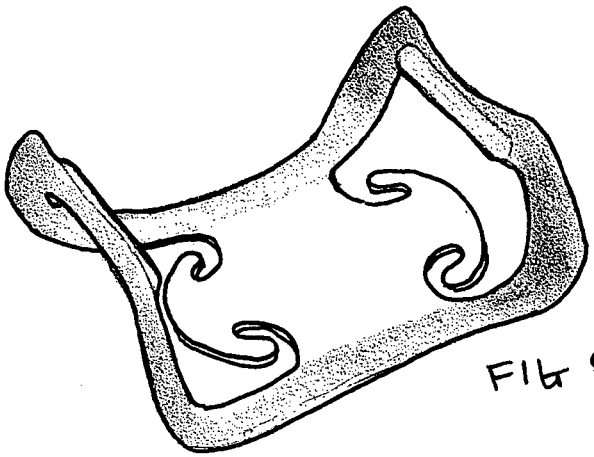
FIG. 86 shows a perspective view of another embodiment of the preferred retaining device configured to mate with a bottle configuration like that shown in FIGS. 2, 81, etc. Less preferable belt engagement features are depicted (belt can be held in place with j-shaped slots through the center, be fed trough the retaining device cutouts, etc.). Although the retaining device configuration shown here may be preferable for some applications in some cases the embodiment shown in FIG. 7 is more preferable.
Figure 87:
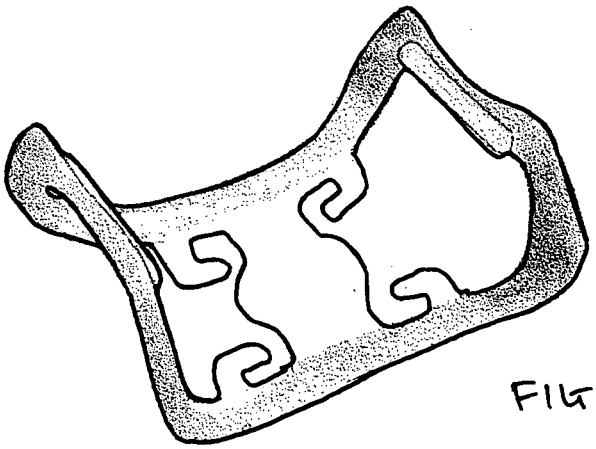
FIG. 87 shows a perspective view of another embodiment of the preferred retaining device configured to mate with a bottle configuration like that shown in FIGS. 2, 81, etc. Less preferable belt engagement features are depicted (belt can be held in place with hook-shaped slots through the center, be fed trough the retaining device cutouts, etc.). Although the retaining device configuration shown here may be preferable for some applications in some cases the embodiment shown in FIG. 7 is more preferable.
Figure 91:
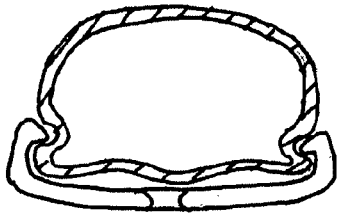

FIG. 91 shows a retaining device view and bottle cross section. For some applications this lower profile retaining device suggested geometry and mating bottle with optional back stiffening features (shown here as an extruded wave-like feature on back) may be desirable. The bottle stiffening elements may have geometry similar to that disclosed in FIGS. 93-97, etc integrated/incorporated into the back (and/or one or more sides of the bottle.) Although the retaining device and bottle configuration shown here may be preferable for some applications in some cases the embodiment shown in FIGS. 7 and 81 respectively are more preferable.

Figure 92:
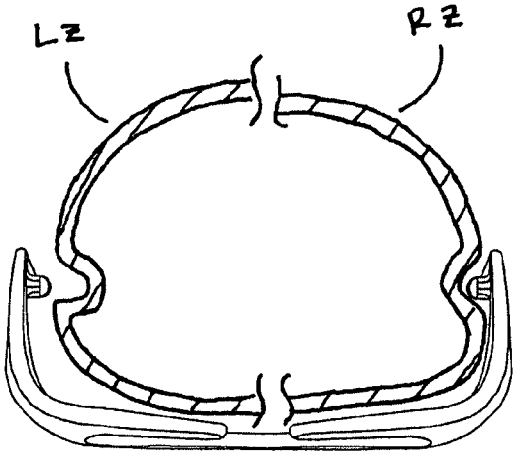

FIG. 92 shows a desirable retaining device embodiment with a desirable cross section of a bottle closely placed so the mating engagement can be more understood. The left side bottle detent is shown more aggressive and right side more soft. The left side "LZ" geometry would be desirable for flexible materials such as LDPE, HDPE, PP, PETE, etc. and the right side "RZ" softer geometry in some cases may be desirable for stiffer materials like Polycarbonate, metals or the like or the previously mentioned plastics (LDPE, HDPE, PP, PETE, etc.) in stiffer geometry and/or wall sections.

Figure 93:
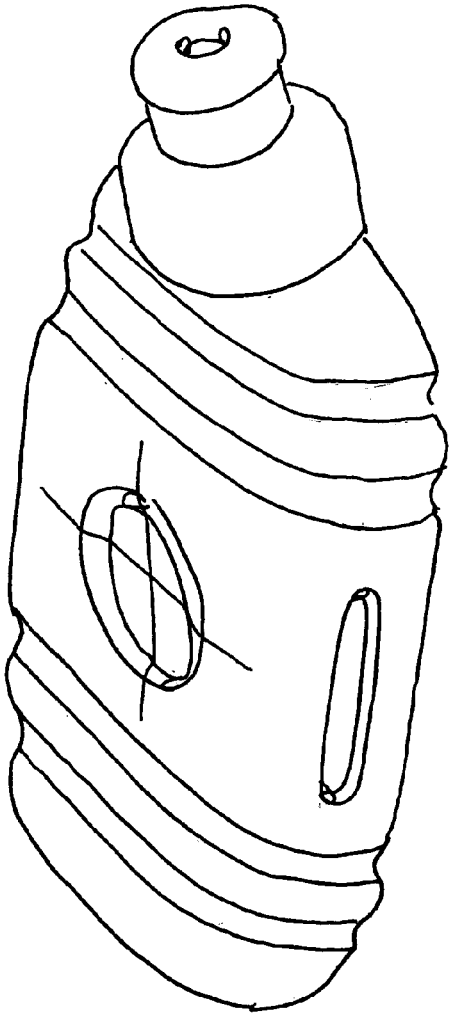

FIG. 93 shows a bottle and with example stiffening features that may be desirable to hold the bottle's shape. Stiffening features similar to these disclosed may be desirable for some flexible materials such as PETE in thin wall sections or other bottle materials that may need stiffening so that the bottle holds its shape but is still flexible to facilitate bottle removal. The back side which is not visible in the drawing could have similar ribbing (or not depending on the desired stiffening result.)

Figure 94:
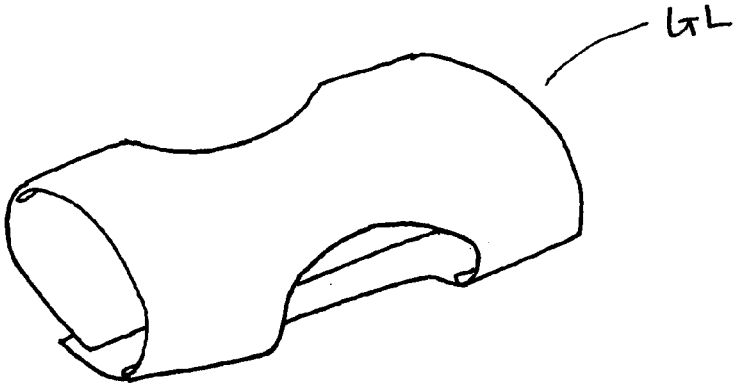
Figure 94:
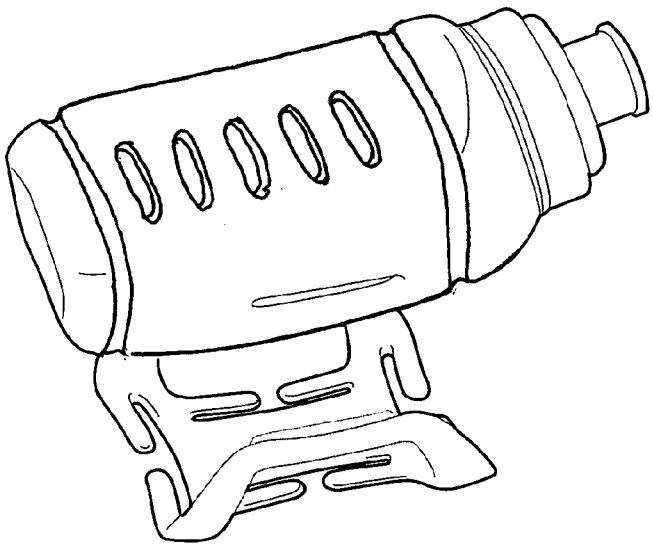

FIG. 94 shows an exploded view of a bottle and with more example stiffening features that may be desirable to hold the bottle's shape. Stiffening features similar to these disclosed may be desirable for some flexible materials such as PETE in thin wall sections or other bottle materials that may need stiffening so that the bottle holds its shape but is still flexible to facilitate bottle removal. Also shown is a desirable retaining device and an example graphic label "GL" that could be applied for marketing and aesthetic results. The back side which is not visible in the drawing could have similar ribbing (or not depending on the desired stiffening result).

Figure 95:
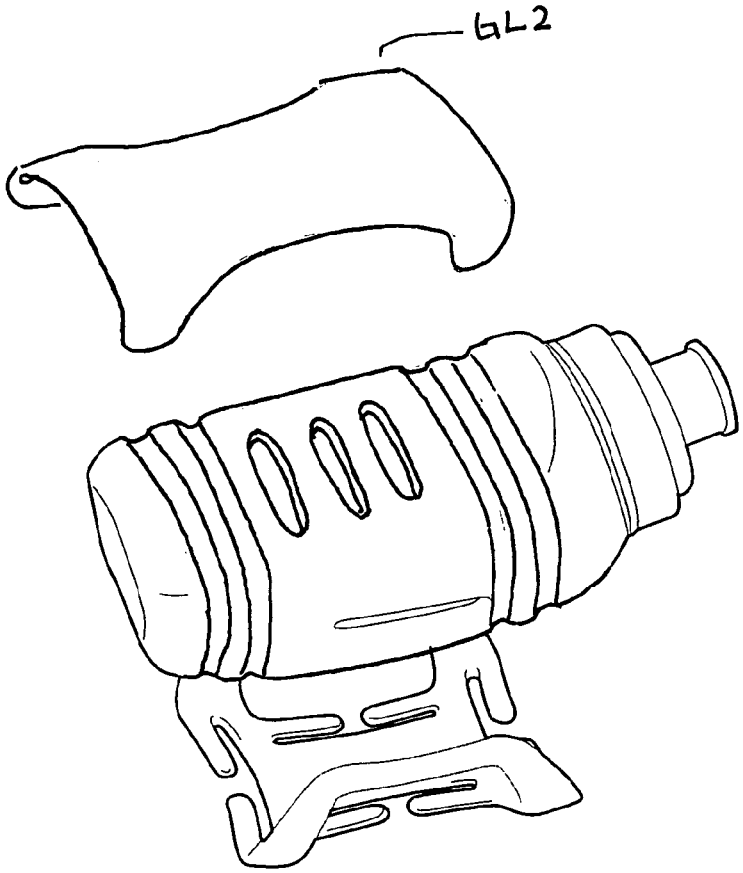

FIG. 95 shows an exploded view of a bottle and with more example stiffening features that may be desirable to hold the bottle's shape (depending on many considerations including desired volume held, material stiffness considerations, manufacturing/shipping considerations, etc). Stiffening features similar to these disclosed may be desirable for some flexible materials such as PETE in thin wall sections or other bottle materials that may need stiffening so that the bottle holds its shape but is still flexible to facilitate bottle removal. Also shown is a desirable retaining device and another example graphic label "GL2" that could be applied for marketing and aesthetic results. The back side which is not visible in the drawing could have similar ribbing (or not depending on the desired stiffening result).

Figure 96:
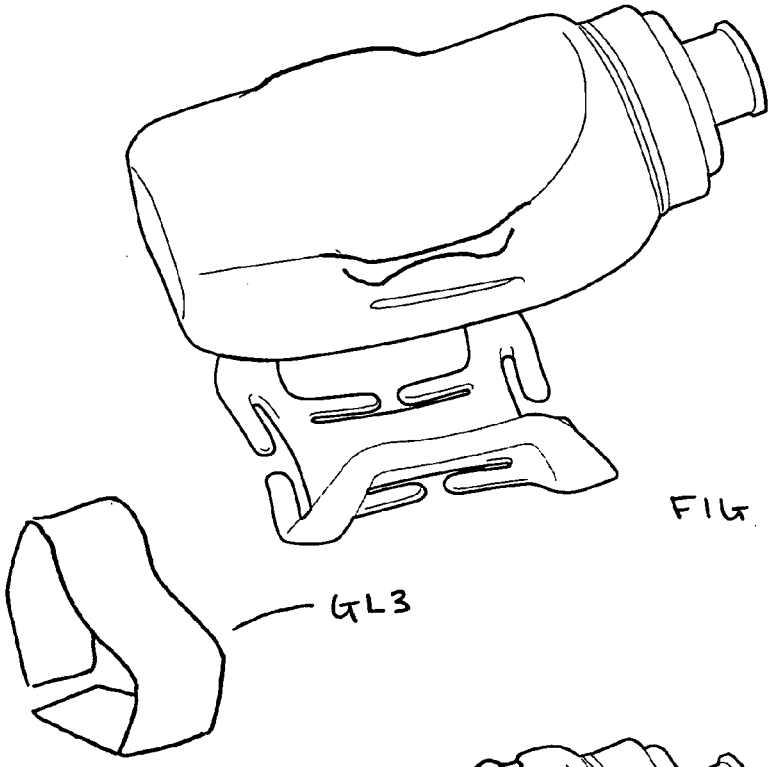

FIG. 96 shows an exploded view of a bottle and with more example stiffening features that could also act as finger grab/ bottle removal features.

Figure 97:
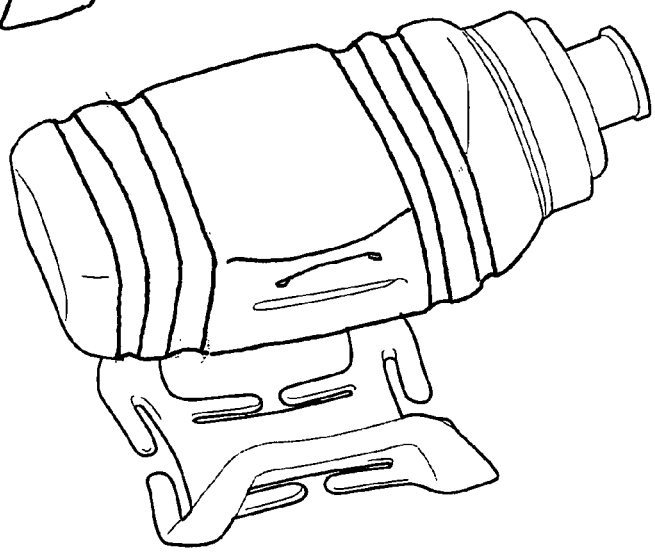

FIG. 97 shows an exploded view of a bottle and with more example stiffening features that may be desirable to hold the bottle's shape/ grab details. Stiffening features similar to these disclosed may be desirable for some flexible materials such as PETE in thin wall sections or other bottle materials that may need stiffening so that the bottle holds its shape but is still flexible to facilitate bottle removal. Also shown is a desirable retaining device and another example graphic label "GL3" that could be applied for marketing and aesthetic results. The back side which is not visible in the drawing could have similar ribbing (or not depending on the desired stiffening result).

Figure 7:
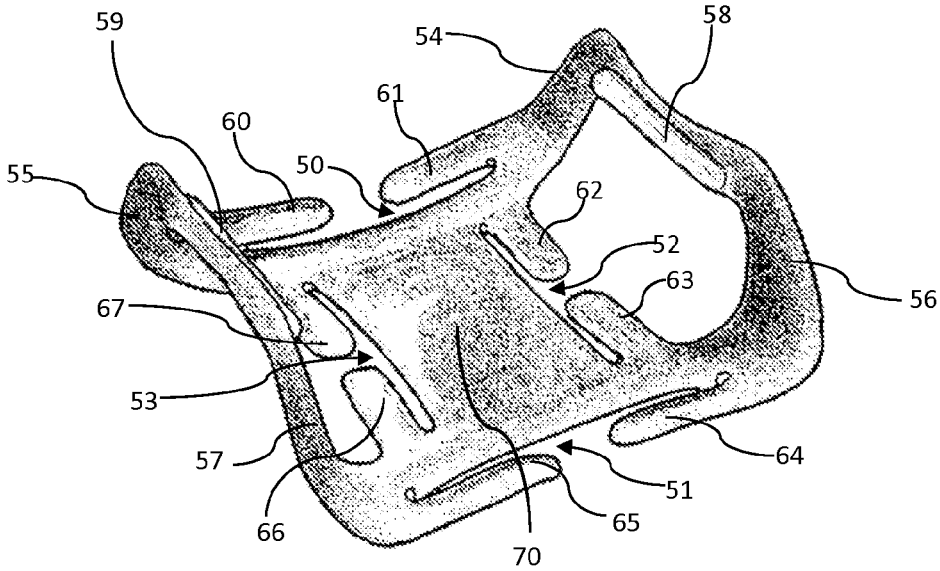
(FIG. 7 is an example of retaining device configured to fit with the bottle details disclosed in this figure, although many other retaining device examples disclosed herein could be configured to fit with these bottle details) so that the bottle (or the like) can be held firmly to the retaining device element.
Figure 7:
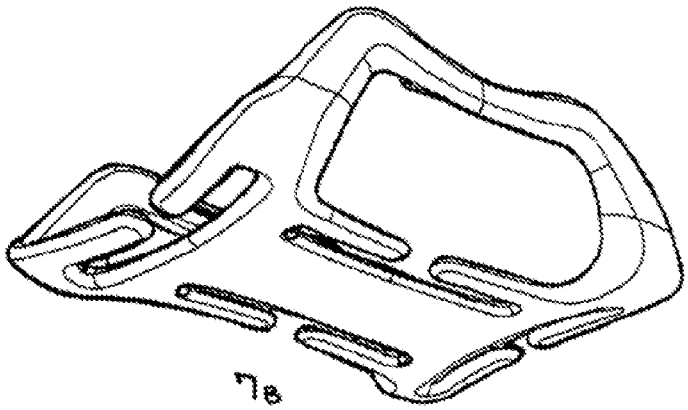
Figure 98:
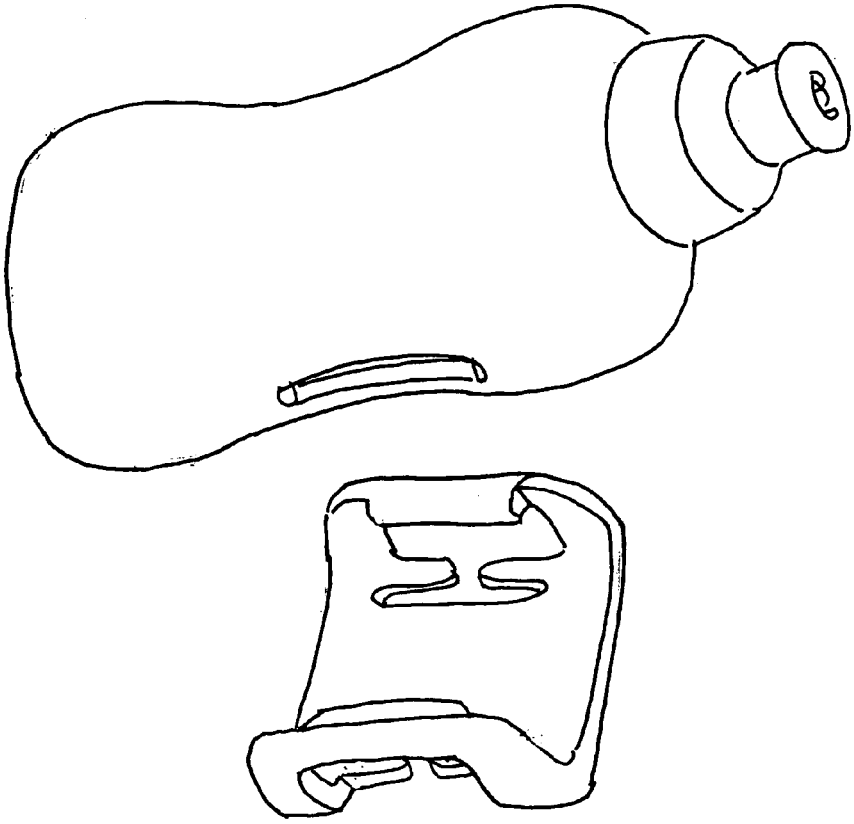

FIG. 98 shows an exploded view of a bottle with an hourglass shape that may be desirable in some cases that more liquid volume is desired while using a somewhat small retaining device. There are other reasons an hourglass-shaped bottle may be desirable like for easy gripping, structural rigidity, comfort, etc. Although this more simple retaining device configuration shown here may be preferable for some applications in some cases the embodiment shown in FIG. 7 is more preferable.

Figure 99:
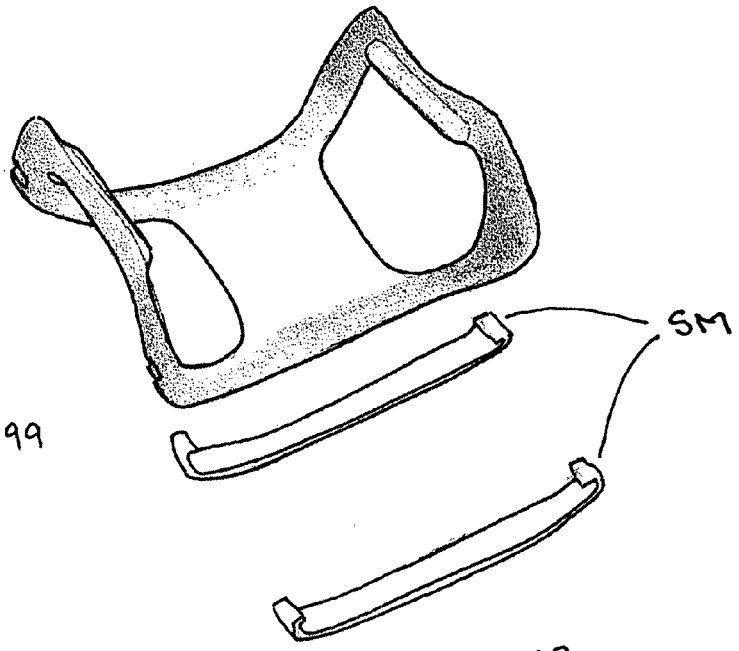

FIG. 99 shows an exploded view of a desirable retaining device in which metal spring stiffening members "SM" are added, press-fit, snapped, or otherwise affixed in place for structure, anti-creep, etc. These metal parts could also be less springy and be bent by the user to fit a desired bottle geometry firmly. Although this retaining device configuration shown here may be preferable for some applications in some cases the embodiment shown in FIG. 7 is more preferable.

Figure 100:
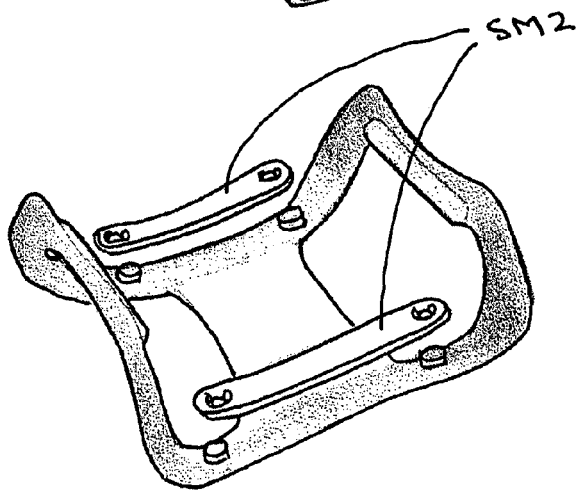

FIG. 100 shows an exploded view of a desirable retaining device in which metal spring stiffening members "SM2" are added, press-fit, snapped, heat staked or otherwise affixed in place for structure, anti-creep, etc. These metal parts could also be less springy and be bent by the user to fit a desired bottle geometry firmly. Although this retaining device configuration shown here may be preferable for some applications in some cases the embodiment shown in FIG. 7 is more preferable.

Figure 101:
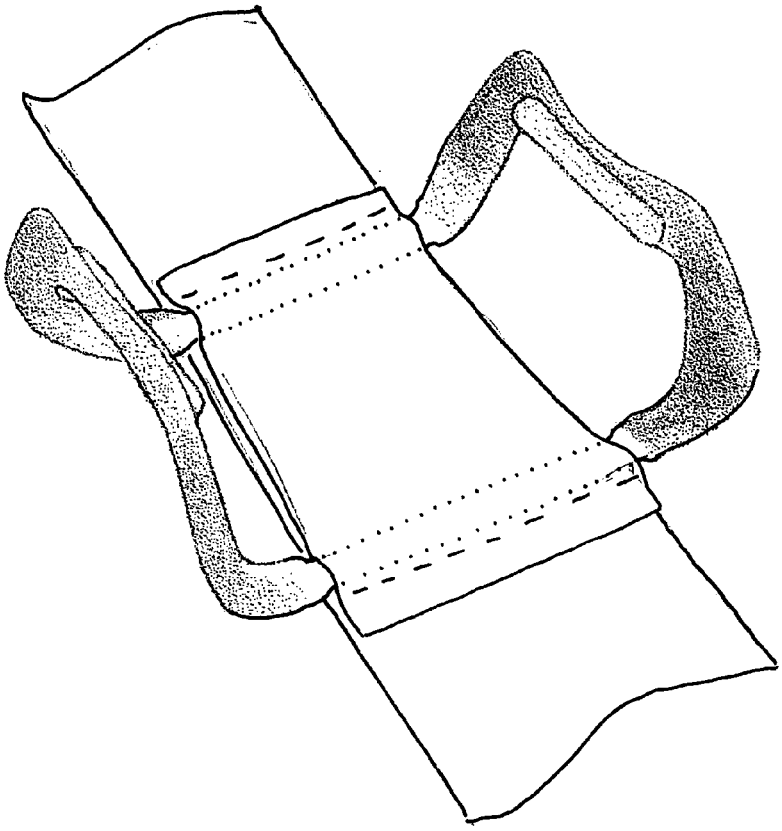

FIG. 101 shows a view of a desirable retaining device as it is assembled to a strap portion. The central dotted lines represents the hidden portion of the retaining device, the dashed line represents a stitch line or other fastening means. Although this retaining device configuration shown here may be preferable for some applications in some cases the embodiment shown in FIG. 7 is more preferable.

Figure 102:
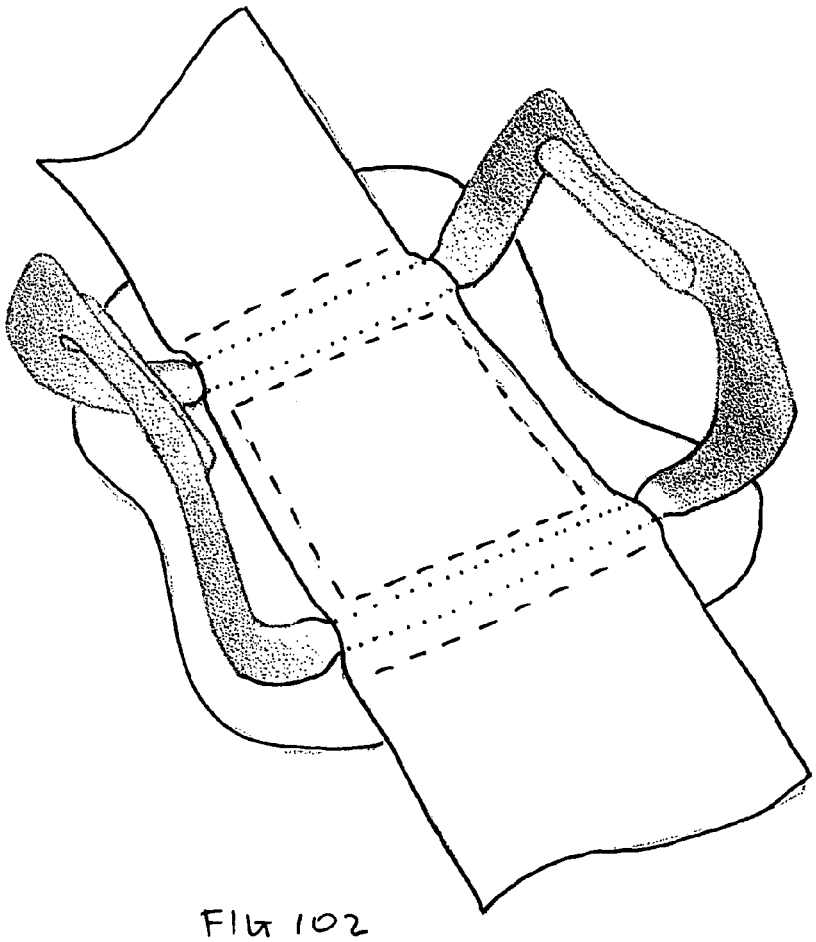

FIG. 102 shows a view of a desirable retaining device as it is assembled to a strap portion and pad. The central dotted lines represents the hidden portion of the retaining device, the dashed line represents a stitch line or other fastening means. Although this retaining device configuration shown here may be preferable for some applications in some cases the embodiment shown in FIG. 7 is more preferable.

Figure 103:
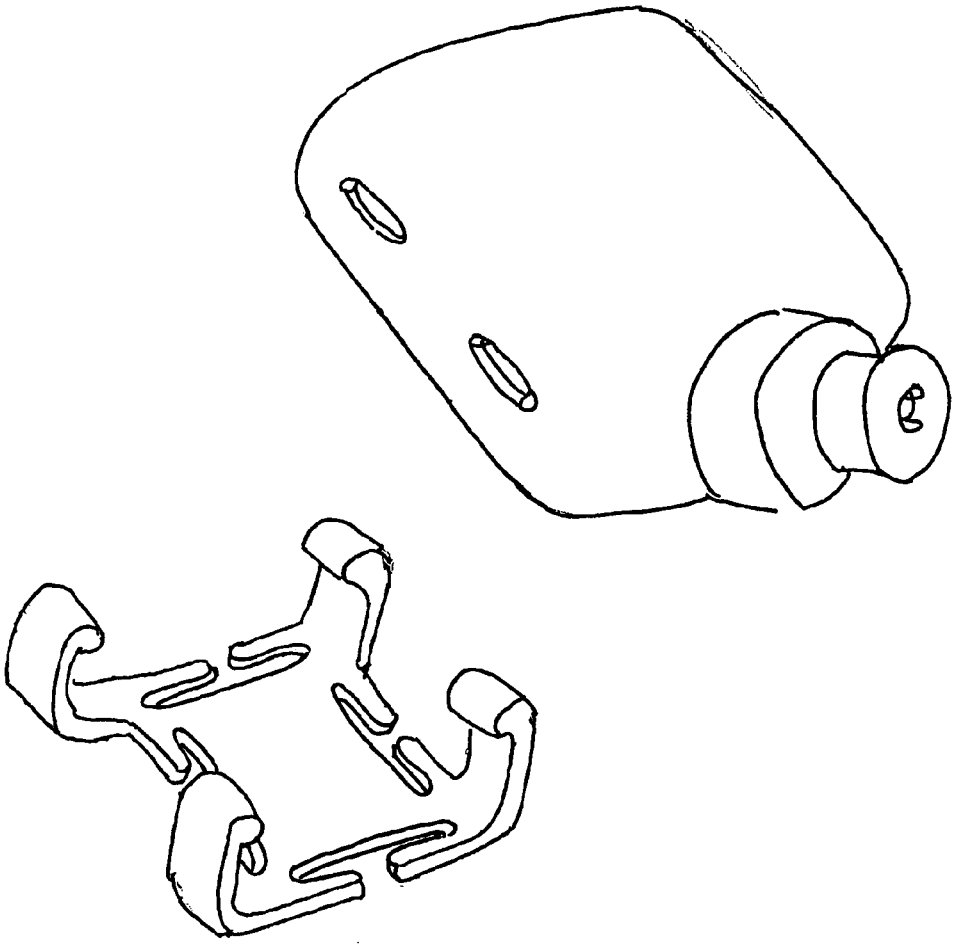

FIG. 103 shows an exploded view of a less desirable bottle and retaining device. Although the retaining device configuration shown here may be preferable for some applications in some cases the embodiment shown in FIG. 7 is more preferable.

Figure 104:
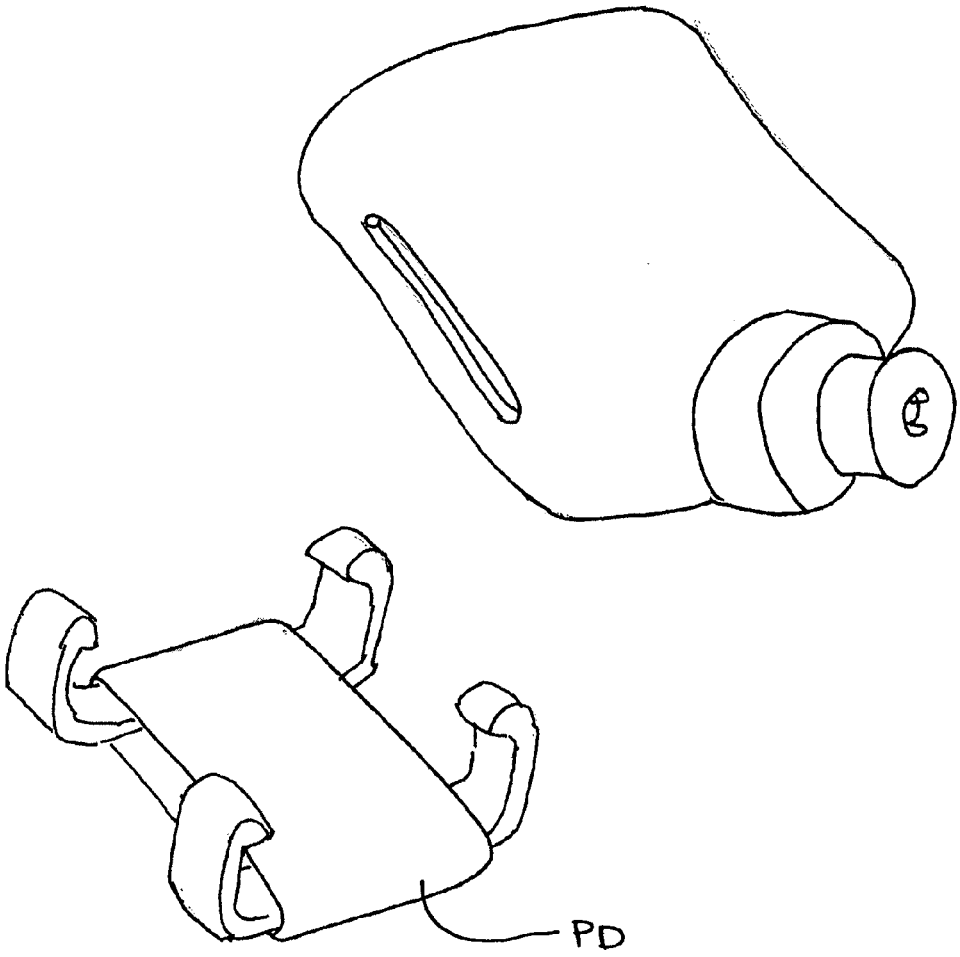

FIG. 104 shows a partially exploded view of a bottle, retaining device and strap/pad "PD" that may be desirable for some applications. The pad/band-like strap "PD" can be used to contain/hold the retaining device to a strap or strap-like ("host item") element by threading the strap through the band. Also the band can be rotated on the retaining device 90 degrees (around an axis perpendicular to the retaining device's somewhat flat foundation area) to fit a strap threaded through the center u-like area. Although the retaining device configuration shown here may be preferable for some applications in some cases the embodiment shown in FIG. 7 is more preferable.

Figure 105:
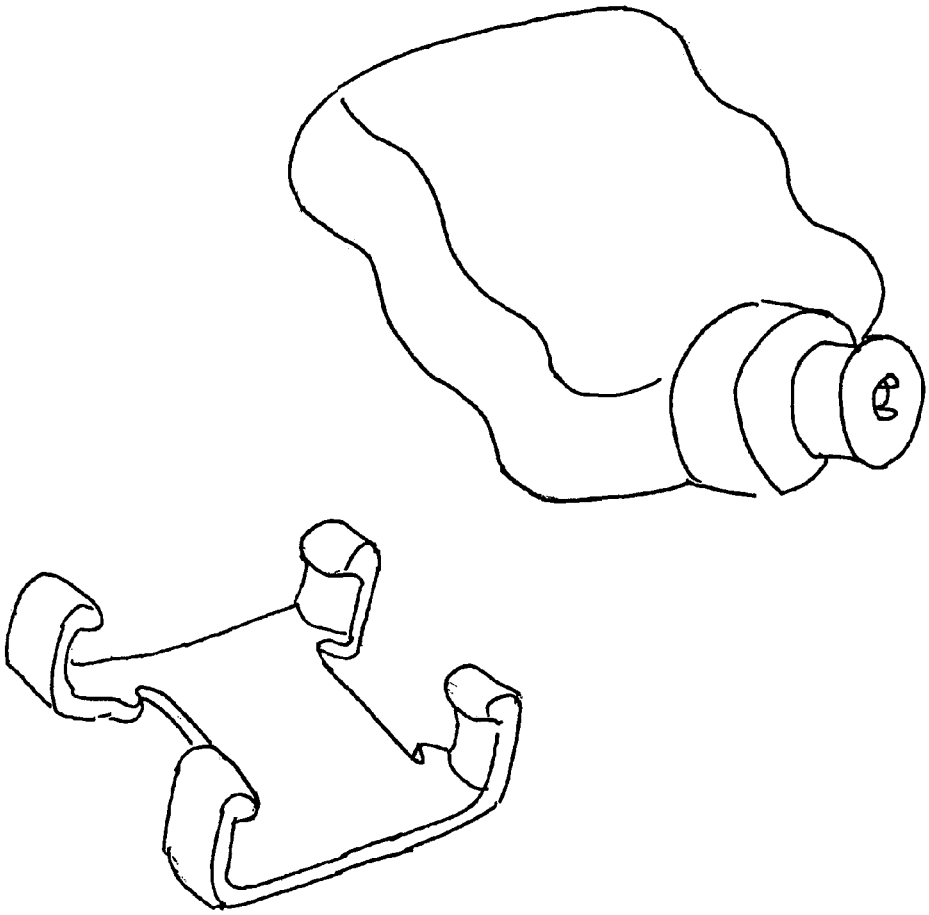

FIG. 105 shows an exploded view of a bottle and retaining device that may be desirable for some applications. Although the retaining device and bottle configuration shown here may be preferable for some applications in some cases the embodiment shown in FIGS. 7 and 81 respectively are more preferable.

Figure 106:
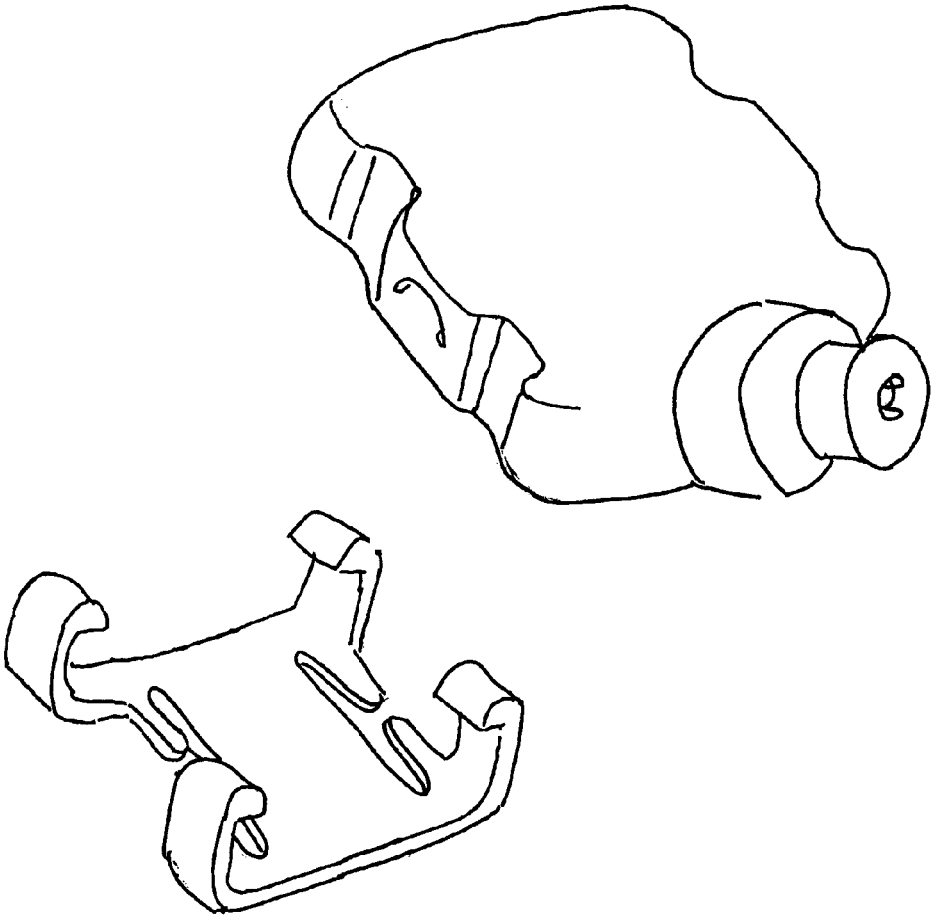

FIG. 106 shows an exploded view of another bottle and retaining device that may be desirable for some applications. Although the retaining device and bottle configuration shown here may be preferable for some applications in some cases the embodiment shown in FIGS. 7 and 81 respectively are more preferable.

Figure 107:
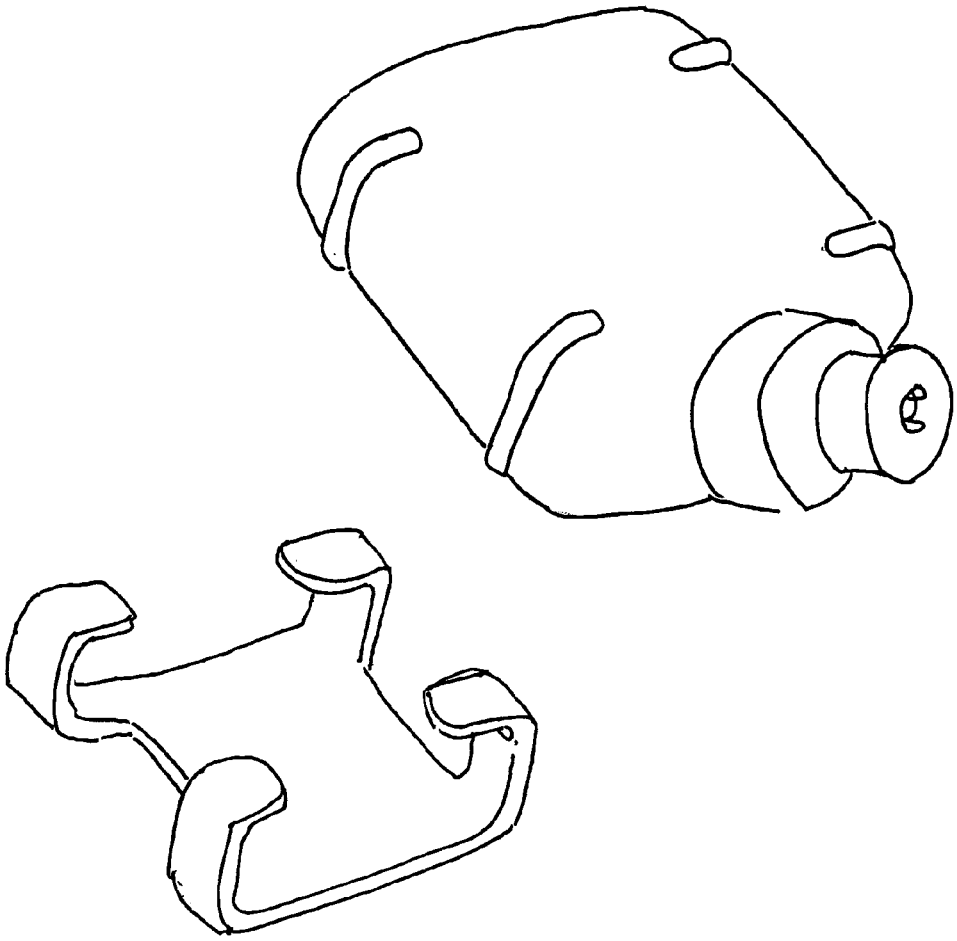

FIG. 107 shows an exploded view of another bottle and retaining device that may be desirable for some applications. Although the retaining device and bottle configuration shown here may be preferable for some applications in some cases the embodiment shown in FIGS. 7 and 81 respectively are more preferable.

Figure 108:
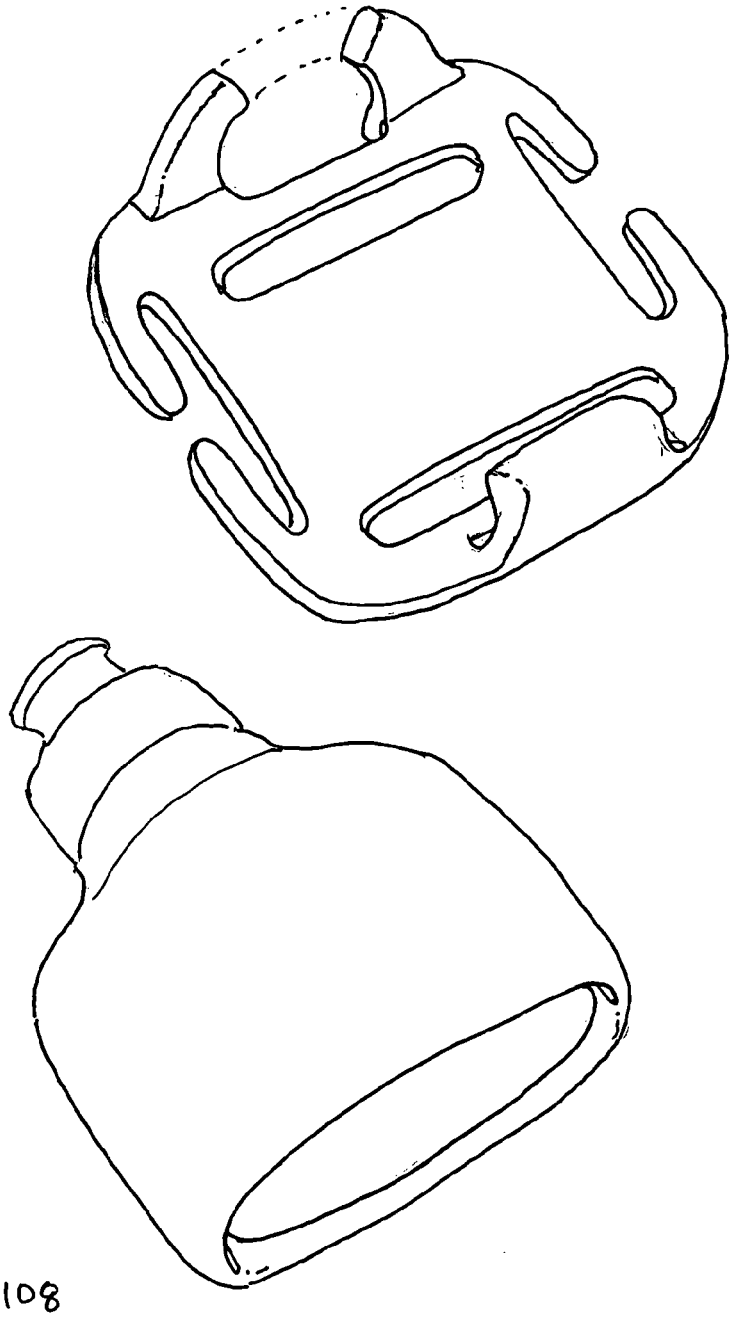

FIG. 108 shows an unmated view of another bottle and retaining device that may be desirable for some applications. Although the retaining device and bottle configuration shown here may be preferable for some applications in some cases the embodiment shown in FIGS. 7 and 81 respectively are more preferable. The dotted line on the retaining device shows how this area can optionally be closed more ring-like to more securely hold the neck of the bottle.

Figure 109:
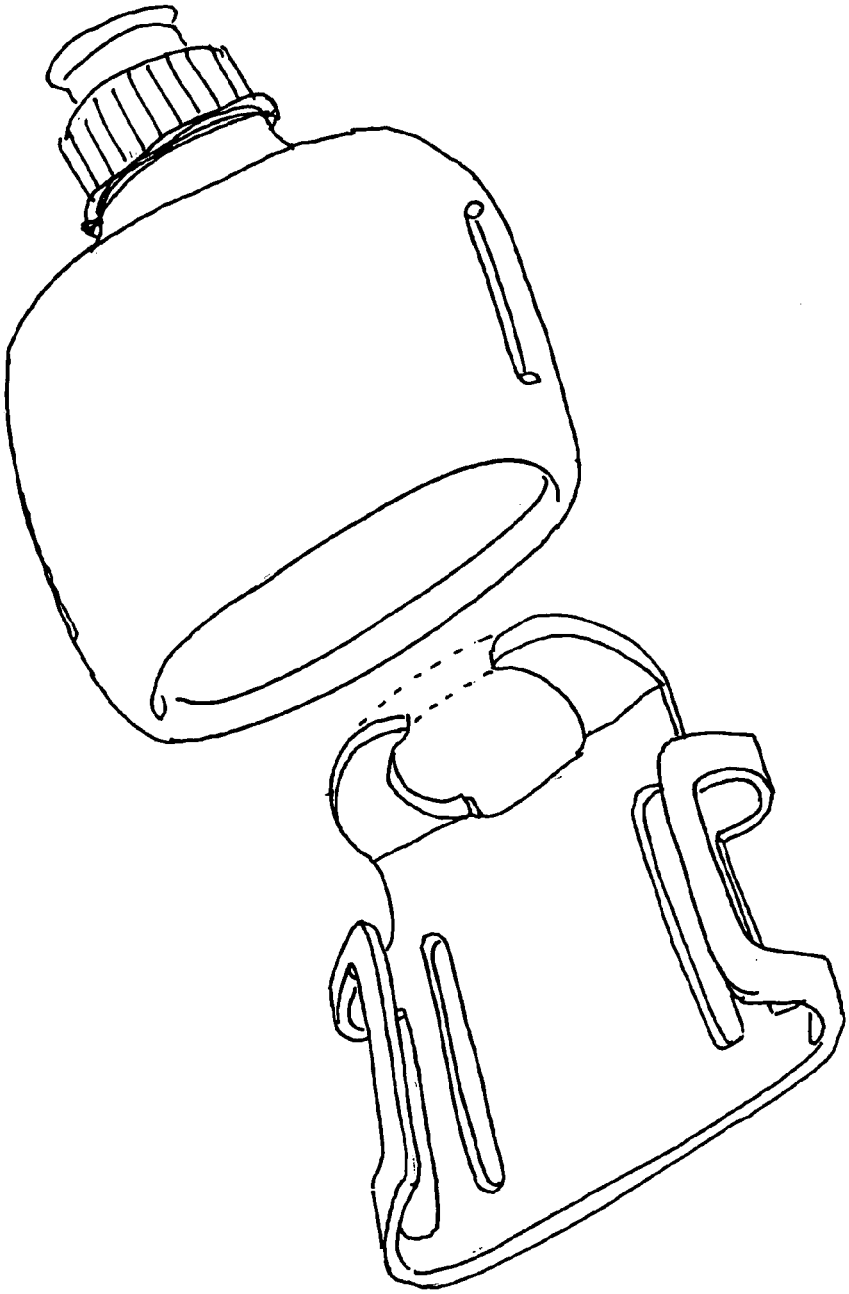

FIG. 109 shows an unmated view of another bottle and retaining device that may be desirable for some applications. Although the retaining device and bottle configuration shown here may be preferable for some applications in some cases the embodiment shown in FIGS. 7 and 81 respectively are more preferable. The dotted line on the retaining device shows how this area can optionally be closed more ring-like to more securely hold the neck of the bottle.

Figure 110:
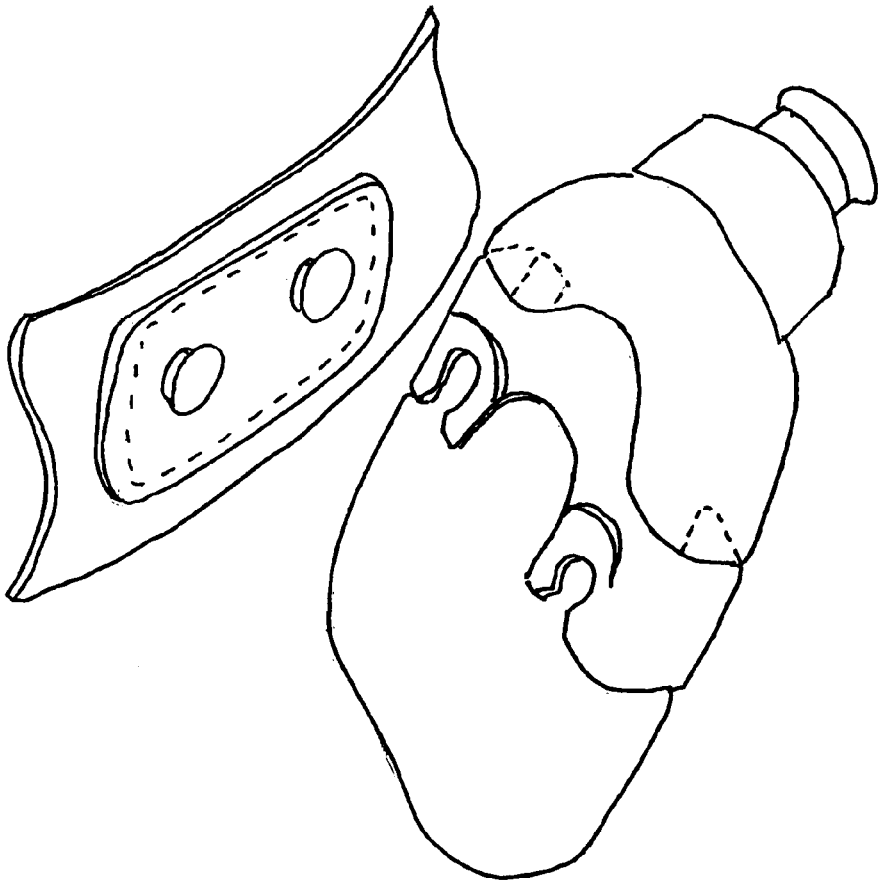

FIG. 110 shows an unmated view of a less desirable bottle and retaining device that may be desirable for some applications. Although the retaining device and bottle configuration shown here may be preferable for some applications in some cases the embodiment shown in FIGS. 7 and 81 respectively are more preferable. This drawing shows a plate with connection features that can be preferably sewn, glued, grommeted or otherwise affixed to a strap or other "host item". Also a bottle grabbing/holding element is shown.

Figure 111:
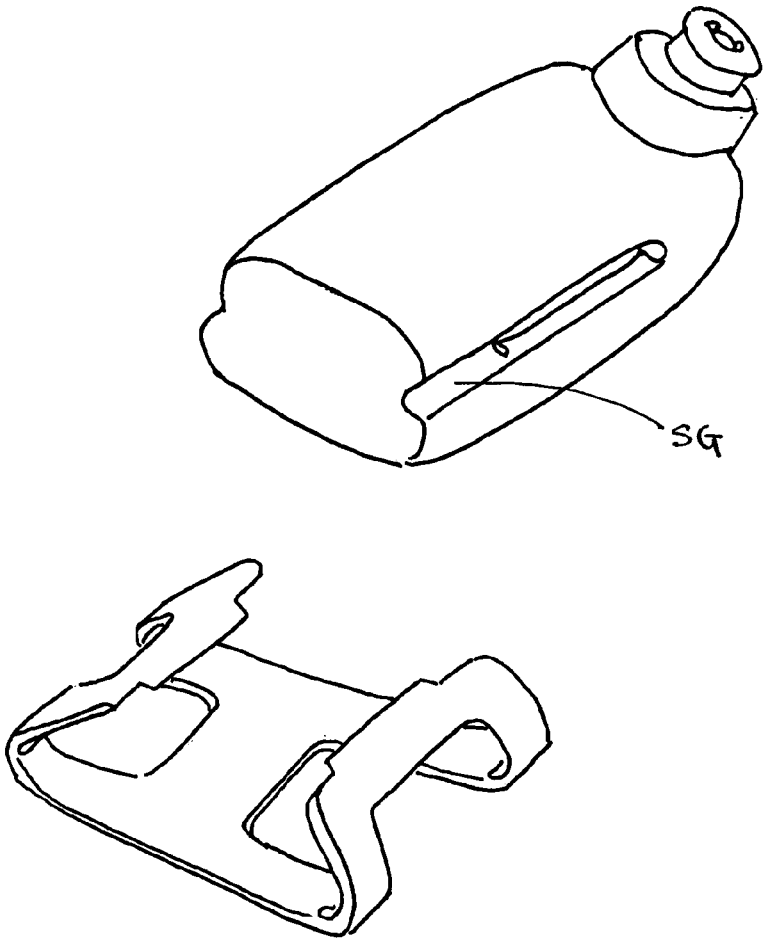

FIG. 111 shows an unmated view of a less desirable bottle and retaining device that may be desirable for some applications. Although the retaining device and bottle configuration shown here may be preferable for some applications in some cases the embodiment shown in FIGS. 7 and 81 respectively are more preferable. This drawing shows a bottle that can be unmated/mated from the retaining device by sliding and/or snapping/pressing in place (as previously discussed and shown in the previously mentioned embodiments). Sliding groove "SG" is shown.

Figure 112:
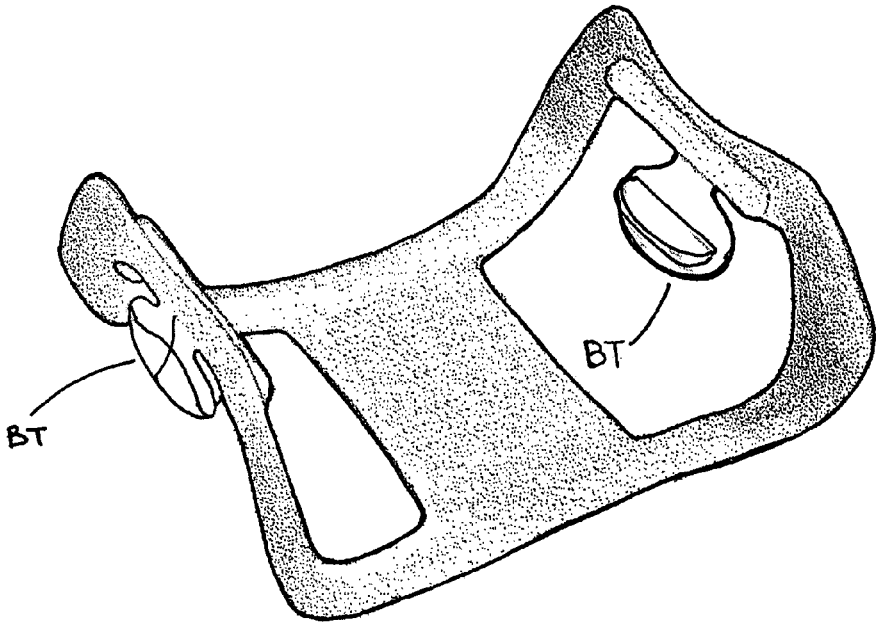

FIG. 112 shows a retaining device with ejection features/buttons "BT". The user would press on these features forcing/popping the bottle (or other "held item") out of the retaining device. Although configuration shown here may be preferable for some applications in some cases the embodiment shown in FIG. 7 is more preferable.

Elements labeled "t" in all figures are preferably injection molded (or the like) from plastic, rubber or the like or combinations thereof Elements labeled "u" in all figures are preferably die-cut and/or injection molded or the like from plastic, rubber, hypalon, fabric or combinations thereof or the like.

DETAILED DESCRIPTION OF THE PREFERRED EMBODIMENT

Detailed Description—Preferred Embodiment

The embodiments described herein have been contemplated for purposes of illustrating the principals of the present invention. Accordingly, the present invention is not to be limited solely to the exact configuration and construction as illustrated and set forth herein.

A. Physical Description of Preferred Retaining Device Architecture

Figure 10:
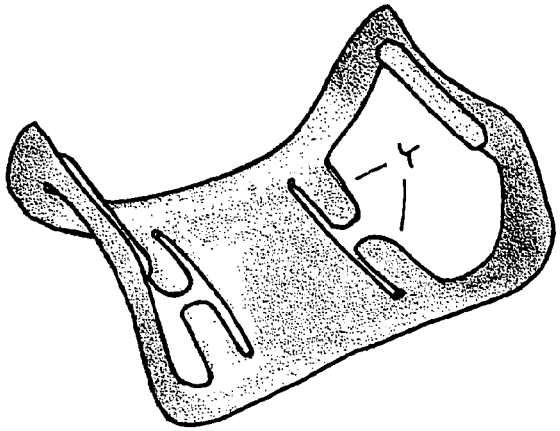
FIG. 10 shows a perspective view of another embodiment of the preferred retaining device showing central belt/pad grip elements (two of four labeled "y" for clarification). Although this configuration with only central belt/pad grip elements (not exterior belt/pad grip features as shown in FIG. 7) may be preferable for some applications in some cases the embodiment shown in FIG. 7 is more preferable.
Figure 11:
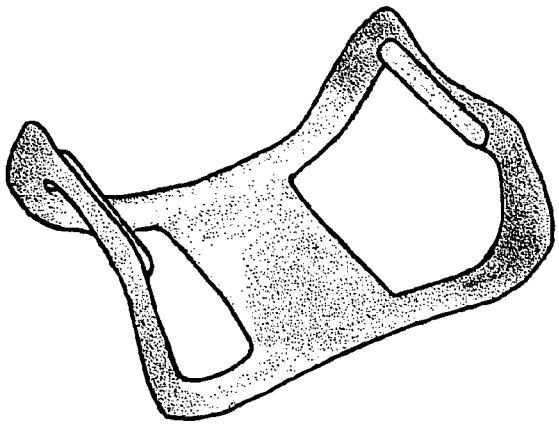
FIG. 11 shows a perspective view of another embodiment of the preferred retaining device. Although this more simple configuration may be preferable for some applications in some cases the embodiment shown in FIG. 7 is more preferable.
Figure 18:
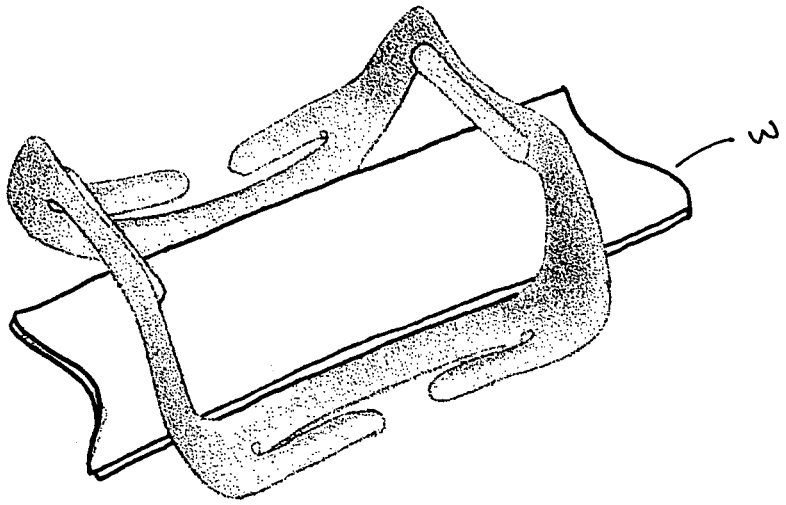
Figure 19:
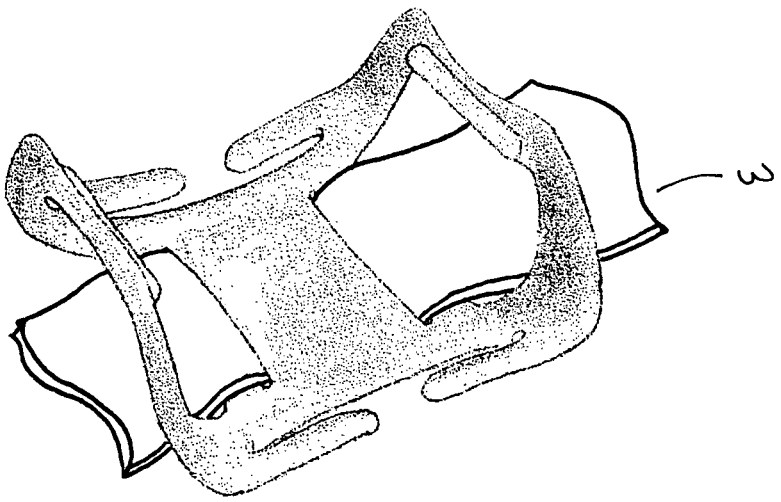
Figure 20:
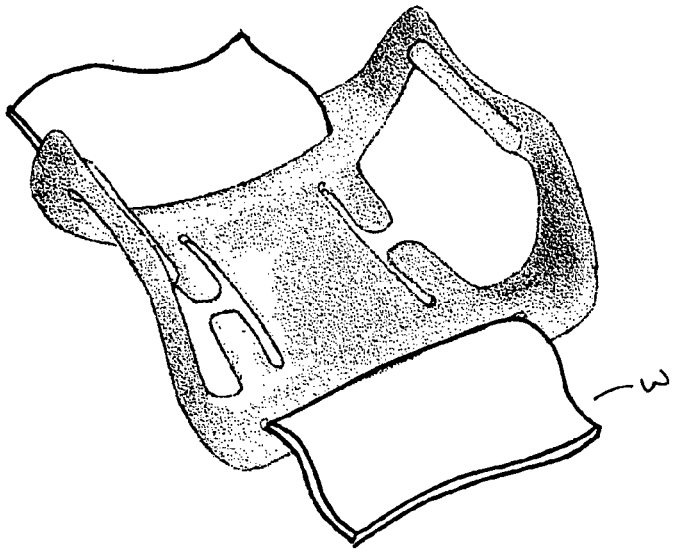
Figure 21:
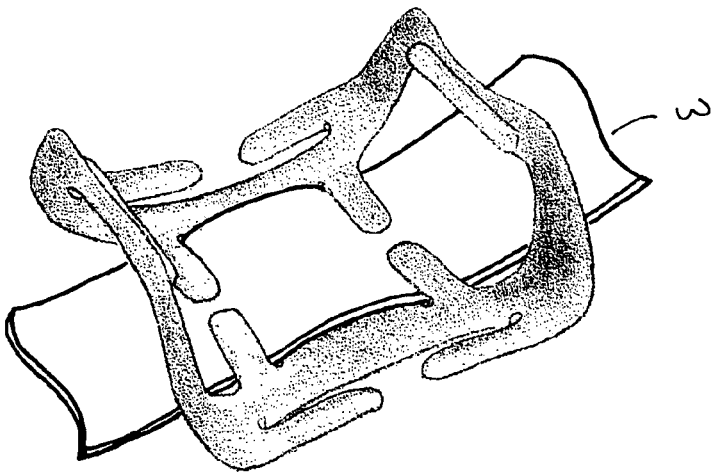
Figure 22:
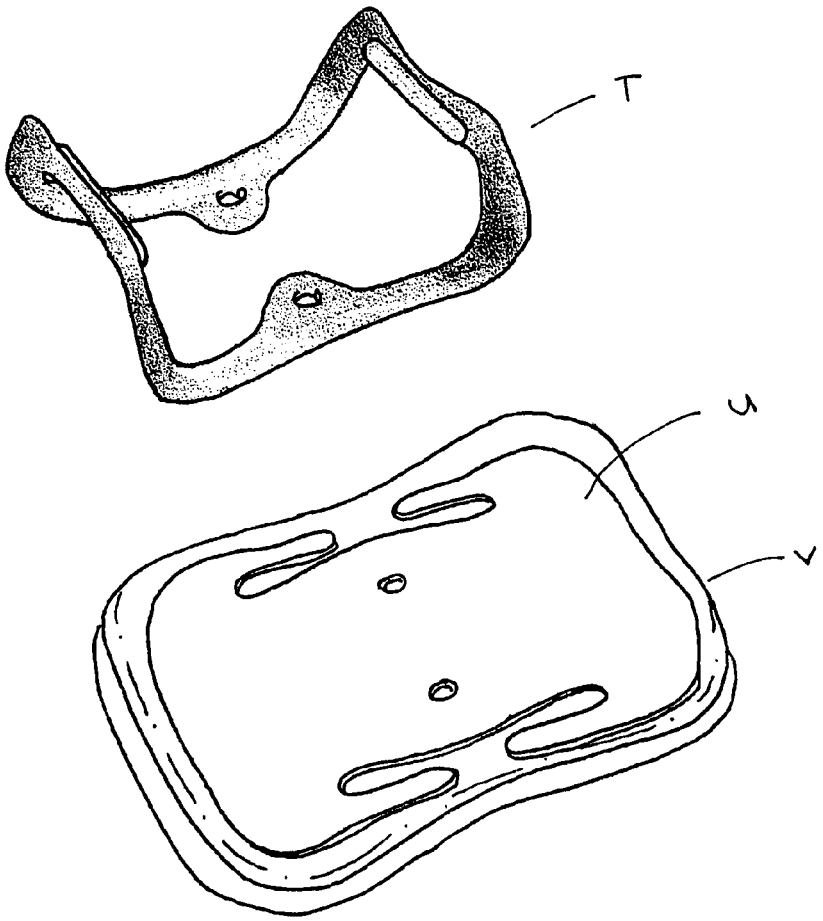
FIGS. 22, 23, 24 show perspectives views of another embodiment (in some cases less preferable than the embodiment shown in FIG. 7) of the preferred retaining device configured to be made from at least two separate parts (part "u" is cut/molded slightly different in each figure to show some different options for this part with and without belt/pad grip features). Bottle or the like grip element labeled "t" would be preferably injection molded plastic or the like. Base element "u" with integral belt grip features (or not) would be preferably die-cut or injection molded plastic or the like. Optional pad element "v" is preferably die-cut and/or sewn from cushioned fabric and/or foam or the like and held in place fixed to the assembly with adhesive, sewn in place (to "u" and/or "t") and/ or trapped in place. (See FIGS. 16-21 for some examples of belt or the like attachment methods for these assemblies.)
Figure 23:
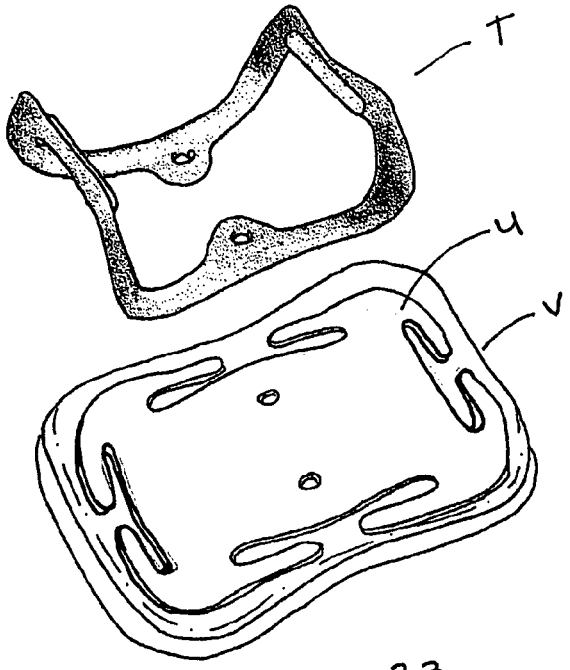
Figure 24:
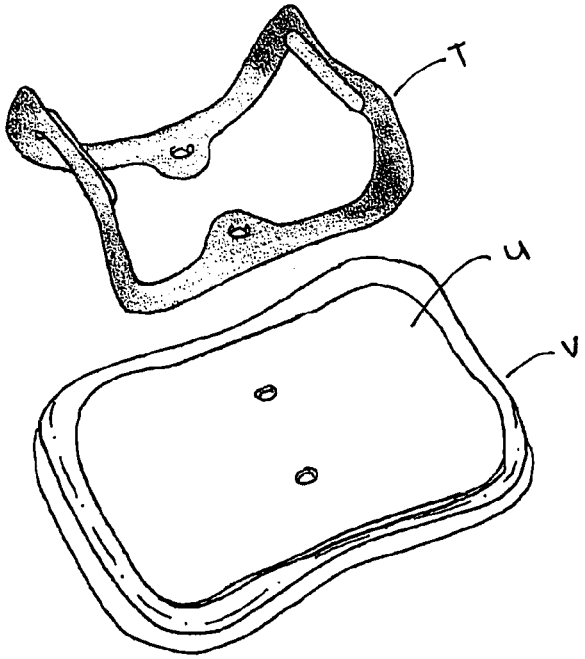
Figure 25:
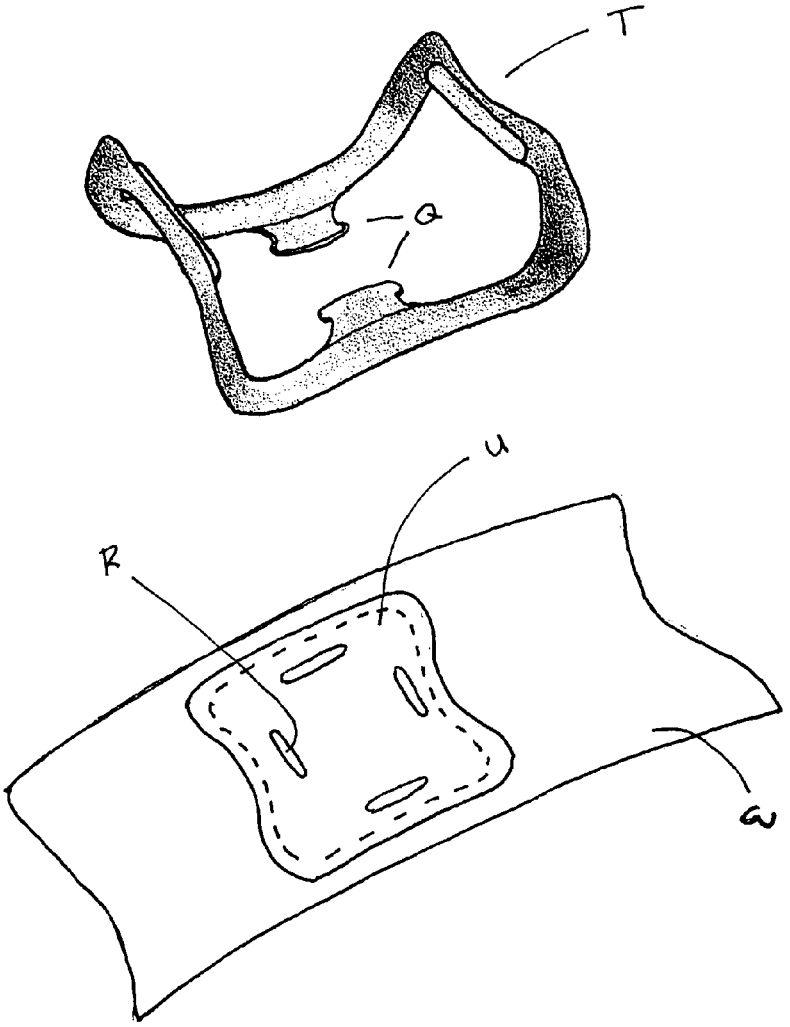
Figure 26:
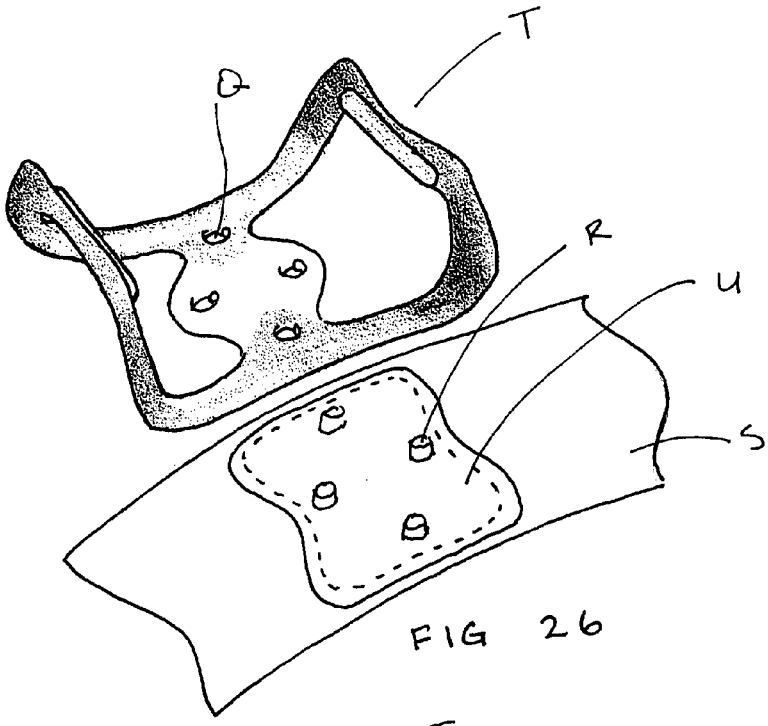
Figure 27:
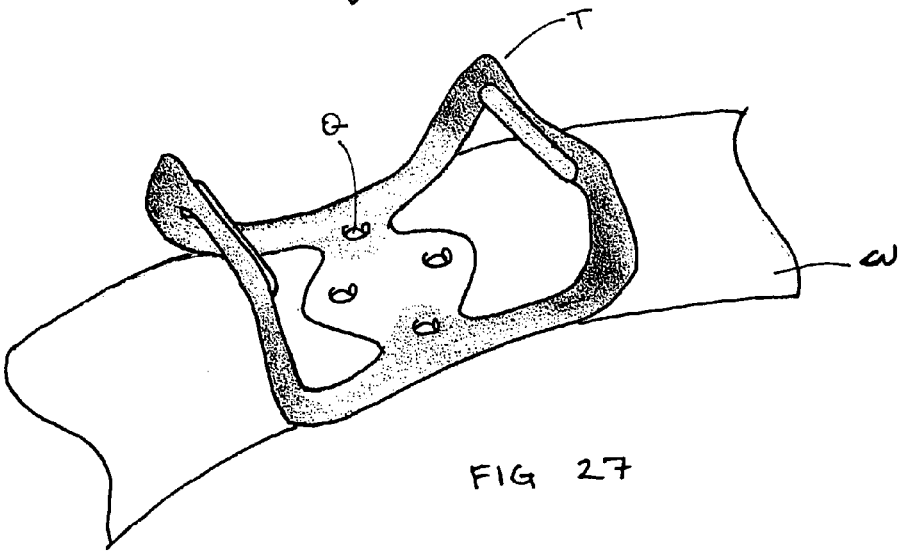
FIG. 27 shows the above same embodiment but part "u" is eliminated (or place behind part "s") and part "t" is fixed directly to strap/belt or the like part "s" with rivets or the like or strap "s" is sandwiched between part "u" and part "t".
Figure 34:
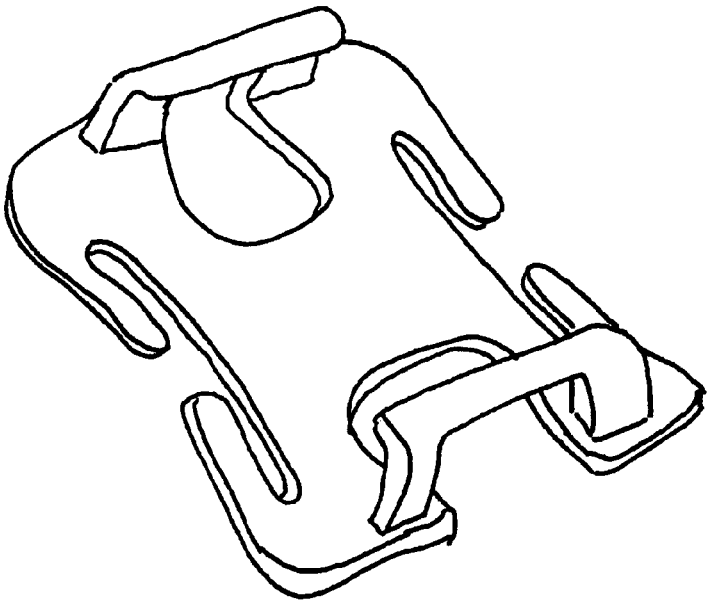
FIG. 34 shows a perspective view of another embodiment of a retaining device similar to FIG. 33 which in some cases is not as preferable as the retaining device shown in FIG. 7.
Figure 35:
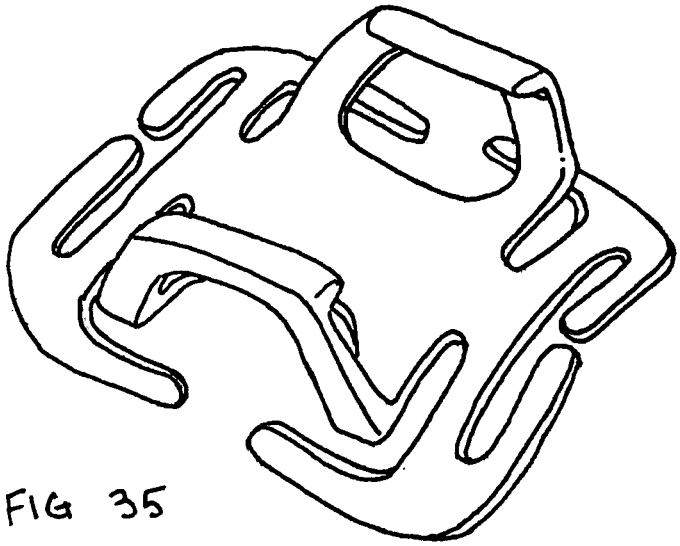
FIG. 35 shows a perspective view of another embodiment of a preferable retaining device configuration, which, although in some cases is not as preferable as the retaining device shown in FIG. 7.
Figure 36:
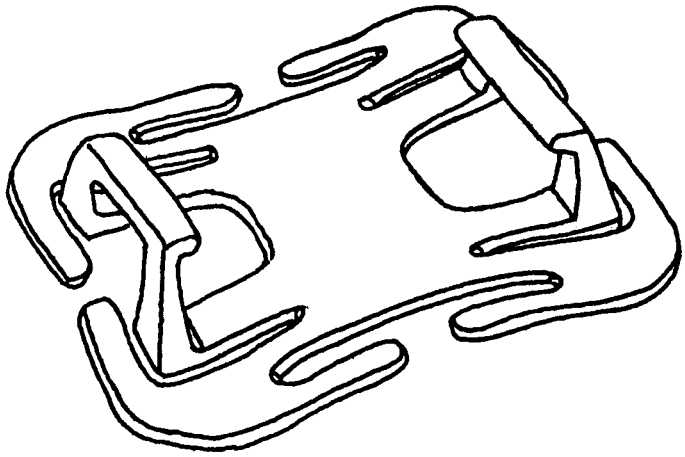
FIG. 36 shows a perspective view of the embodiment shown in FIG. 35 of a preferable retaining device configuration although unlike FIG. 35 the base plate is configured more flat. In some cases this configuration is not as preferable as the retaining device shown in FIG. 7.
Figure 37:
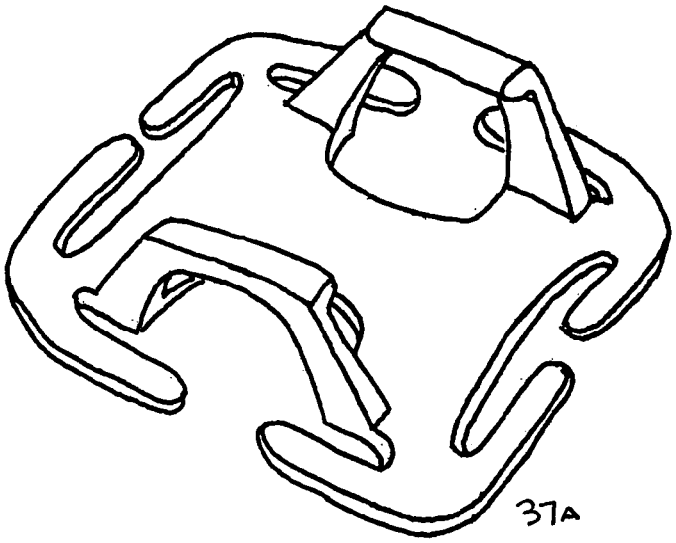
FIG. 37 shows a perspective view of another embodiment of a retaining device similar to FIG. 35 which in some cases is not as preferable as the retaining device shown in FIG. 7 (37A somewhat of a top perspective view and 37B, another somewhat top perspective view).
Figure 37:
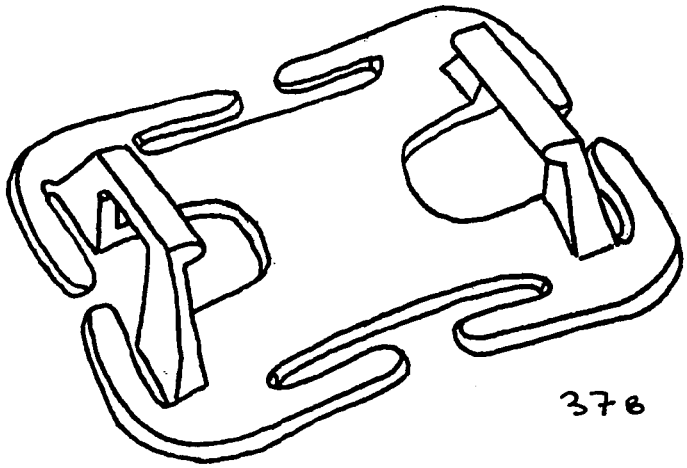

A preferable architecture for the retaining device portion of the invention is shown in FIG. 7 (from two different angles) and FIGS. 76, 77, 78, 79 and others. This preferable retaining device is comprised of a somewhat flattened central base portion, two upward curving opposing side cut-out arms, and numerous engagement cutouts for removeably affixing the retaining device, preferably in one case, to a flat strap type "host or base item". The front side of the preferred somewhat or substantially C-shaped or U-shaped form (see FIG. 77) is of some dimensional depth (a somewhat extruded form) and within this depth (somewhat extrusion) are various cutouts, shaped areas, areas where material is added and/or removed locally for specific purposed as herein described and pictured. Bottle engagement preferable protrusions (shaped much like an elongated mail box with base of preferable mail box feature integrated into the inside of the upwardly extending arms of the substantially U or C-shaped retaining device) are preferably incorporated in the upright or substantially upright side arms of the substantially U or C-shaped retaining device such that the convex tops of the elongated mailbox shaped protrusions substantially face each other with their long axes substantially parallel somewhat at a distance from each other. The long axis of this somewhat elongated mailbox shape is also preferably somewhat parallel to one side of the somewhat flattened, somewhat rectangular central base portion; elongated mailbox shaped protrusions (labeled "PP" in FIG. 77) protruding inward with their convex tops substantially facing towards each other forming retention lips "LP" in FIG. 77. Within the somewhat rectangular central base of the preferred retaining device there are preferably four or more elongated slots, one slot each configured parallel and somewhat close to each somewhat flat side of the somewhat rectangular base. One slot at the base of each cut-out arm and somewhat below the bottle gripping elements (labeled "si" in FIG. 76) and one slot at the front and back of the substantially U or C-shaped retaining device (labeled "so" in FIG. 76). Each slot preferably has an opening somewhat centrally located to one of two long slot sides providing an opening from the slot to the perimeter of the base. Slots "si" preferably opening into cut-out areas in upwardly curving cut-out arms coming up from said base and slots "so" preferably opening towards the perimeter font and rear of said base. The slots and slot openings defining somewhat inwardly/centrally facing/pointing peninsula-shaped features (see FIG. 76). Although four slots are described and pictured in FIG. 7 (and others) some or all of these slots can be eliminated (although it is less preferable). See FIGS. 10, 34 and others for an example of two slots eliminated and FIG. 11 (and others) for all slots eliminated. Cut-outs in upwardly extending arms are shaped and sized such that a belt or the like and preferably an accompanying belt buckle can pass through these cut-out openings (see FIG. 18) and be trapped therein retaining the retaining device on the belt or the like.

The retaining device can be divided into a number of elements/areas "held item" gripped element(s);

- retaining device foundation area" that incorporates the "base item" gripping/holding fastening system;
- belt or the like gripping/holding elements (preferably incorporated into the base area);
- belt or the like gripping/holding elements have potential secondary function as pad connection details;
- optional secondary pad retaining features;
- optional "held item" ejection/removal tabs/features.

As discussed the "held item" grip element(s) could take many other forms besides the disclosed protrusion features supported by arms/walls coming up from the "retaining device foundation area".

Figure 38:
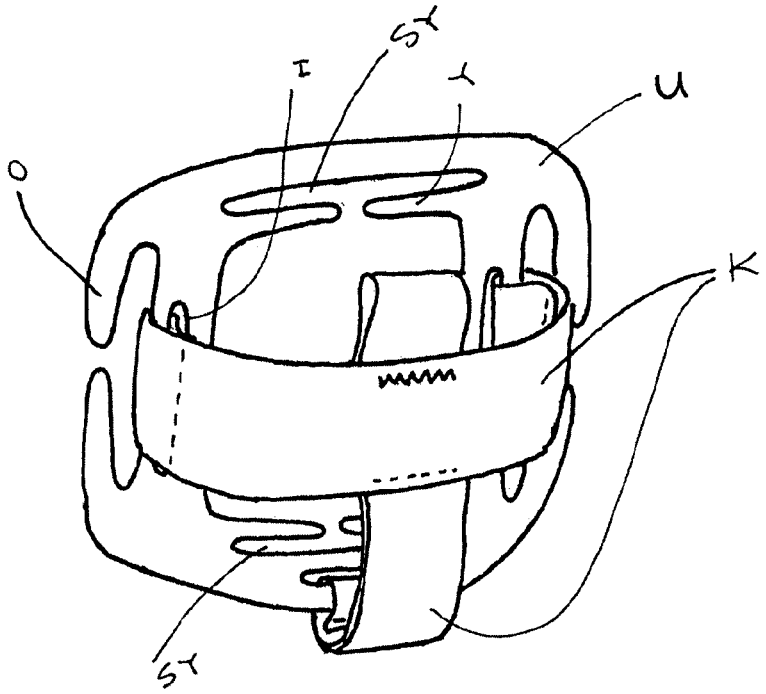
FIG. 38 shows a perspective view of another embodiment of a base element "u" with stretch strap, webbing or the like element "k" which is preferably looped through holes (one of three holes on this figure is labeled "I" for clarification) and sewn or otherwise fixed to itself to form a cage for the bottle or the like element. The preferable stretch strap or the like elements "k" are fastened on either side of "u" (or through slots "I" on "u" and fastened to itself) and at the bottom and sewn or the like together in the center in a "t" or substantially "t" shaped configuration. One of the exterior belt or the like grip elements "o" and one of the interior belt or the like grip elements "y" is labeled for clarification. In many cases this configuration is not as preferable as the retaining device shown in FIG. 7.
Figure 39:
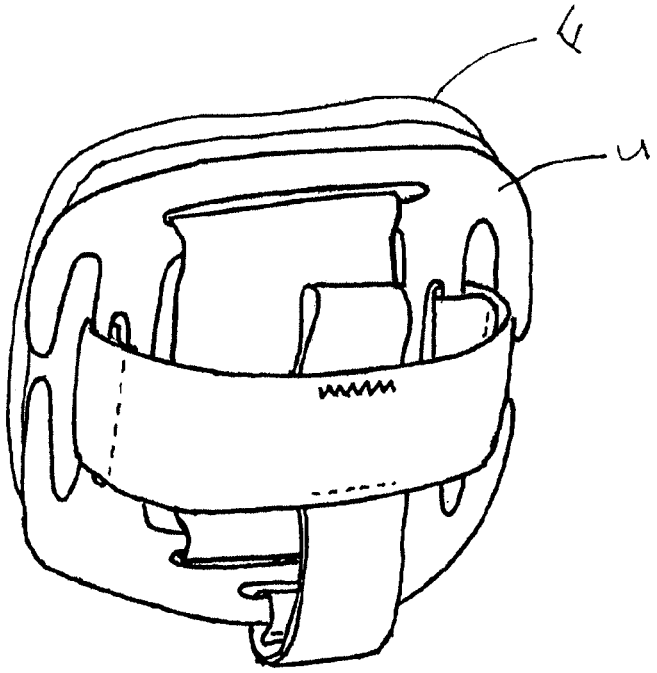
FIG. 39 shows a perspective view the embodiment in FIG. 38 with pad "f" installed to grip elements/projections "y". See FIG. 50 for explanation of the preferable configuration of pad "f".
Figure 40:
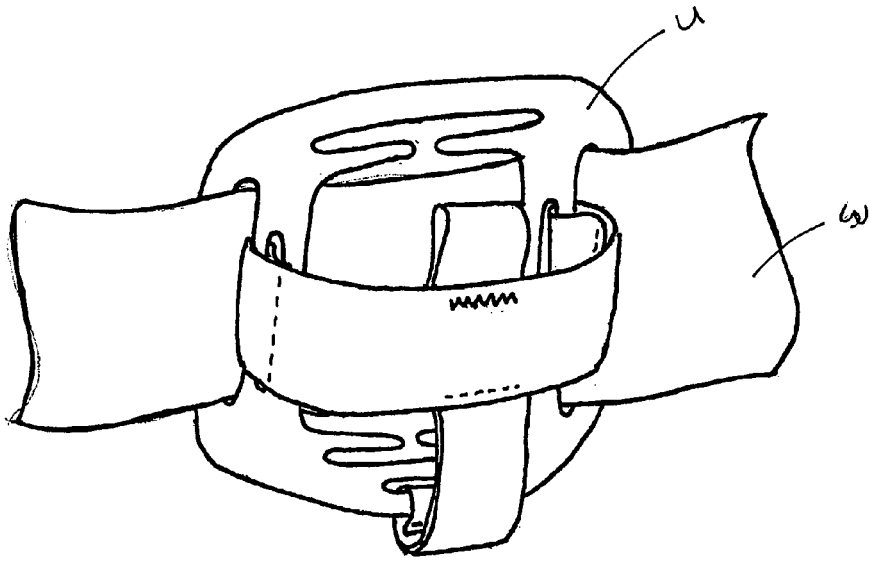
FIG. 40 shows a perspective view the embodiment in FIG. 38 with strap "w" installed to exterior grip elements/projections "o".
Figure 41:
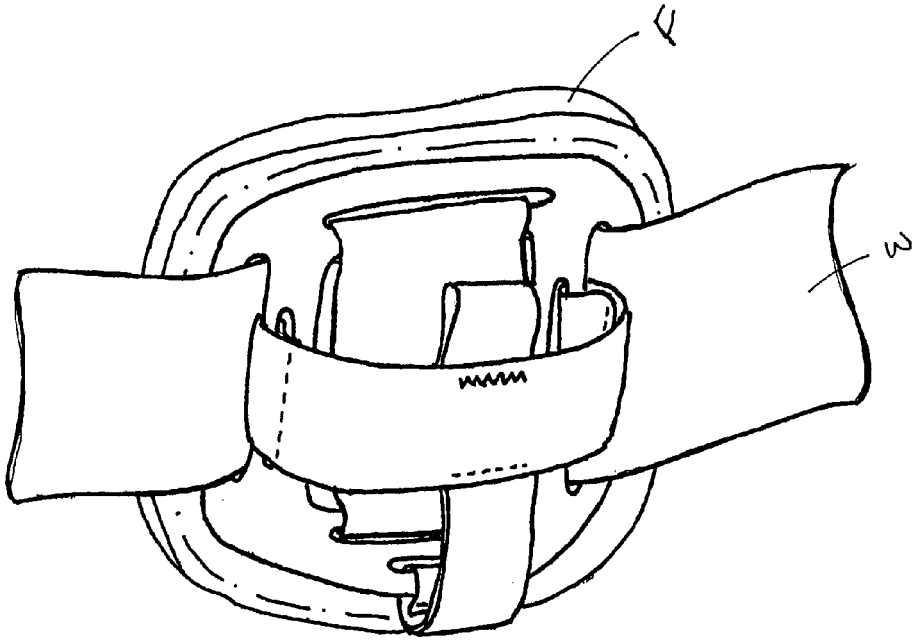
FIG. 41 shows a perspective view the embodiment in FIG. 38 with strap "w" installed to exterior grip elements/projections "o" and pad "f" installed to grip elements/projections "y".
Figure 42:
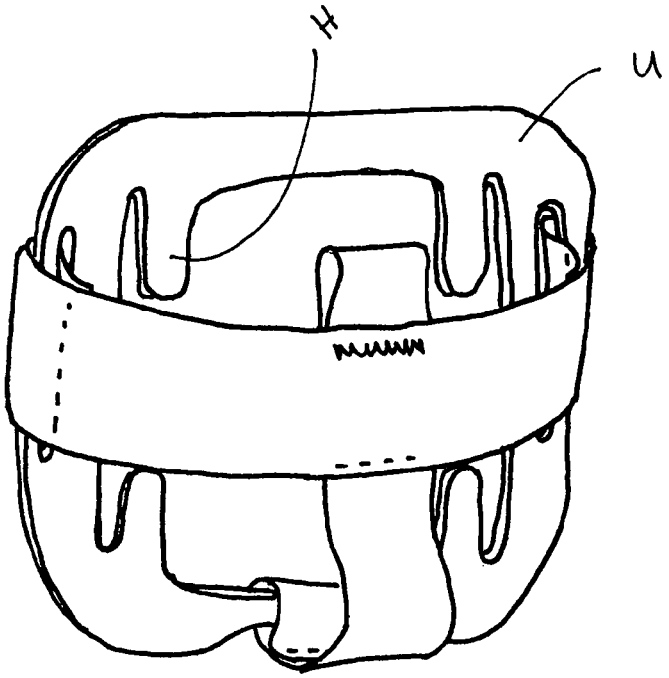
FIG. 42 shows a perspective view of another embodiment of a retaining device similar to FIG. 38. In many cases this embodiment is not as preferable as the retaining device shown in FIG. 7.
Figure 43:
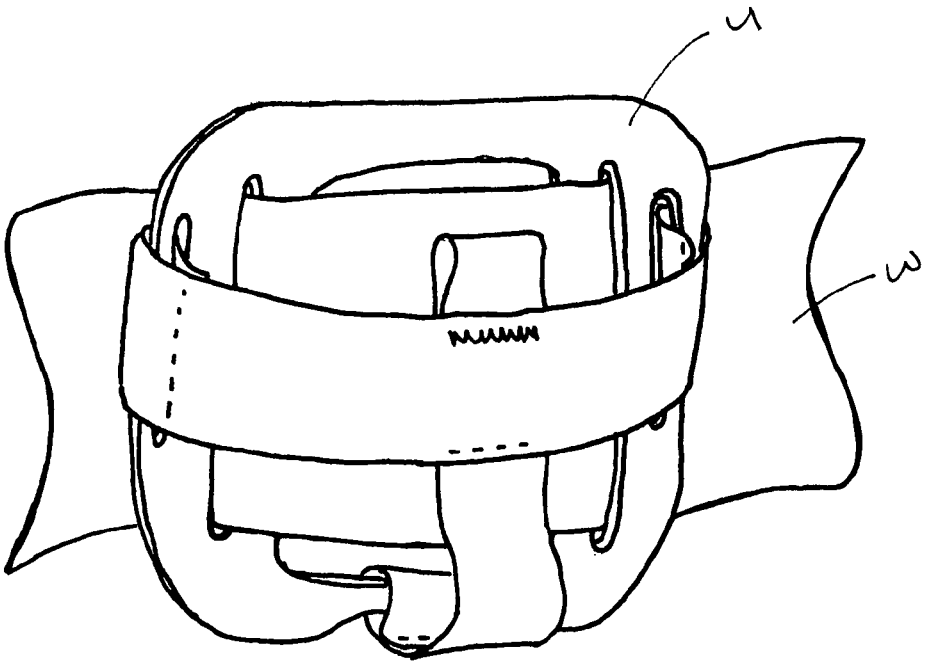
FIG. 43 shows a perspective view of the embodiment in FIG. 42 with strap "w" installed in projections (one of four is labeled "h" for clarification).
Figure 44:
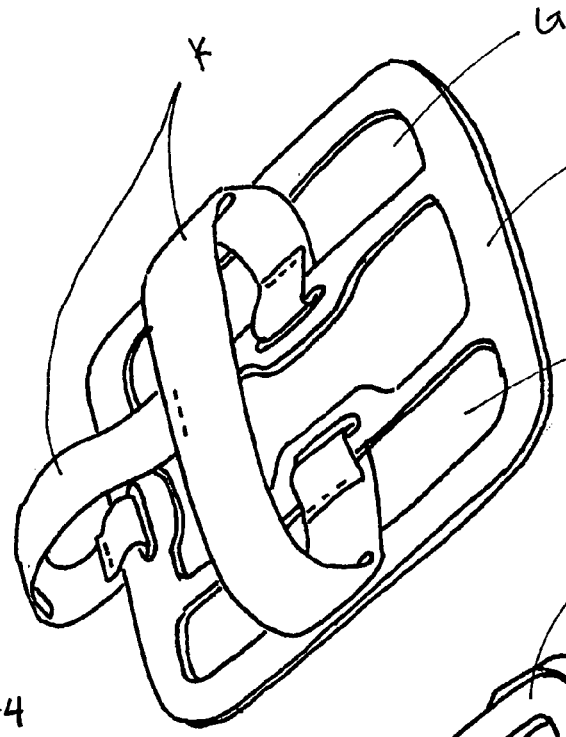
FIG. 44 shows a perspective view of another embodiment of a retaining device similar to FIG. 38. In many cases this embodiment is not as preferable as the retaining device shown in FIG. 7.
Figure 45:
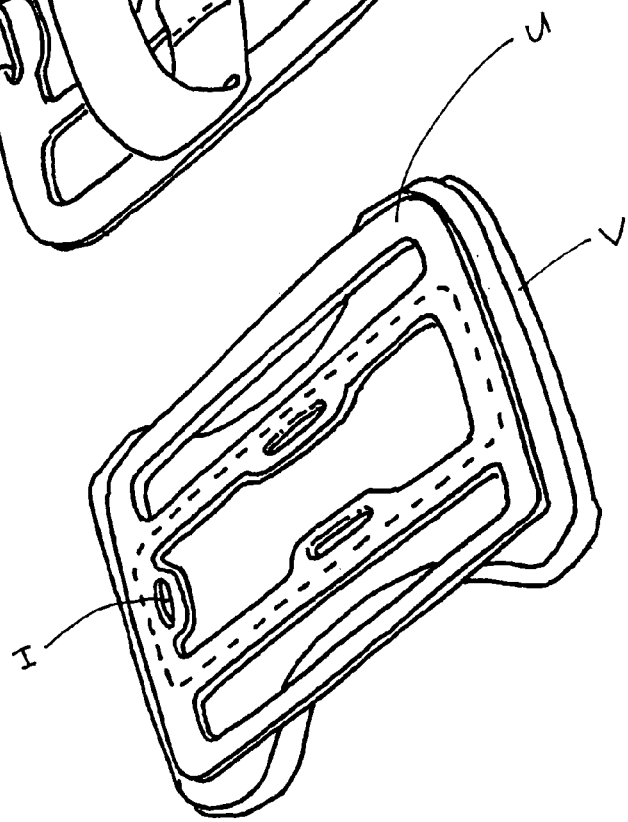
FIG. 45 shows a perspective view the embodiment in FIG. 44 with pad "v" installed. As described earlier pad "v" is preferably sewn or glued to "u".
Figure 46:
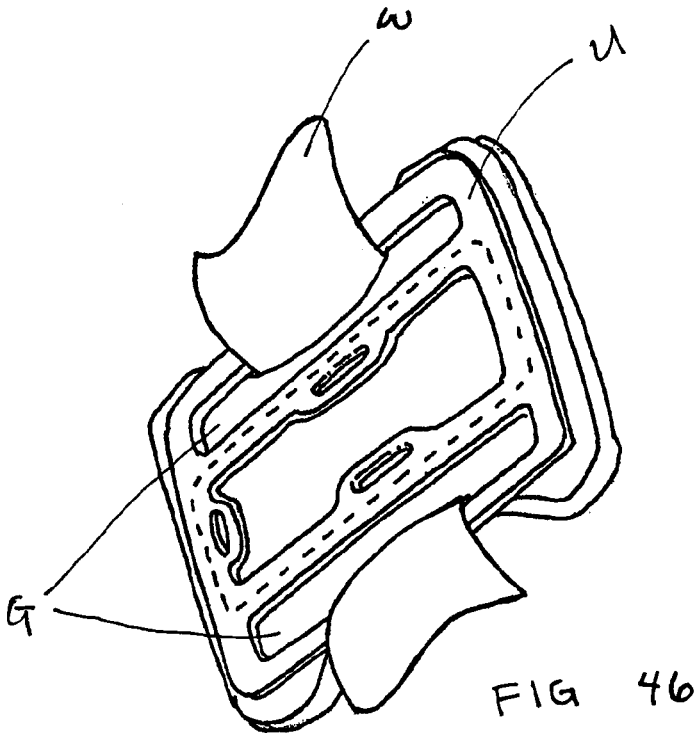
FIG. 46 shows a perspective view the embodiment in FIG. 44 with pad "v" installed and strap "w" installed through holes "g".
Figure 47:
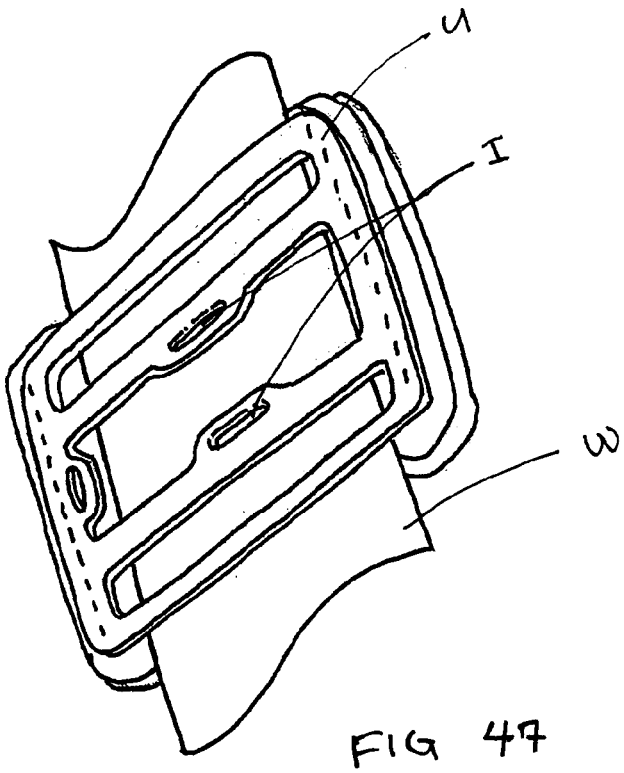
FIG. 47 shows a perspective view the embodiment in FIG. 44 with pad "v" installed by sewing along its top and bottom edges and strap "w" installed behind "u".
Figure 48:
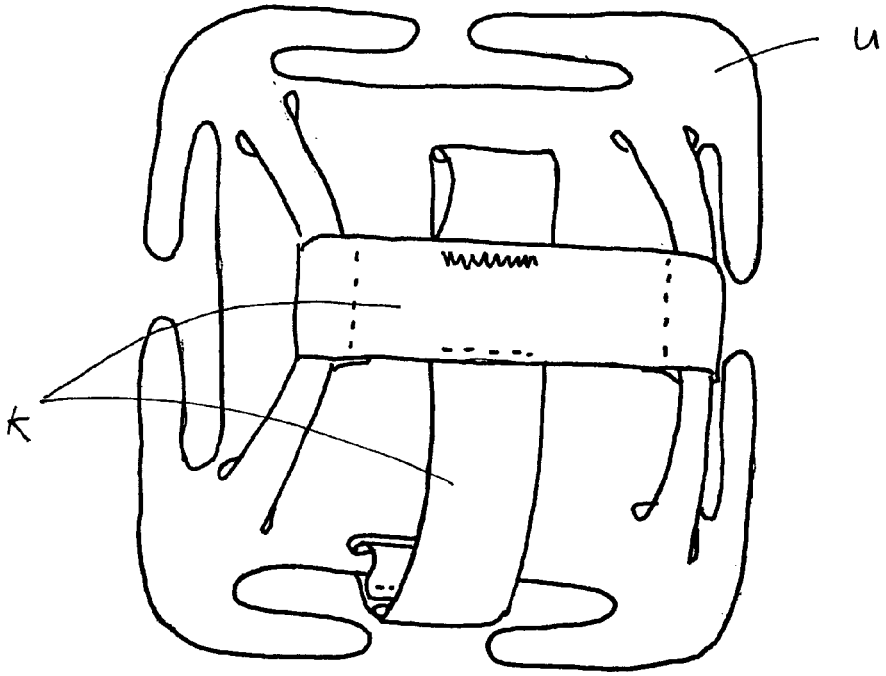
FIG. 48 shows a perspective view of another embodiment of a retaining device similar to FIG. 44. In many cases this embodiment is not as preferable as the retaining device shown in FIGS. 7.
Figure 49:
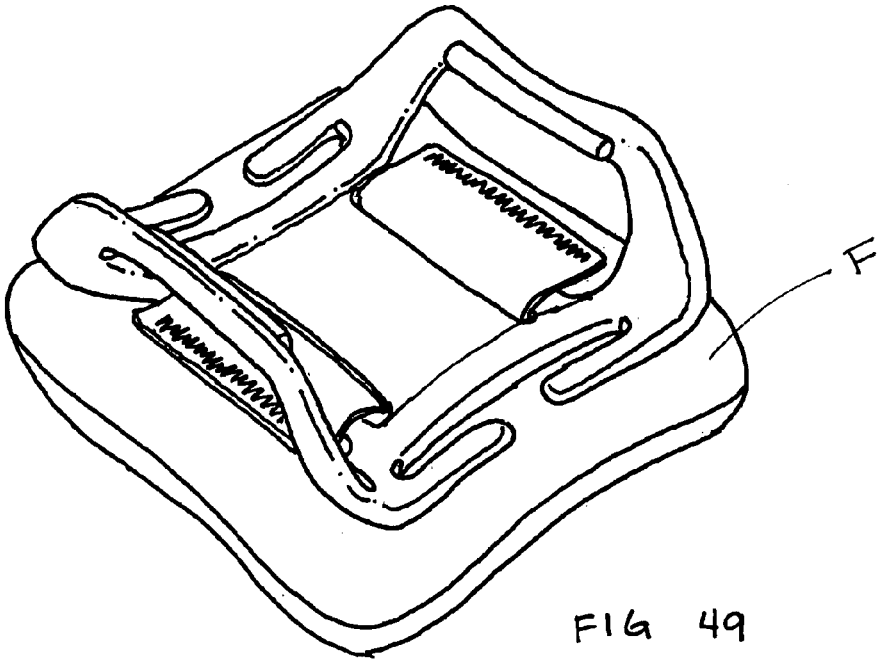
FIG. 49 shows a perspective view the preferred embodiment of the retaining device shown in FIG. 7 with pad "f" installed.

Although it is not preferable a system of straps could be configured to hold the bottle (or "held item") in place on the foundation area/base where the "host item" gripping/holding fastening system resides and the cut-out arms could be replaced by this strap system. This strap system as picture in FIGS. 38 trough 48 (the strapping itself labeled "k") would preferably be fastened to itself through slots or the like "I" the base plate (labeled "u"). The strap system would be configured preferably sewn in a substantially T-shaped design so that all three ends of the Substantially T-shape strap configuration would extend and fasten to themselves through slots in the baseplate. Within a preferably somewhat rectangular base of this formed bottle or the like cage system there are preferably two or more elongated slots one slot each configured parallel and somewhat close to each substantially flat side of the somewhat rectangular base. One slot at the base of each end of the top substantially T-shaped strap system and optionally two more rotated substantially 90 degrees to this. Each slot preferably has an opening somewhat centrally located to one of two long slot sides providing an opening from the slot to the perimeter or interior of the plate base although in some cases although not preferable this slot could be closed (see FIGS. 44 through 47) or open towards the interior of the part (see FIG. 38 slots "sy").

The foundation area could be molded, die-cut from stock or otherwise manufactured from plastic, metal, rubber or the like (or combinations thereof—or of the like materials).

Figure 74:
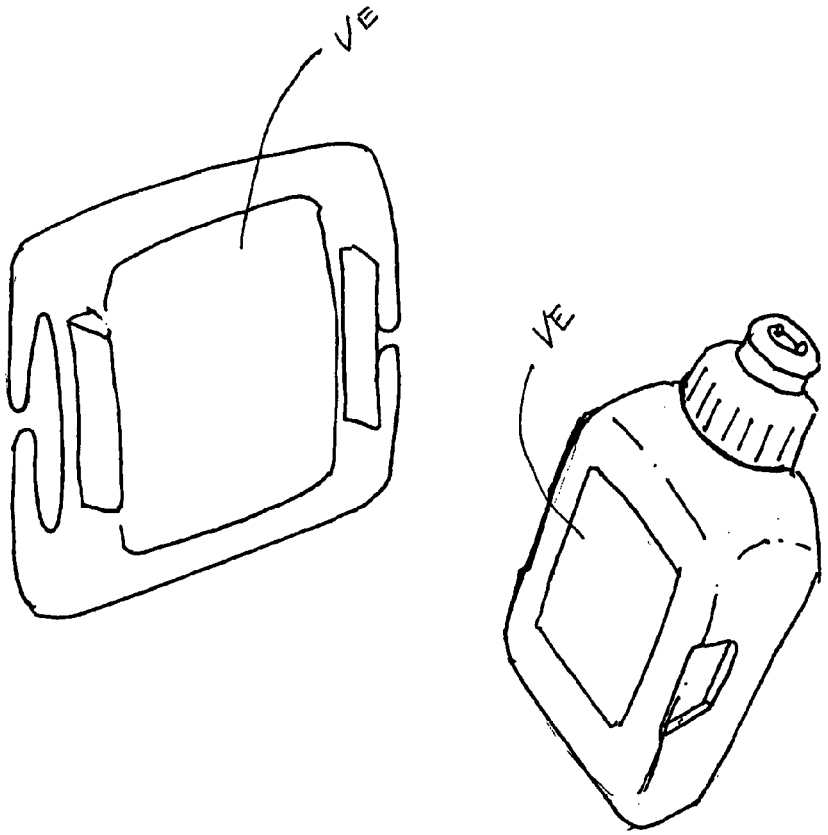
FIG. 74 shows a perspective exploded view of another less preferable embodiment of the plate and bottle portion of the invention. Bottle detent features are replaced by Velcro or the like parts "ve" at the base of the bottle and on a flat area of the base of a plate. This configuration is less preferable than disclosed preferable configuration.

Although not preferable access and retainment of the "held item" can be accomplished by providing ribs or walls extending up from the "retaining device foundation area" so that a substantially "u" shaped area is created. Velcro or some other retaining element/geometry can be attached to one side of the held item as well as within the crux of the substantially "u" shaped retaining device (see FIG. 74). This way the "held item" can be held firmly inside the crux of the substantially "u" shaped retaining device with the sides of the retaining device in one or more axes and the Velcro or the like holds the "held item" in place in one or more axes. The Velcro or the like component could be a substantially ball and socket connection or the like, etc. The retaining device could be held to a "host item" (belt or the like, etc.) in any one of the ways (or the like) already disclosed for the more preferable retaining device herein disclosed.

Also, the walls or ribs could be eliminated and only Velcro or the like placed on the "retaining device foundation area" and a surface of the bottle or "held item" to take the place of the "held item" grip element(s).

The retaining device has a number of functions among these to spread/transfer load to "host item" and hold "held item" firmly and removably (provide a reliable, somewhat firm connection from the retaining device/bottle assembly to the belt or the like assembly.

The retaining device itself is preferably molded, cast or otherwise formed from rigid, but flexible material or materials like acetal, nylon, polycarbonate or the like. It is preferable that the retaining device be strong, rigid, somewhat flexible but have low plastic creep characteristics, for these reasons acetal homopolymer or the like is a desirable choice of material for the retaining device in the disclosed preferable invention. In some cases glass-filled plastics or other similar materials may be desirable for rigidity and low creep characteristics. Although in other embodiments the retaining device could be manufactured from a combination of materials to get similar results like metal or metals or the like combined, dipped, co-molded, etc. with plastic, rubber or the like, plastic or plastics combined with rubber or the like. Also many other materials could be used alone or in combination to attain similar results.

Although the preferred embodiment of the disclosed invention uses the retaining device to hold a sports bottle or the like there are many other items the retaining device could be used to hold. The following describes a novel retaining device whose function is to act as a docking interface between a "host item" (a person, person's bag, bicycle, vehicle or the like) and another item or items "held item" that a person would like ready-access to. The novel described retaining device is meant to be fixed to a person or to other (base) items where this kind of ready access to the "held item" is desirable. A "host item" could be anything that a person or other would like the docking interface to be affixed to, examples include but are not limited to, a person, person's belt, waist/fanny pack, backpack, backpack strap, bag, bag strap, apparel, vehicle, bicycle, desk, cart, medical device, bed, etc. A "held item" could be any item or items that a person or other would like desire ready access to, examples include but are not limited to: a water bottle or bottles, a holder/container for items, a radio or other electronic item like a music player, computer, telephone, PDA or the like, etc.

Figure 16:
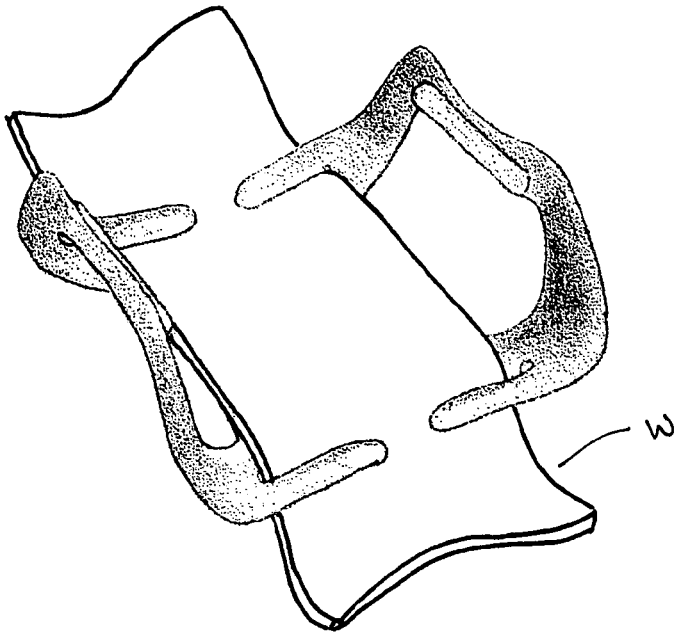
FIGS. 16, 17, 18, 19, 20, 21 show how the belt/pad or the like grip features can be utilized to fix the retaining device to a belt, strip or the like (labeled "w").
Figure 17:
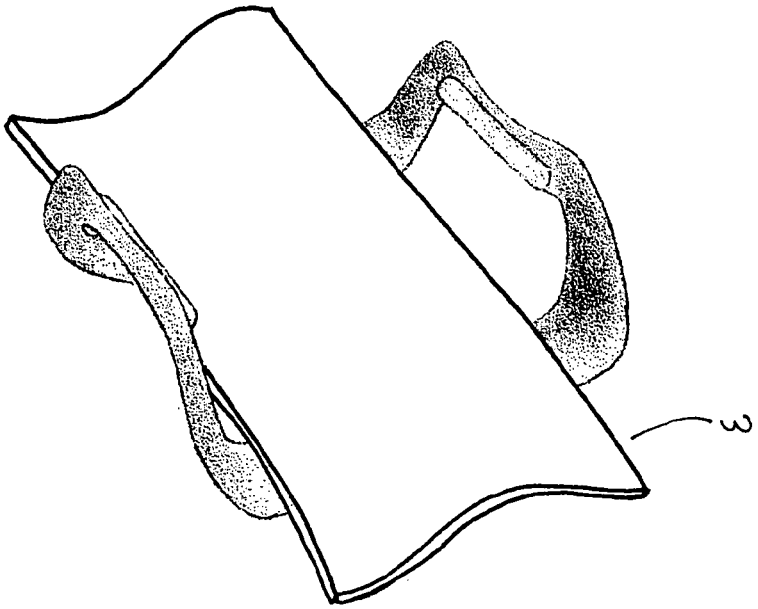

The preferred embodiment of the retaining device disclosed has integrated belt, strapping or the like gripping features for holding/fastening the retaining device to belt or belt like element or elements. The preferred geometry of these belt gripping/attaching elements is disclosed and preferred use depicted in FIGS. 16 though 21 and others.

The belt gripping elements (and retaining device "held item" gripping elements) as disclosed allow the retaining device for holding the "held item" to hold the "held item" in a variety of positions and orientations and allow this assembly to be held fixed to a variety of features on the "base item" as well as provide versatility of pad choices if desired see FIGS. 16 through 21 and others.

Another embodiment of the retaining device incorporates a sewable, glueable, grommetable or otherwise fixable plate that can be affixed to the "base" element(s). This plate incorporates the "held item" gripping element or elements so that these gripping element(s) can be affixed by gluing, grommeting, sewing, with hook and loop, etc or the like to the "base" element. This plate or the like could be molded or otherwise formed/constructed integral to the gripping element(s) but also could be a separate part that is constructed and then mated or otherwise assembled to the gripping element or elements. This would easily allow different materials with different properties to be integrated into the same part. For example a flexible, sewable plate or the like made of leather, sewable plastic, plastic, rubber or the like, fabric, etc. or the like could be assembled to the gripping element(s) so that these/this element(s) could be sewn, glued, grommeted, snapped or otherwise assembled to a "base" element using this intermediate plate or the like (depending on the kind of connection desired). This could allow the gripping element(s) to be permanently or removably affixed to the "base" element (see FIGS. 22-26 and others).

Figure 28:
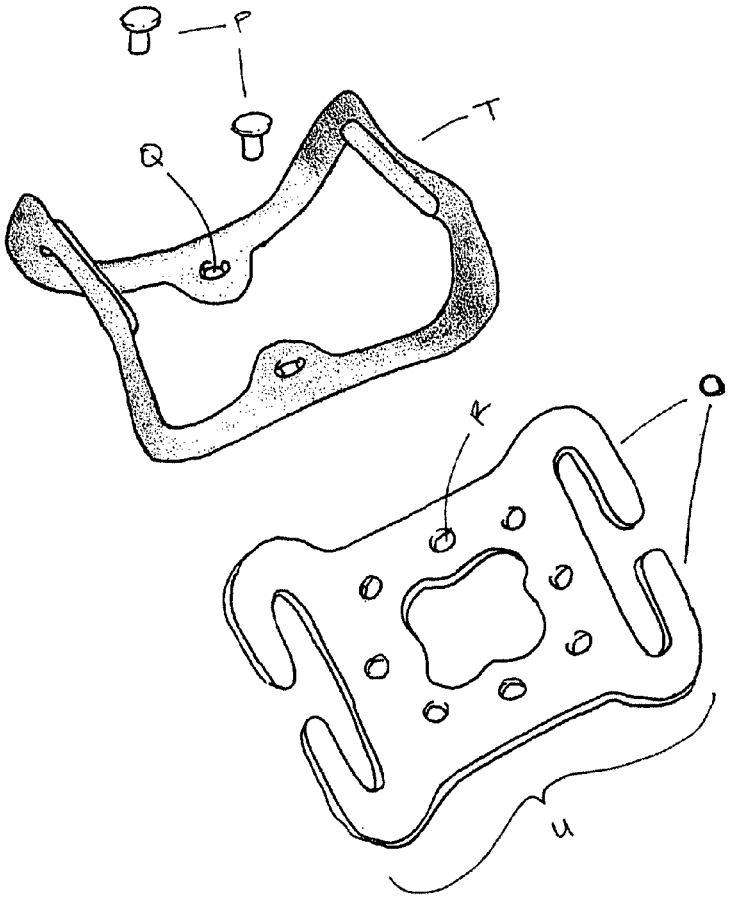
FIG. 28 shows a perspective view of another embodiment (in some cases less preferable than the embodiment shown in FIG. 7) similar to FIG. 26 in which the bottle or the like grip element "t" is configured with hole or the like features (one labeled "q" for clarification) to fix through holes or the like features (one labeled "r") resident in base part "u" with rivets or the like "p" that pass though holes in part "u" fixing to part "t" but these rivets could also could be other fastening elements. For example they could be projections integrally molded into part "u" and then heat mushroomed down to fix part "t" to part "u". They could other fasteners like screws, plastic rivets, snaps, etc or the like. Part "u" is configured with multiple holes (one labeled "r") so that the relationship between part "t" and belt grip features (two of four—or more—labeled "o" for clarification) resident on part "u" can be rotated and fixed in an angled relationship (angling means) so that the bottle or the like element could be fixed in a chosen angled relationship to the belt or the like grip elements (two of four here labeled "o"). These belts or the like grip features preferably would attach in a manner to a belt similar to those shown in FIGS. 16-21.
Figure 29:
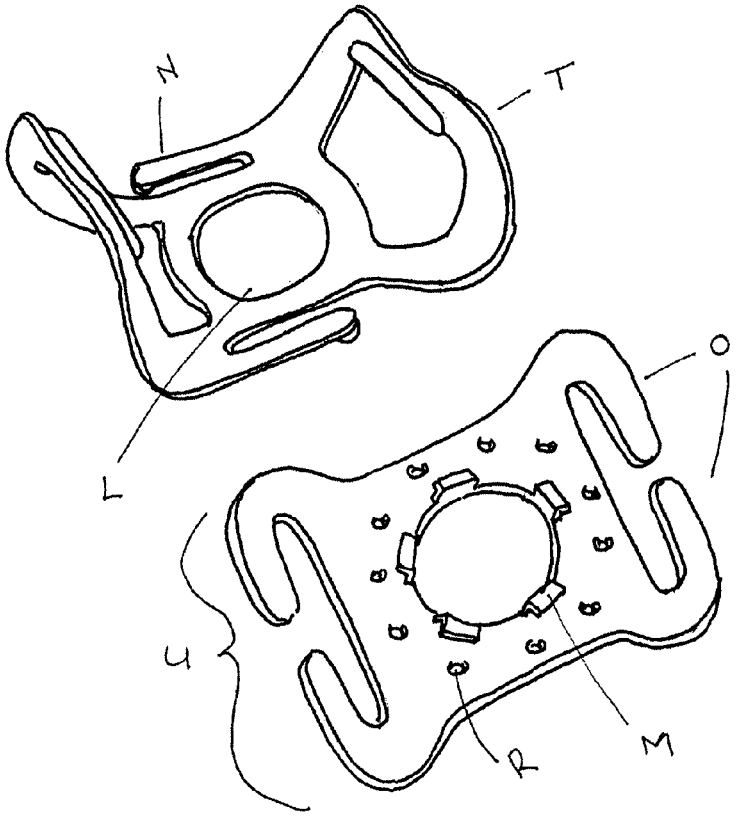
FIG. 29 shows a perspective view of another embodiment (in some cases less preferable than the embodiment shown in FIG. 7) similar to FIG. 28 in which the bottle or the like grip element "t" is configured with one or more beam detent or the like features (one labeled "n" for clarification) to detent to holes or the like features (one labeled "r") resident in base part "u". Part "u" is configured with multiple holes (one labeled "r") so that the relationship between part "t" and belt grip features (two of four—or more—labeled "o" for clarification) resident on part "u" can be user-rotated and fixed in an angled relationship so that the bottle or the like element could be fixed in a chosen angled relationship to the belt or the like grip elements (two of four here labeled "o"). These belts or the like grip features preferably would attach in a manner to a belt similar to those shown in FIGS. 16-21. Part "u" would fix rotatably to part "t" with retainers (one labeled "m") fitting through hole "L".
Figure 30:
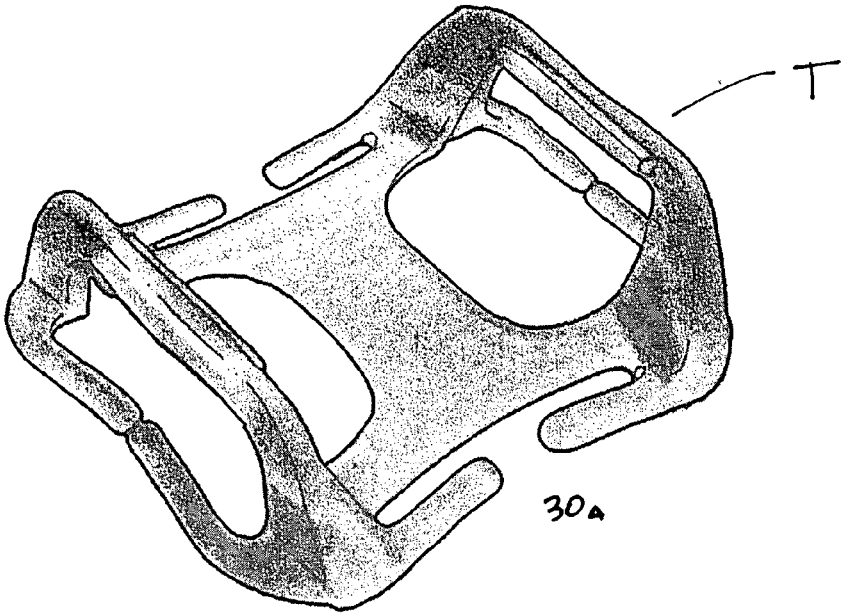
FIG. 30 shows two perspective views of another embodiment (30A somewhat of a top perspective view and 30B, somewhat of an underside perspective view). Of a retaining device which in some cases is not as preferable as the retaining device shown in FIG. 7.
Figure 30:
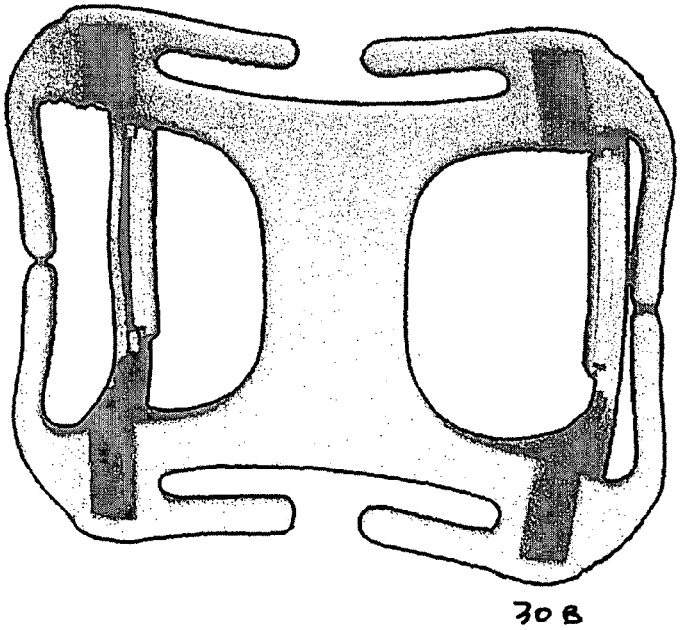
Figure 31:
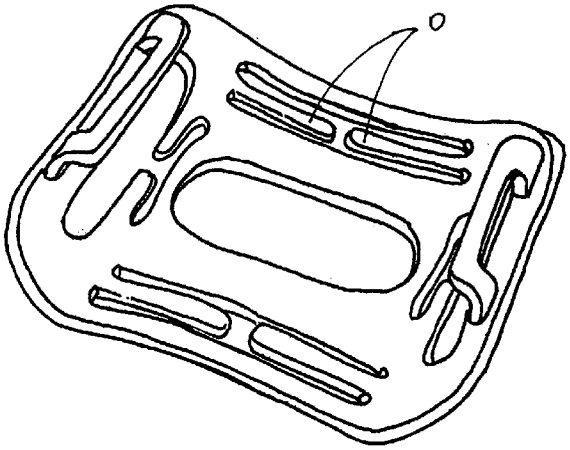
FIG. 31 shows a perspective view of another embodiment of a retaining device which in some cases is not as preferable as the retaining device shown in FIG. 7.
Figure 32:
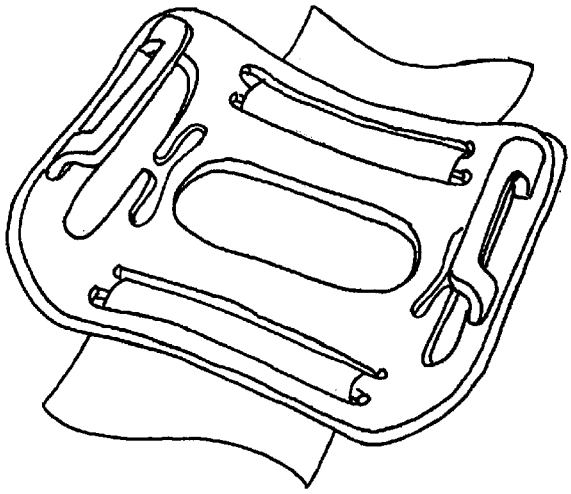
FIG. 32 shows a perspective view of FIG. 31 with strap or the like element installed in belt or the like grip elements (two of four—or more—labeled "o" for clarification).
Figure 33:
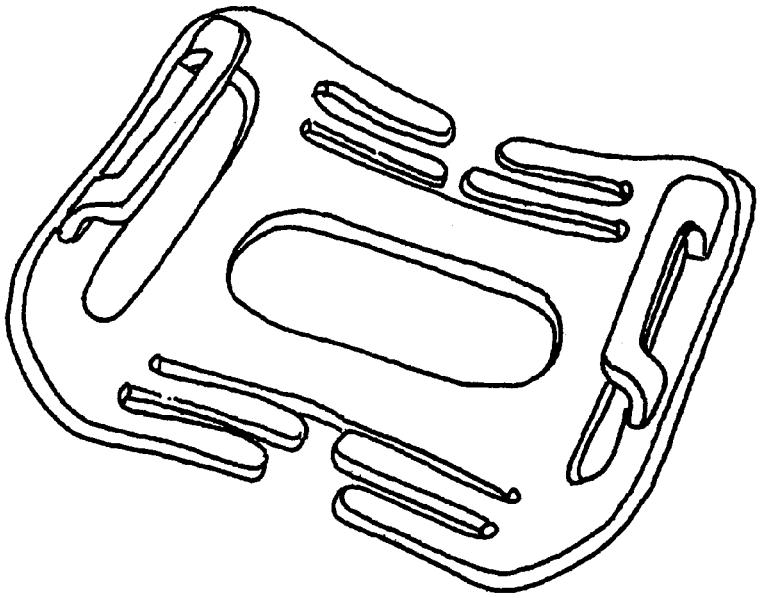
FIG. 33 shows a perspective view of another embodiment of a retaining device similar to FIG. 31 which in some cases is not as preferable as the retaining device shown in FIG. 7.

Another embodiment separates the retaining device into two or more parts. This allows for a variety of connection options as well as can allow for angle adjustment of the "held item" gripping means (and thus the held item) and the attachment to the "base item" (see FIGS. 28, 29).

Figure 50:
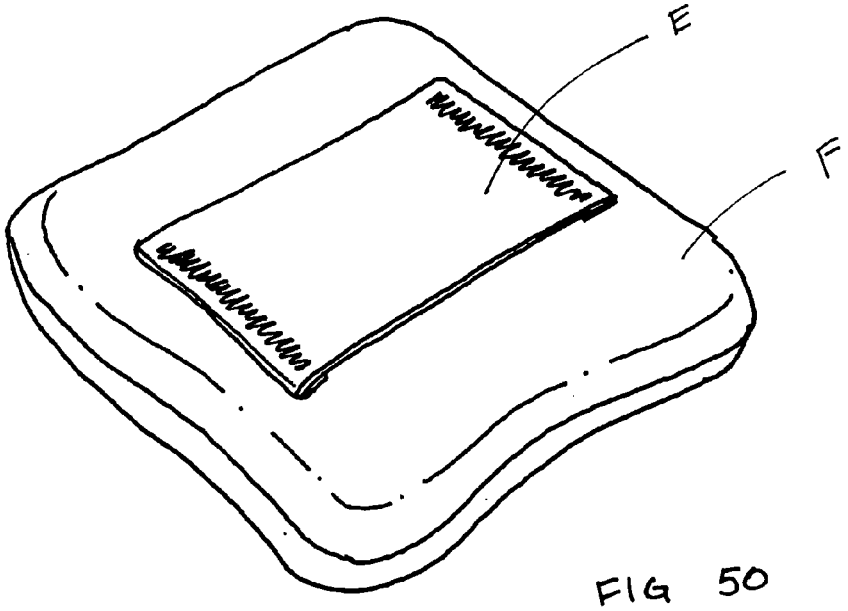
FIG. 50 shows a perspective view of pad "f". Pad "f" is preferably cushioned fabric or the like that is preferably cut to shape with substantially the same base shape as the base of the retaining device that it assembles to. Then strap, webbing or the like part "e" is preferably sewn in place substantially along two sides.

Also disclosed herein is an optional pad for cushioning a user such that when affixed between a user and the retaining device baseplate this pad cushions the user from the preferably rigid but flexible retaining device base plate, belt and bottle or "held item" (see FIG. 50 and others). The pad is preferably either held in place affixed to the retaining device baseplate or held affixed or integrated into the belt. In one embodiment the pad or pad-like element provides engaging details that it engages with (although a pad could be held in place to the retaining device baseplate or belt system in by a variety of ways including but not limited to gluing/sticking it directly to the belt or retaining device baseplate, sewing, riveting, grommeting or affixing removably (or not) by its own integral geometry like integrated belt loops or the like, fitting over, nesting within, etc.) In another embodiment (or within the same embodiment just in another location on the product) the pad is preferably held on the belt or belt-like element between the retaining device and the user's body. The pad can be held to the belt in a variety of ways including integrated with the belt so that the belt is the pad (one contiguous part or a combination of parts which in effect creates a contiguous part) or belt transitions into the pad affixed together by sewing, grommeting, gluing or the like. Also the pad can be held in place on the belt with belt loops or the like, treaded through slots, holes, pass-throughs or the like or integrated removably in some other way with the belt (for example affixed together in place with Velcro, snaps, buttons or the like). It should also be noted that the pad or pads can have other components/features integrated into them like pockets, straps for holding sunglasses, race numbers or the like, an area or areas for affixing a logo or logos, etc.

The retaining device pad could also be co-molded with retaining device, using expandable foam, rubber, or other cushioning material or the like.

One of the advantages of the disclosed novel invention is the retaining device for attaching to the "held item", its versatility and ability to fit/integrate easily with many things. Among many systems of integrating the retaining device to a "host item" or person there are many off-the-shelf belt or strapping systems that would work with the herein disclosed retaining device. Disclosed herein are a number of novel belting systems specifically adapted to be worn on the body and work with the disclosed retaining device although they are believed to be novel and fundamentally unique inventions themselves and could be used without the novel retaining device to carry a variety of items.

B. Physical Description of How the Retaining Device Affixes to the Host or Base items (Removably)

The retaining device in some cases is intended to fix directly to the "host item". For example the retaining device may be preferable for it to affix directly to a belt, bag, backpack, fanny pack, shoulder bag, etc or the like. This could be done with glue, adhesive, by sewing, grommeting, ultrasonic welding, etc. or the like although it is preferable to connect it to the "base item" using the herein disclosed connection features which allow it to be affixed, but removed or repositioned as desired between or during uses. In other cases it may be preferable for the retaining device (or a part of the retaining device) to fit to an intermediate item or items and then fix to the "host item". For example, it may be preferable for the retaining device to fix to a pad, bag, strap part, etc. and then this assembly could be fixed to a variety of other "host items". The novel described retaining device is preferably meant to be accessible to a person by way of a "host item" or items in cases where ready access to the "held item" is desirable although it could be directly fixed to a person with medical grade adhesive, a suction cup, tape, etc. or the like although it is not preferable. A "host item" could be anything that a person or other would like the docking interface to be affixed to, examples include but are not limited to, a person, person's belt, waist/fanny pack, backpack, backpack strap, bag, bag strap, apparel, vehicle, bicycle, desk, cart, medical device, bed, etc.

C. Physical Description of the Preferable "Held Item "

Figure 9:
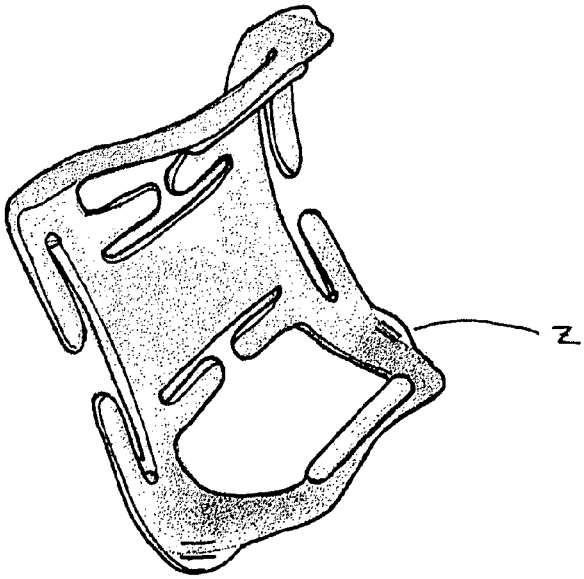
FIG. 9 shows a perspective view of the retaining device portion of the preferred embodiment with grip tabs integrally molded (one of the four grip tabs shown in drawing is denoted with a "z" for clarification). These grip/bottle removal tabs are optional features and are configured to facilitate removal of the bottle or the like from the retaining device portion (used for leverage to push against on bottle (or the like) removal.

A "held item" is preferably a bottle or the like but it could be any item or items that a person or other would desire ready access to, examples include but are not limited to: a bottle or bottles (as discussed and pictured and is preferable for this invention), but also could be a holder/container for items, a radio or other electronic item like a music player, computer, telephone, PDA or the like, etc (although a bottle or the like is preferable). Also as an example the versatility of the invention the "held item" could be an object or objects used by military personnel like a grenade(s), cartridge or the like, etc (although a bottle or the like container is preferable). The bottle or container or the like is preferably molded, cast or otherwise manufactured from a material or materials that are semi-flexible and/or flexible like plastics, examples include: Polyethylene, PETE, Polypropylene or the like. Also, in other embodiments the bottle or bottles could be manufactured from more rigid materials (or a combination of rigid and flexible). Examples of more rigid materials include but are not limited to Polycarbonate, Stainless Steel, Aluminum, ceramic, glass or the like. It should also be noted that more rigid materials like Polycarbonate and others can be more flexible in thinner wall sections. A traditional bottle cap, push-pull, or other simple readily available cap is preferably used to cap the bottle. The bottle or the like is preferably molded or otherwise fabricated from flexible or some-what flexible plastic or the like for a number of functional reasons. One reason for the choice of preferably flexible material for the bottle is that this allows the bottle to be flexed, squeeze, or otherwise deformed in some way facilitating removal of the bottle from the retaining device element. Although the material for the bottle is preferably flexible, a somewhat rigid (or a combination of rigid and flexible) material as mentioned above could be used and the retaining device could bend/flex to allow bottle removal (or a combination of both bottle and retaining device flex). For example, if it is desired to use the disclosed novel invention with a more rigid bottle—with wall thickness to produce the desired rigidity—Polycarbonate (Lexan), stainless steel, PETE or the like—with a wall thickness to produce the desired rigidity—a tab or tabs can be integrally molded or constructed in some way into the retaining device portion so than the retaining device can be flexed away from the bottle and thus the bottle and retaining device can be unmated (see retaining device embodiment FIG. 9, features "z" representing example finger grip areas to facilitate bottle or the like removal, see FIG. 88 for how these features could be gripped). Also grip features on the bottle itself can be integrated to facilitate bottle removal (many figures show example bottle grip features—the bottle shown in FIG. 96 for example). It should also be noted that a variety of combinations of material and/or geometry could be used to get a desired result. For example plastic with inlaid, co-injected (or the like) rubber, plastic (or the like) areas could be used for the bottle and/or retaining device, also a single material could be used and the wall thickness could be varied so that a desired area could be flexible and another less flexible to meet the requirements of bottle mateability. These inlaid, co-injected and/or integrally formed/molded or the like portions of the bottle or the like and/or retaining device can also be used for grip areas to provide friction, (for the hand, fingers, etc.) and/or provide features to facilitate bottle removal—handle(s), grab hold(s), tabs, leverage point(s), or other bottle removal features. For bottle or the like materials such as PETE or the like (commonly used for soda pop bottles) it may be desirable to mold/form into the bottle surface itself ribs or other stiffening features so that areas that are not desirable to bend or flex are stiffened and other areas that a controlled flex is desired are stiffened less so.

Another preferable geometry consideration for the preferable bottle or the like "held item" is that it is preferably formed low profile or somewhat of a flattened (out of round) cross section (see FIGS. 2-6, section "A" for some examples). This off-round or low profile bottle has many benefits in the disclosed invention over a standard round cross-section bottles. This geometry not only integrates with the wearer to lower the perceived weight of the bottle to the user but it also allows the bottle to more easily be removed from the retaining device and allow a more reliable grip of the item being held. The off-round geometry can be squeezed so that the cross section becomes more round (which does not appreciably compress the liquid contained) and thus the bottle can easily be removed from the retaining device. If the bottle cross section was already round and if the bottle is full of a liquid like water (with the cap closed) it would be difficult to squeeze to remove it from the retaining device because of the incompressibility of a liquid. A round cross section does not want to be squeezed out of round (with the bottle lid closed) because this compresses the liquid inside. An out-of-round cross section on the other hand can be squeezed and deformed somewhat more closer to a round cross-section somewhat as easily as the structure of the bottle or the like walls can be deformed. Thus by controlling the structure, material, etc. of the bottle or the like walls the squeeze force to remove the bottle or the like can be controlled and thus tuned to the desired specifications of the application. A round cross section bottle on the other hand (without some pressure relief like opening the top or providing an expansion area) does not have this degree of preferable flexibility.

Although a round cross-section bottle or the like is not preferably used in the preferable invention it could potentially be used. To remove and replace the bottle or the like to/from the retaining device the retaining device could be flexed and/or the bottle slightly flexed as well (see above section on using stiffer materials for the walls of the bottle or the like for an example on how this somewhat stiffer reacting bottle—when full of liquid—can be potentially accommodated in the disclosed invention.)

The preferred embodiment of the Bottle/Container described is preferably constructed to contain water or other liquid elements for personal hydration purposes (for user to drink from) for a variety of leisure and sport activities although obviously it could be used to contain other fluids or other materials that are able to be contained in a bottle-like container. Preferably the bottle consists of at the minimum, two portions, a container or reservoir portion to hold liquid and top which allows for easy drinking of the liquid (although the bottle could obviously be molded integral with the cap attached by a molded-in cord-like element and a "pop-of" type cap could be utilized. Preferably the top includes a push pull drinking spout or other commonly available, effective means of sipping and sealing the container. The top is preferably made using a urethane PE, PU or PP (polypropylene) and is durable, hard and may have a thicker wall thickness than the bottle—as the top is not preferably intended to be squeezable. The bottle/container is preferably made of a durable, but flexible plastic or polymer such as Polyethylene (PE), Polyurethane (PU) or Polypropylene (varying densities or combinations of polymers) to arrive at the desired thickness and flexibility depending upon the final intended use and environment. One combination would be Low Density Poly Ethylene (LDPE) in combination with HDPE or High Density Polyethylene or the like. These materials are desirable for their translucency, flexibility, food grade approval (FDA), ability to be molded easily, readily available and can be made easily and cheaply in different colors, durability, easy to grip or hold on to (not too slippery) and readily available and affordable for molding and manufacture throughout the world. Other materials with these qualities in full or in part are acceptable based upon final use of bottle/container. The body /reservoir of the bottle is preferably hollow and has a wall thickness in the range of roughly 0.25 mm to 2 mm thick—preferably 1 mm optimizing weight factors, durability, translucency and flexibility among other factors. In the preferred embodiment the body is of a low profile (lower as compared and relative to a round cross section type standard sports water bottle readily available at sport shops). In addition to the low profile overall geometry of the bottle body, the bottle body may include desirable contours or finger, hand holds to enable the user to easily grasp and to hold the bottle and to easily pull it out of the pack sleeve.

The bottle is preferably constructed using blow, vacuum or injection molding process for cost effectiveness, quality, consistency between bottle units, and ease of mass production. The cap is preferably injection molded.

Figure 1:
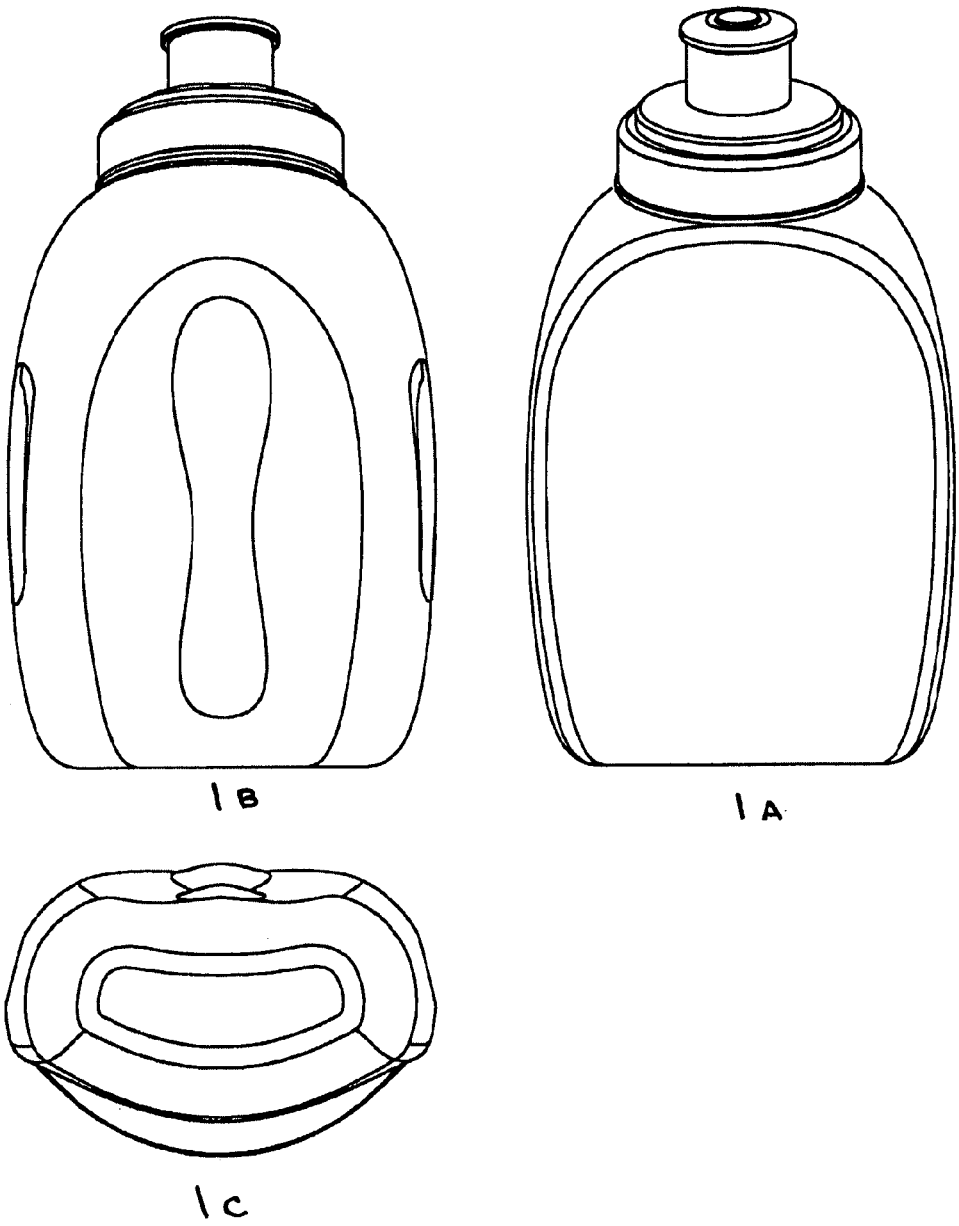
FIG. 1 shows a back (1B), front (1A) and bottom (1C) view of a bottle of the preferred embodiment of the invention. The bottle closure shown is a standard push-pull closure with a screw top although another type of commonly used closure could be used within the scope of the invention. The bottle is preferably created in such a manner so that it is low profile (the bottle is flattened so that it would sit close to the user's body when worn on the body held there by the retaining device and belt system of the preferred primary embodiment.
Figure 2:
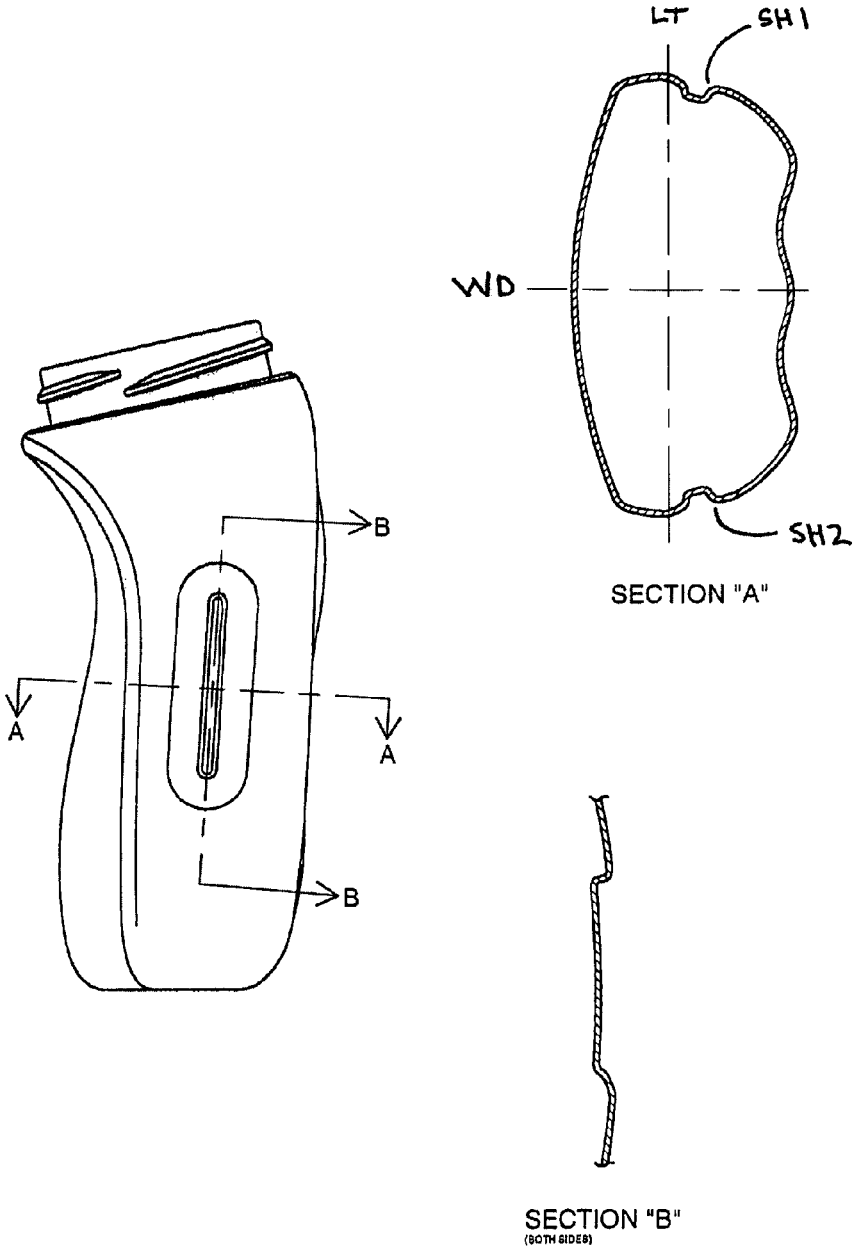
FIG. 2 shows a side view of a bottle of the preferred embodiment of the invention and two section views to show preferred features that are configured to mate with features on the disclosed retaining device FIG. 7. (7A is a top perspective view and 7B is a underside perspective view) is an example of retaining device configured to fit with the bottle details disclosed in this figure, although many other retaining device examples disclosed herein could be configured to fit with these bottle details, so that the bottle (or the like) can be held firmly to the retaining device element. Section "A" of FIG. 2 shows cross-section "A" defined by first axis LT and second axis WD orthogonal to LT, the bottle having a length along the first axis LT and a width along the second axis WD wherein the length LT is greater than the width WD. The second axis WD divides the bottle into a first portion and a second portion wherein the exterior surface of the first portion comprises a first shoulder SH1 and the exterior surface of the second portion comprises a second shoulder SH2; each of the first and second shoulders being configured for mating engagement with disclosed retaining device.
Figure 3:
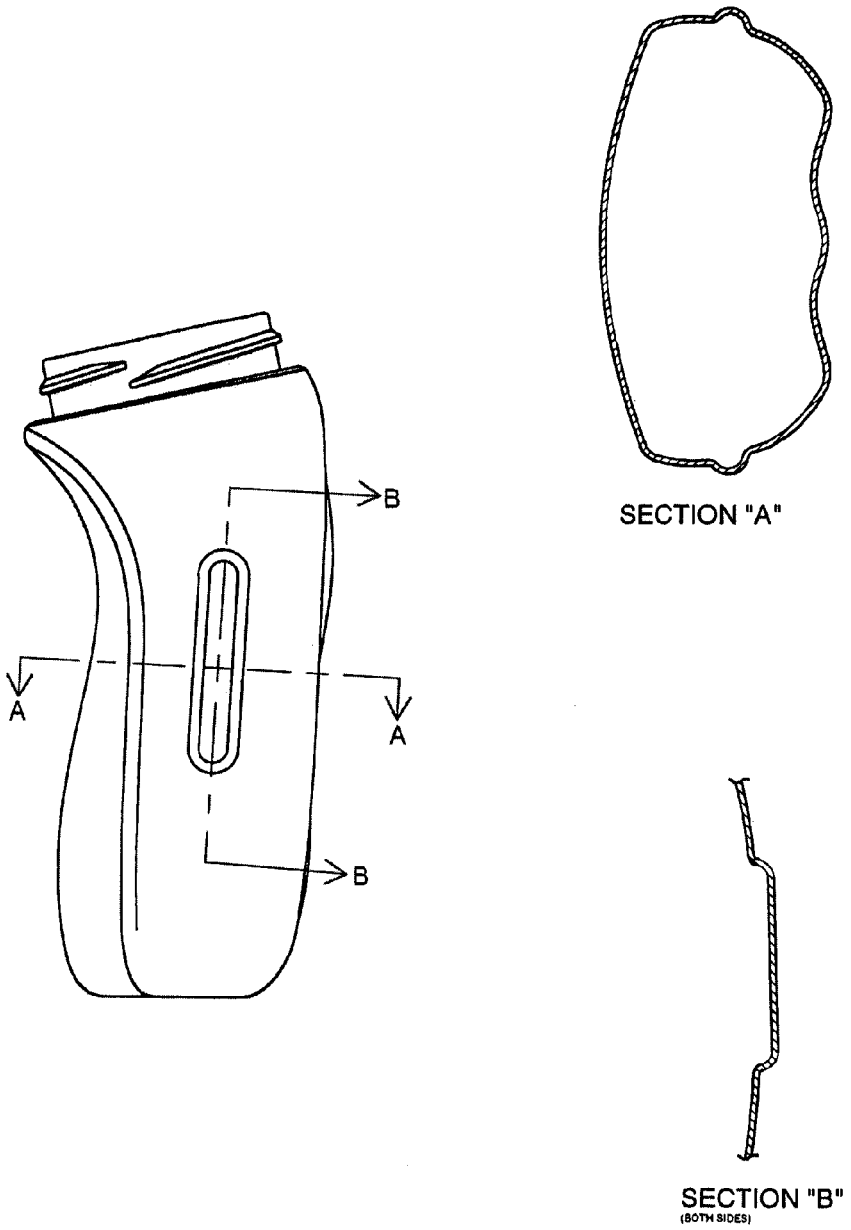
FIG. 3 shows a side view of another embodiment bottle of the preferred embodiment of the invention and two section views to show other features that are configured to mate with features on the disclosed retaining device
Figure 4:
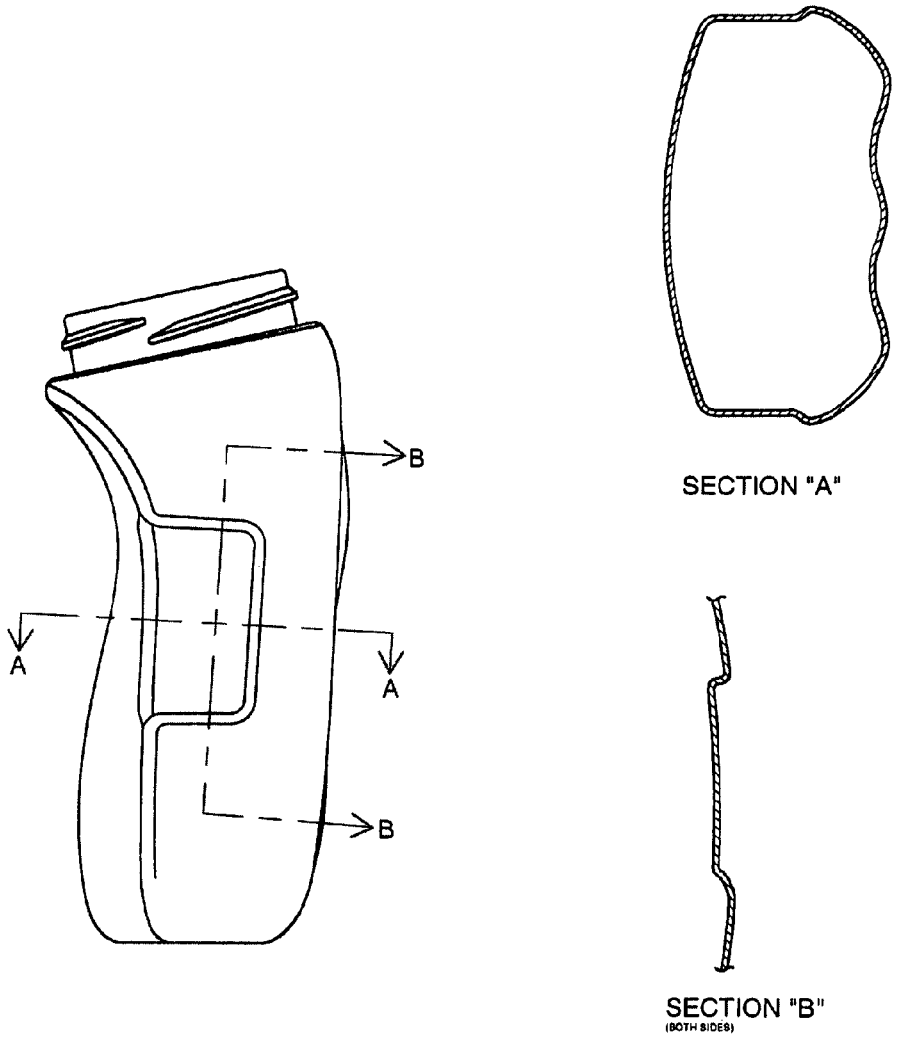
FIG. 4 shows a side view of another embodiment bottle of the preferred embodiment of the invention and two section views to show other features that are configured to mate with features on the disclosed retaining device
Figure 5:
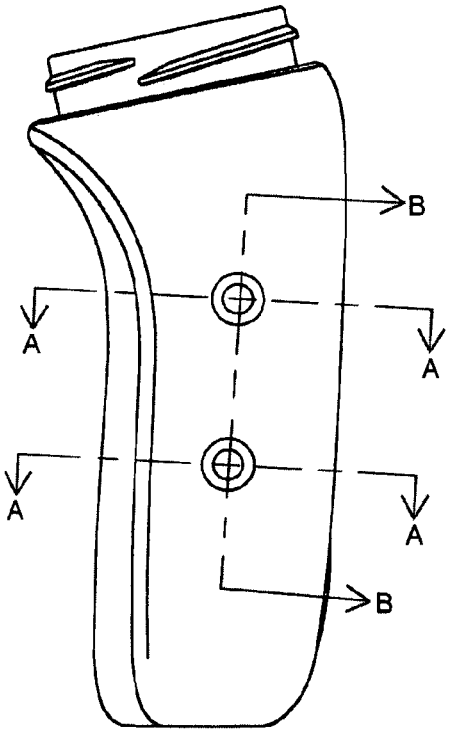
FIG. 5 shows a side view of another embodiment bottle of the preferred embodiment of the invention and two section views to show other features that are configured to mate with features on the disclosed retaining device
Figure 5:
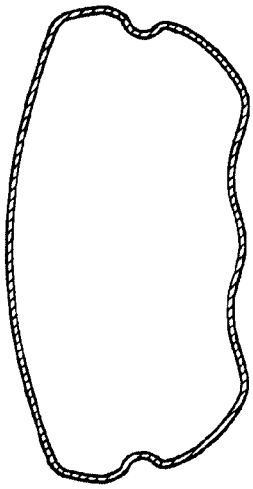
Figure 5:
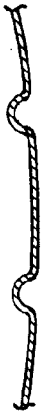
Figure 6:
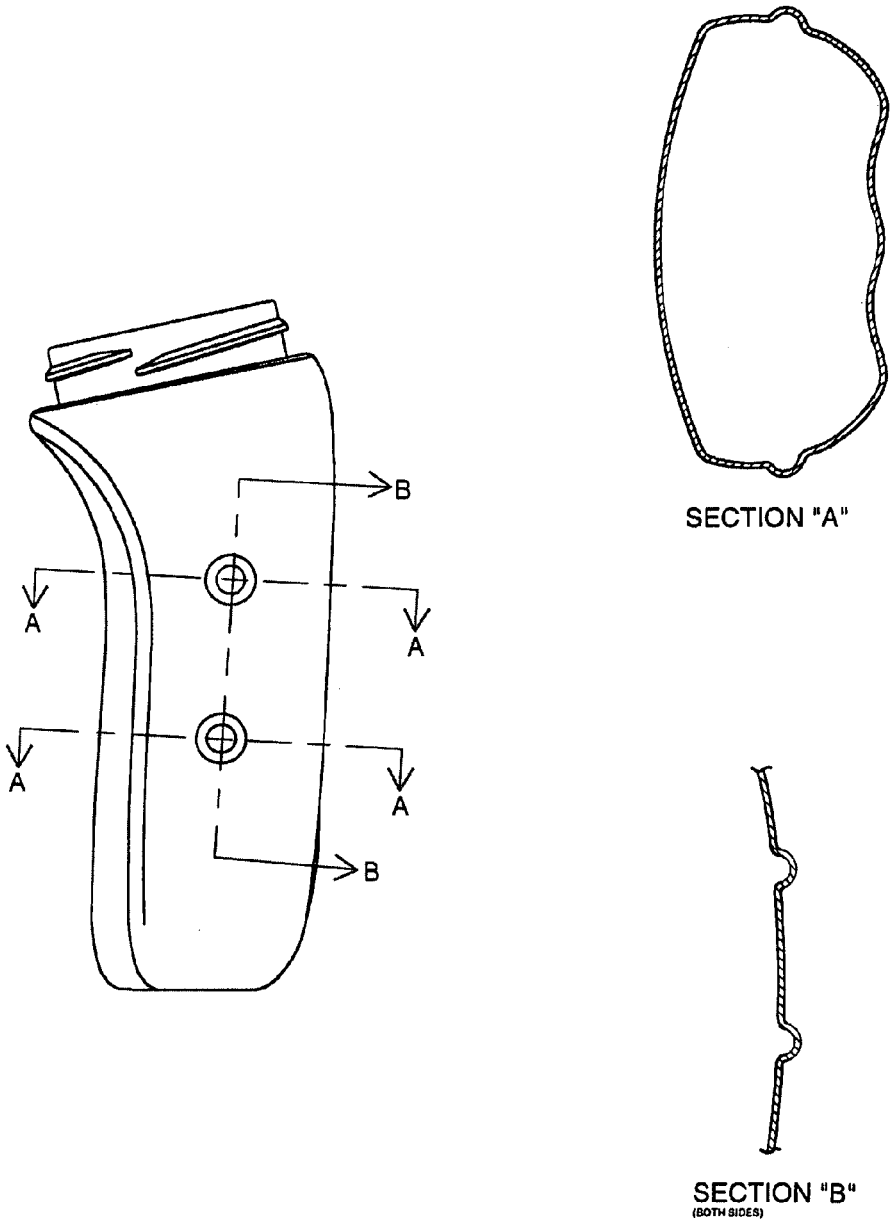
FIG. 6 shows a side view of another embodiment bottle of the preferred embodiment of the invention and two section views to show other features that are configured to mate with features on the disclosed retaining device
Figure 12:
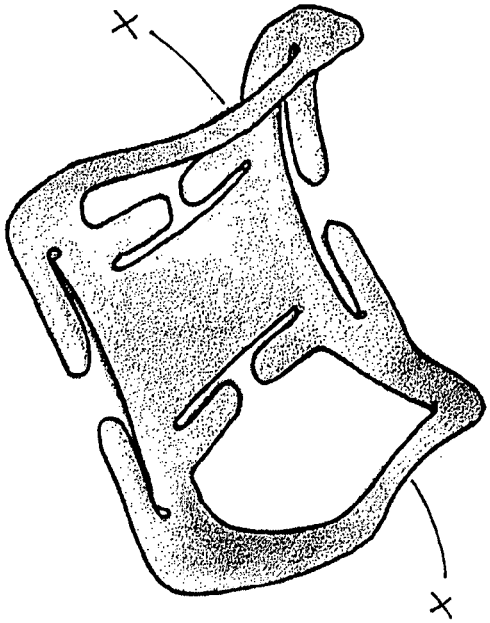
(FIG. 12 is an example of retaining device configured to fit with the bottle details disclosed in this figure, although many other retaining device examples disclosed herein could be configured to fit with these bottle details) so that the bottle (or the like) can be held firmly to the retaining device element.
Figure 13:
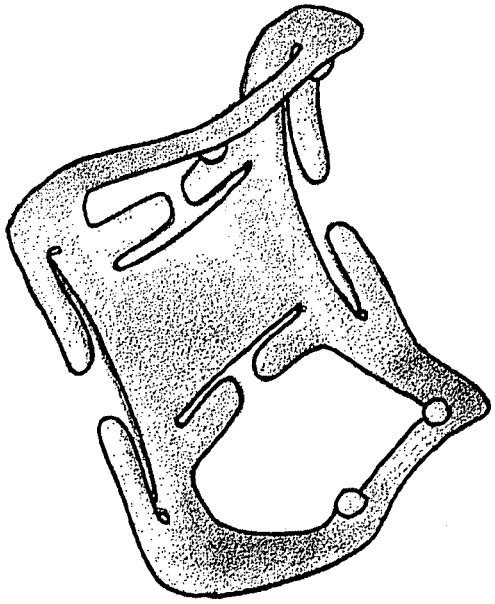
(FIG. 13 is an example of retaining device configured to fit with the bottle details disclosed in this figure, although many other retaining device examples disclosed herein could be configured to fit with these bottle details) so that the bottle (or the like) can be held firmly to the retaining device element.
Figure 14:
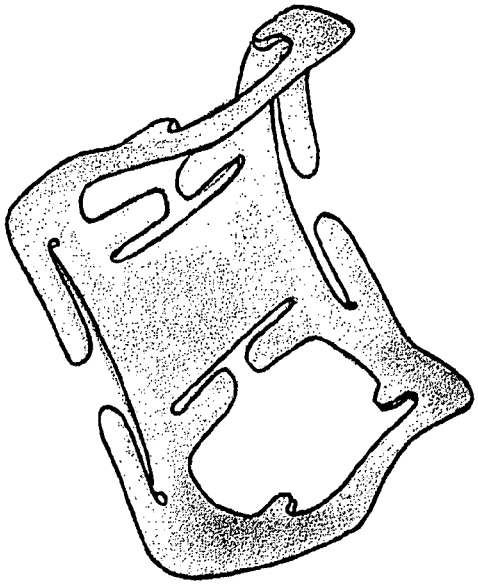
FIG. 14 shows a perspective view of another embodiment of the preferred retaining device configured to mate with a bottle configuration like that shown in FIG. 6 (also FIG. 3 could be configured to work).
Figure 15:
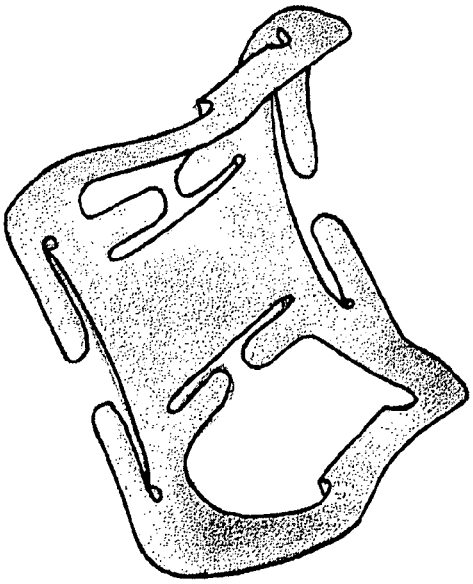
(FIG. 15 is an example of retaining device configured to fit with the bottle details disclosed in this figure, although many other retaining device examples disclosed herein could be configured to fit with these bottle details) so that the bottle (or the like) can be held firmly to the retaining device element.
Figure 67:
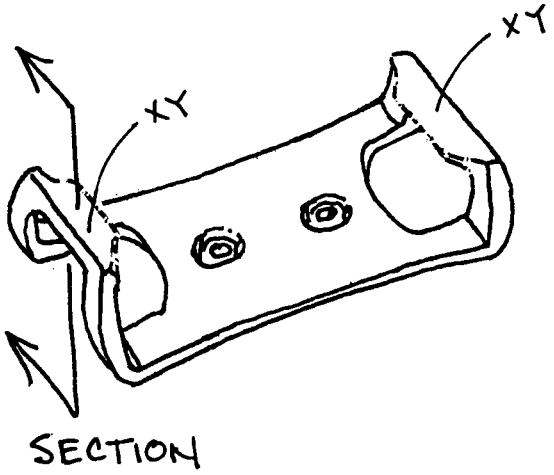
FIG. 67 shows a perspective view of a retaining device example embodiment (less preferable than the preferable embodiment) of the invention and a number of section views through the short axis of the preferred convex retaining device detent feature (to show examples of preferred features that are configured to mate with features on the disclosed bottle).
Figure 67:
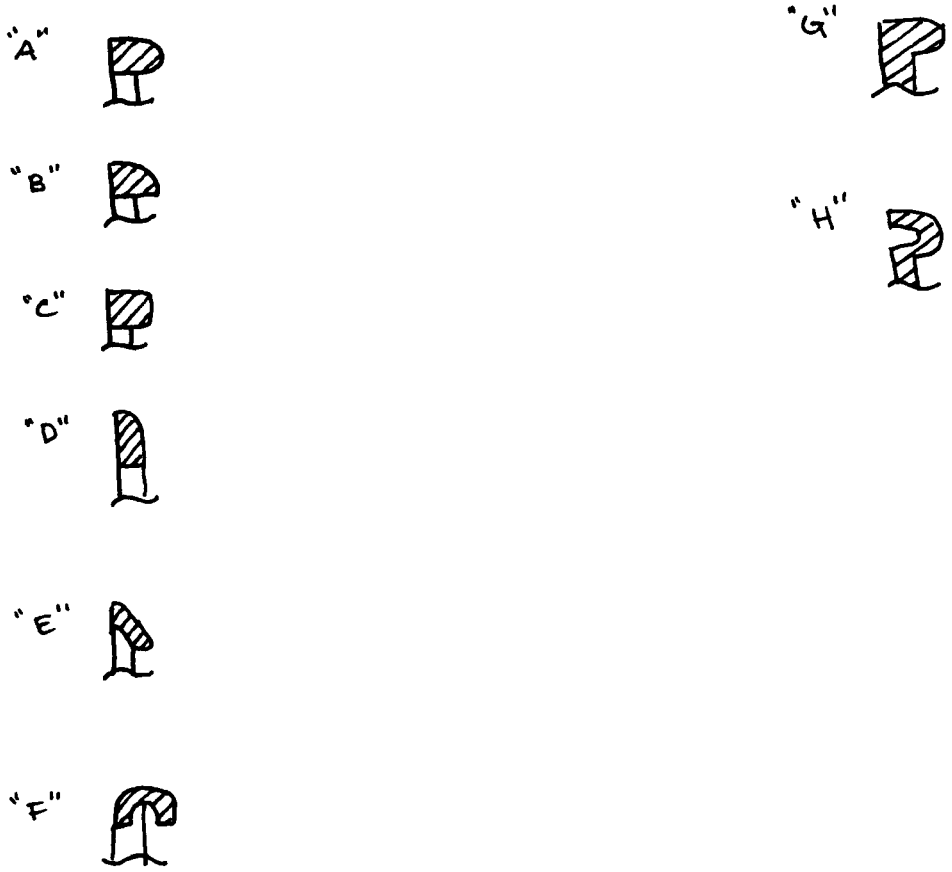
Figure 68:
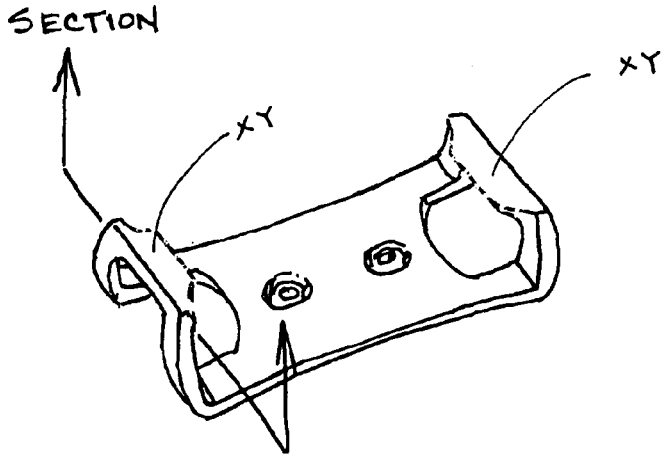
FIG. 68 shows a side view of a retaining device example embodiment (less preferable than the preferable embodiment) of the invention and a number of section views through the long axis of the preferred convex retaining device detent feature (to show examples of preferred features that are configured to mate with features on the disclosed bottle).
Figure 68:
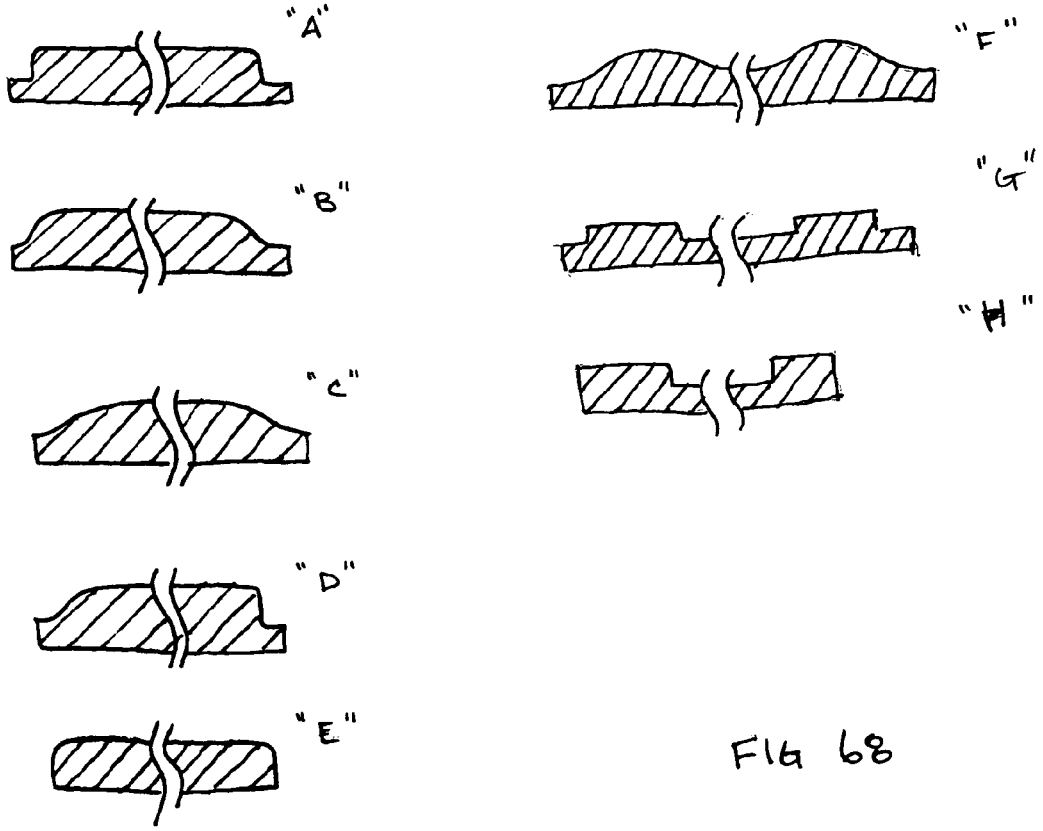
Figure 69:
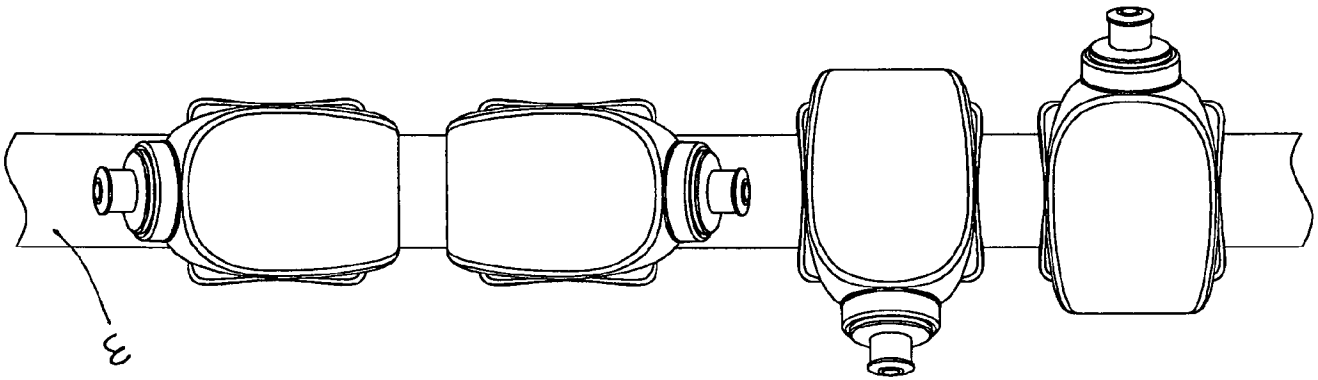
FIG. 69 shows a plan view of a bottle installed with retaining device and belt component "w" of the preferred embodiment of the invention. Figure shows how bottle and retaining device can be installed in different configurations depending on how "w" is mated with the belt grip components of the retaining device.
Figure 70:
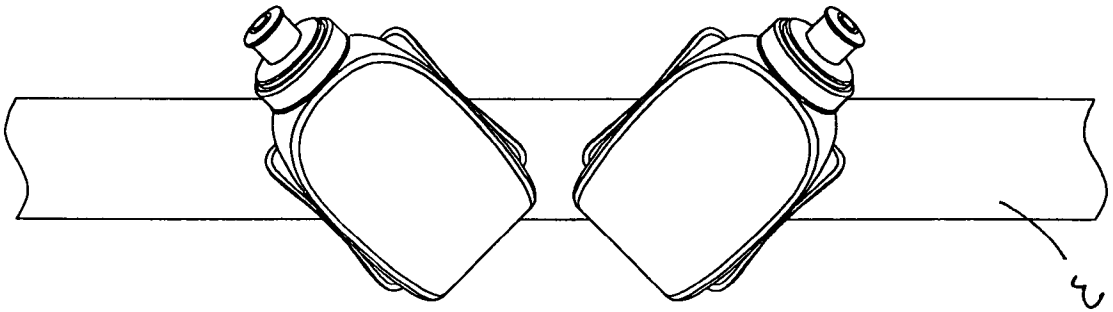
FIG. 70 shows a plan view of a bottle installed with angle adjustable retaining device as disclosed in FIGS. 28, 29 (and others could be configured such) and belt component "w" of the preferred embodiment of the invention. Figure shows how bottle and retaining device can be installed in different configurations depending on how "w" is mated with the belt grip components of the retaining device and the angle of the disclosed angling means.

D. Physical Description of the Retaining Device and Held Item's Architecture and Features Where They are Mated for Optimal Secure, but Removable and Replaceable Engagement with One-Another The bottle or the like preferably incorporates a feature or features that are formed integrally to the bottle or the like that mate with the retaining device to removably hold the bottle or the like in place in the retaining device. FIG. 2 Section "A" shows cross-section of bottle "A" defined by first axis LT and second axis WD orthogonal to LT, the bottle having a length along the first axis LT and a width along the second axis WD wherein the length LT is greater than the width WD. The second axis WD divides the bottle into a first portion and a second portion wherein the exterior surface of the first portion comprises a first shoulder SH1 and the exterior surface of the second portion comprises a second shoulder SH2; each of the first and second shoulders being configured for mating engagement with disclosed retaining device. The container is preferably formed in a somewhat flattened shape and made of preferably flexible material that allows the container to be flexed to lessen the dimension between the opposed docking elements whereby the container can be removably disengaged from the retention element docking features. The features integrated in/with the bottle or the like can take a number of forms/shapes so long as this/these shapes provide a feature or features that removably but securely mate with the retaining device. Preferably the bottle or "held item" incorporates at least two somewhat centrally placed (somewhat near to—on either side of—the "held item's" center of mass) concave longitudinal troughs (or shoulders) preferably configured on somewhat opposite sides to each other and running somewhat parallel to the bottles standing axis (as defined by an axis through the center of the mouth of the bottle and the center of the base). On both sides of the bottle or held item, and further illustrated in the Section "A" and "B" of FIG. 2 (and others). Instead of concave grooves as shown on the bottles of the preferred embodiment there are many other shapes/geometry that will work to mate with the disclosed novel retaining device (see FIGS. 3-6 and FIGS. 65-66 for examples). Although not preferable, the convex ridge positioned somewhat centrally and somewhat in the same location on the bottle or the like as discussed above in the preferred embodiment (shown FIG. 3 and others) could be provided on either side of the bottle or the like and mating concave features provided on the retaining device providing similar secure, but remateable engagement (see FIG. 3 and FIG. 12 for a mated bottle/retaining device pair). These mateable features can take the form of ball(s) and socket(s), groove(s), pin(s), textured areas, locally applied hook and loop material and protrusion(s) in a variety of shapes/geometry, and dimension, depending on what is being held, the holding force desired (depending on the level and jarring nature of the users activity) and the desired characteristics of the mating—secure but removable retention, in/out force, auditory sound on mating, feel, ergonomics, angle/procedure of mating and/or removal. The gripping/mating feature(s) provided on the retaining device two upward curving opposing side cut-out arms can also take many forms consistent within the scope of the invention as long as they/it provide a mateable grip directly, or a gripping action upon mutual contact) and/or intermediately of the "held item" firmly and reliably (see above mateable features for examples of geometry). See FIGS. 67 and 68 and others for some examples.

Figure 72:
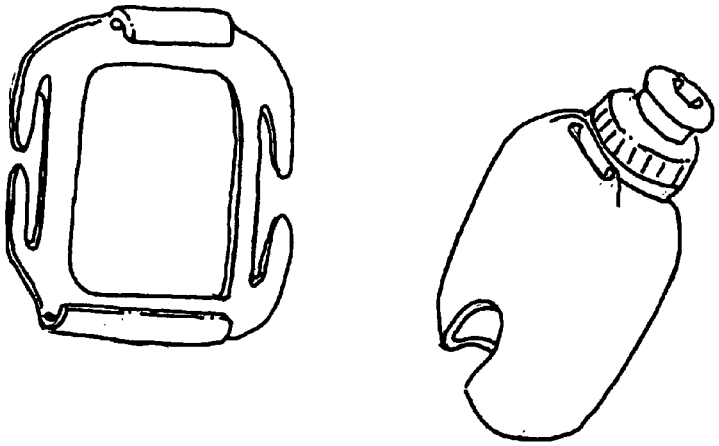
FIG. 72 shows a perspective exploded view of a less preferable embodiment of the plate and bottle portion of the invention. Bottle detent features are configured at 90 degrees from the disclosed preferable configuration. This configuration is less preferable than disclosed preferable configuration.

The bottle or the like engagement/grip elements are preferably configured on either side of the bottle or the like in such a way that they mate removably and re-attachably in such a manner that the bottle or the like is held firmly but can be removed by pinching, twisting, sliding, pulling and/or forcibly removing the bottle in some such manner, and replaced in similar manner, or by pure force. One or more sides of the slots/features in which the retaining device mates can be ramped or transitioned in such a way the preferred bottle or "held item" can be removably slid (ramping out) from the retaining device engagement details yet be still held relatively rigidly in place, by other mated feature mating locations. These mating elements are preferably configured somewhat central—on either side—to the "held item's" center-of-mass although for light items carried the indents on the container may be able to be placed closer to the plane of the "host item" or central portion of the plate or in another location (see FIG. 72).

Alternate Engagement Means

Figure 71:
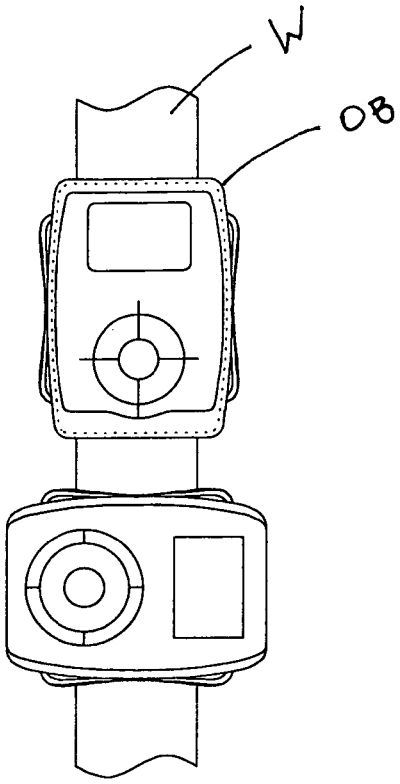
FIG. 71 shows a plan view of an electronic device (music player, medical device, etc.) installed in a preferable retaining device and belt component "w" of the preferred embodiment of the invention. Figure shows how device and retaining device can be installed in different configurations depending on how "w" is mated with the belt grip components of the retaining device and the angle of the disclosed angling means. An intermediate "over-boot" part labeled "ob" or the like can be used as an intermediate connection between the device ant the retaining device with the detent features resident in the sides of the "over-boot" part.
Figure 73:
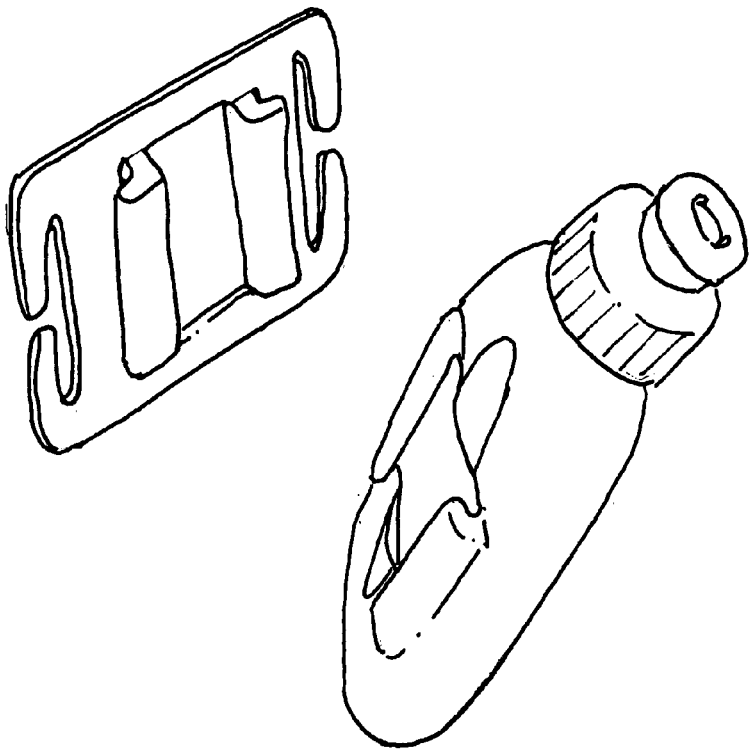
FIG. 73 shows a perspective exploded view of another less preferable embodiment of the plate and bottle portion of the invention. Bottle detent features are configured at the base of the bottle. This configuration is less preferable than disclosed preferable configuration.
Figure 75:
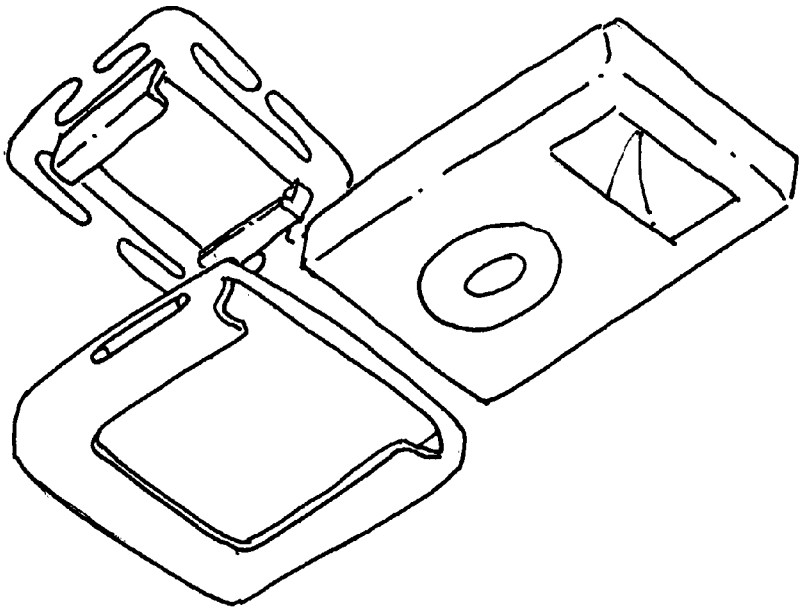
FIG. 75 shows a perspective exploded view of another less preferable embodiment of the plate and electronic device portion of the invention. Device detent features are configured on a secondary intermediate "over-boot" or the like. This configuration is less preferable than disclosed preferable configuration.
Figure 76:
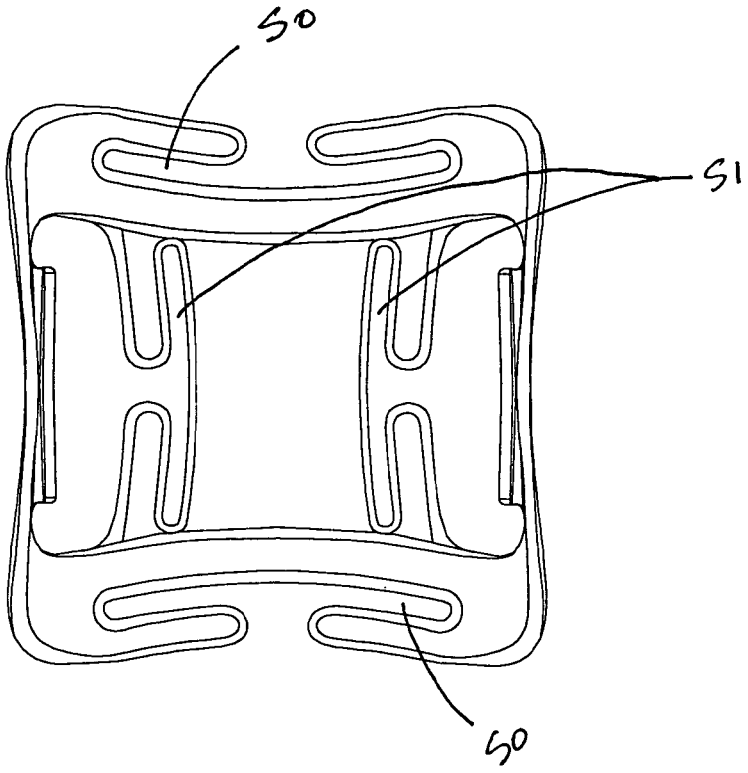
FIG. 76 shows a top orthographic view of the preferred embodiment of the retaining device. Belt/pad retaining slots labeled "si" and "so" defining somewhat inwardly facing peninsula-like projections.
Figure 77:
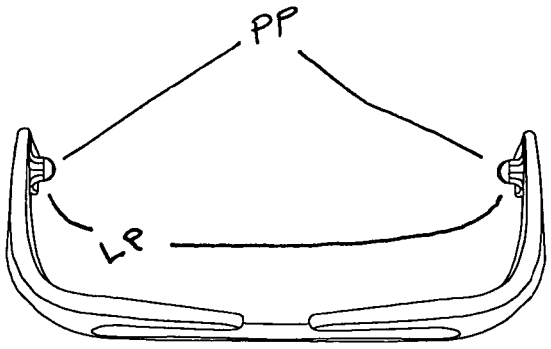
FIG. 77 shows a front orthographic view of the preferred embodiment of the retaining device (the back side would be a mirror image thereof).
Figure 78:
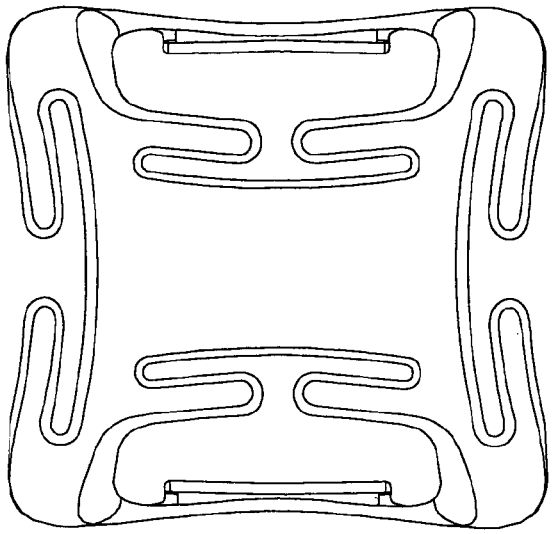
FIG. 78 shows a bottom orthographic view of the preferred embodiment of the retaining device.
Figure 79:
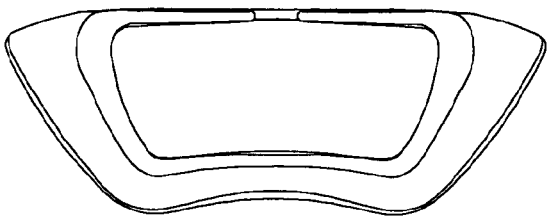
FIG. 79 shows a side orthographic view of the preferred embodiment of the retaining device (the other side would be a mirror image thereof).

Although the herein disclosed retaining device/bottle (or "held item") engagement means is preferably configured as described and pictured in the preferred embodiments, this engagement can be accomplished in a number of other ways. Retaining device/bottle engagement can be accomplished with a retaining device that engages internally to a gripping cavity or cavities on the bottle (although not preferable) a cavity, slot, trough or the like formed into the bottle could fit to an appropriately shaped counterpart on the retaining device element (instead of the preferable features resident in the sides of the bottle—see FIG. 73). Also the retaining device could grip around the bottle instead of to features resident in the sides of the bottle (or "held item"), or to an intermediate part (or parts) although this in less preferable. This intermediate part or parts could be affixed (glued, co-molded, snapped, screwed in place, held by friction, wrapped around) so that the geometry of the items mate or the like in some manner to the bottle (or "held item") and these/this element(s) provided a mateable connection point between the "held item" and the retaining device. An example of an intermediate connection to the retaining device is if the "held item" is a radio, electronic music player, PDA, phone or the like, a plastic, rubber or the like connection unit could be molded, cast or otherwise fabricated that would attach in some manner to the "held item". This intermediate connection unit (or container or the like)—see FIGS. 71 and 75—could be fabricated so that it affixed to the "held item" surrounding it like a rubber "over-boot" or the like or containing it (this intermediate part/container or the like could be made of a variety of rubbers, plastics or the like) and the retaining device could engage with mating details on the over-boot or the like component and the "over-boot"/container or the like would contain the "held item". This "over-boot"/container could be formed slightly or substantially larger (or in some cases smaller for a tight fit or substantially the same size) than the item(s) it contains/holds fit within. Another example of this kind of intermediate part would be a Tupperware like container with features preferably integrated into its sides that mate with the retaining device grip features, the size, shape and other details of this Tupperware like unit would be configured to fit what it is desired to contain or hold (like a radio, music player, other "held item" or the like). This intermediate connection unit would allow multiple different kinds of off-the-shelf "held items" like music players, PDAs, cell phones or the like to fit with the same retaining device unit by fabricating a specific intermediate connection unit specific to fit with that specific instrument (or "held item"). Also these mating details that engage with the retaining device on the "held item" could be molded directly into the "held item" similar to the manner they are molded directly into the disclosed bottle or the like forgoing an intermediate connection unit. Herein disclosed the retaining device belt or the like connection features could be formed integral into the "held item" or preferable bottle so that the bottle or the like is removable and fixable to the belt or the like using the retaining device belt connection features.

Preferred Host Item (Belts/Straps) and Optional Often Desirable Variations of Host Items There are certain functionally desirable properties of the belting system to allow it to function as a system to comfortably hold the retaining device or retaining devices to the body in a manner that is rigid yet comfortable, to control the undesirable bounce/movement of the system while in use, to allow it to function to hold the bottles and other objects being carried while encumbering the user in a manner that is as minimal (or non-existent) as possible. Minimizing weight, maximizing the allowable mobility of the user, holding the carried items in a manner that is rigid to the body so that they act as one with the body and do not bounce or feel encumbering (maximizing the comfort to the user) are the desirable characteristics of the belting (or the like) system to the user.

The following disclosed novel invention describes a belt constructed of a combination of materials in such a way to achieve the desired functional requirements. Although the belting system could be manufactured in many other ways, the availability of materials, manufacturing issues, and the properties of readily available materials is important to the choice of design and construction of the belting system. It is important to note that many other material choices and combinations could be combined within the scope of the invention to attain a similar result of the desired belting system requirements. Many examples of materials and construction processes will be discussed so that the novel invention of the functionally desirable belt system or the like is described yet should not be limited to these within the scope of the invention.

The main belt upon which other materials are preferable affixed to obtain the desired belting system, sewn glued, grommeted or attached in other ways like with hook and loop Velcro or the like is preferably made of elastic, stretchy or somewhat stretchy, breathable, flexible webbing/belting examples of which are commonly found in the waist band of underwear, tights, compression tights, pants or the like also suspender strapping or the like. Also nylon, cotton, polypropylene or the like webbing could be used in another embodiment as well as a strip or strips of other fabric made of cotton, nylon, polyester or other natural or synthetic fiber materials or blends in combination with webbing, material, mesh or the like or by itself. Also although not preferable a strip or strips of leather, plastic or leather-like material or materials could be used for the main belt of the novel system.

Another embodiment uses somewhat flexible but not stretchy nylon, polypropylene webbing or the like integrated with a portion of stretch material (like elastic webbing, rubber, bungy material or the like) to get a desired controlled stretch to move with the users breathing yet not allow too much stretch that would allow the carried items to bounce during jarring activities.

Because in some cases stretch is desired for flexibility of the belt but too much stretch allows the carried items on the belt to bounce during jarring or somewhat jarring activities a stretch limiter is preferably incorporated into the belt system or the like to allow a controlled amount of stretch. Also low stretch materials can be used for the belting to allow a little flexibility but not too much so that bounce of carried items is limited.

Attached to part, portions, or all of the length of the main belt preferably is a strip, strips or pieces of non-stretchy or somewhat non-stretchy webbing, ribbon or other fabric, strip, or element. This element is incorporated to control (or limit stretch). This stretch limiting element or elements is preferably made of non-stretchy or somewhat non-stretchy webbing, ribbon, nylon fabric or the like but also could be accomplished in other ways such by sewing areas with non-stretchy or somewhat non-stretchy thread or sewing, gluing, or otherwise attaching non-stretchy or somewhat non stretchy elements made of plastic, leather, vinyl, nylon or the like. Also hook and/or loop or the like material can be sewn glued, heat applied or otherwise affixed along the length or portions of the length to accomplish a similar stretch-limiting/controlling result and can have other uses for example being part or parts of the fastening closure for holding the belt on the user.

In another embodiment the stretch limiter portion of the belt can be assembled to the somewhat stretchy portion of the belt by stretching one side and sewing the limiter in place. The opposite side is relaxed and then sewn in place so the belt will curve. This curve or somewhat curved belt geometry can be desirable for users that have smaller waists with respect to hips providing for some users a more comfortable fit.

Although not preferable for some uses the stretch limiter could be eliminated and a stretch belt could be used. This may be desirable for carrying light loads on the belt or if a low stretch belt/elastic is used. The stretch-limiter is preferably sewn around its perimeter to the base preferably stretchy belt although it can be sewn at its ends or strategically in certain areas and not in other to provide functional elements (for example loop areas could be left un-sewn similar to an ammunition belt).

Figure 56:
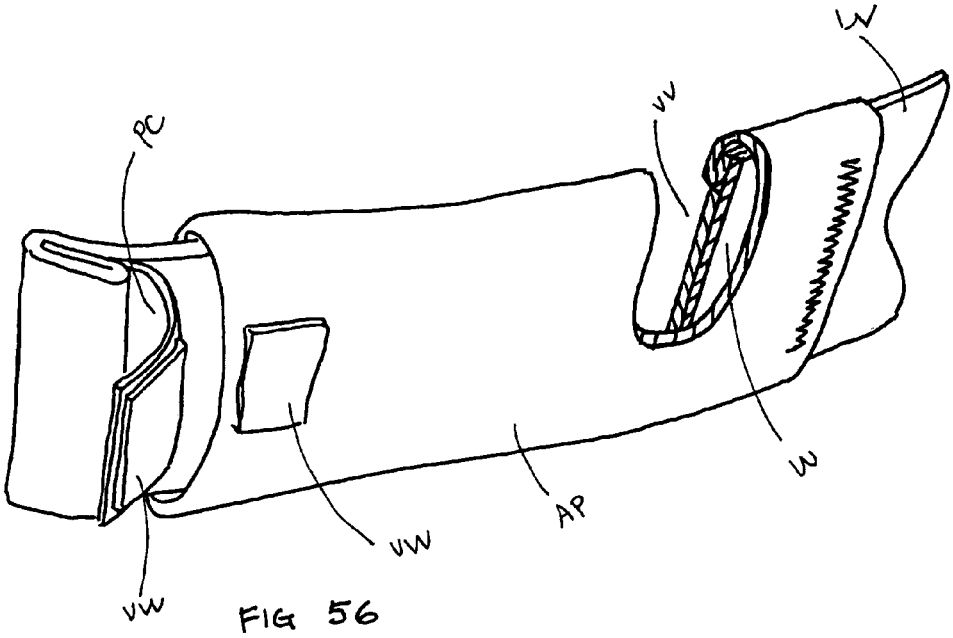
FIG. 56 shows a cut-away perspective view of the pocket forming means of the primary embodiment of the preferred belt assembly (as shown in FIG. 55) for holding retaining device components as disclosed.
Figure 57:
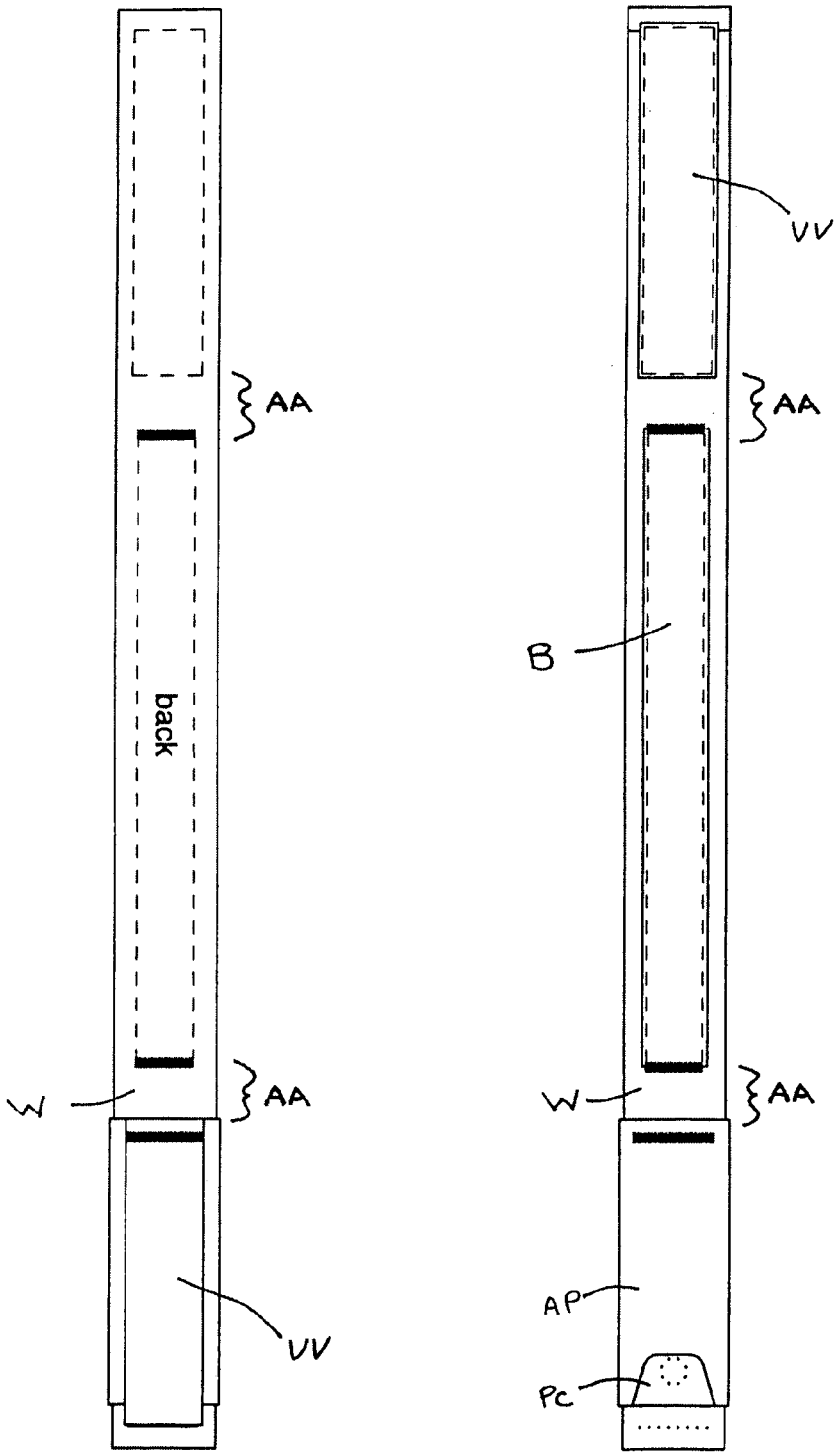
FIG. 57 shows front and back orthographic views of the primary embodiment of the preferred belt assembly for holding retaining device components as disclosed.
Figure 58:
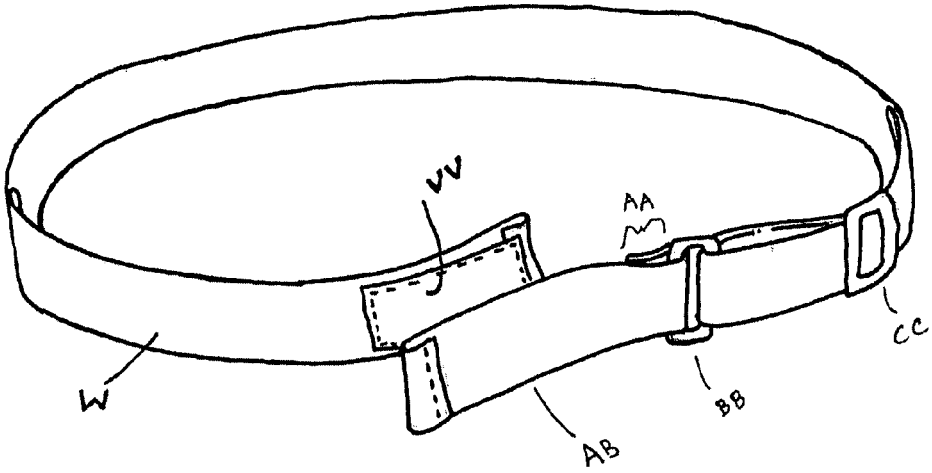
FIG. 58 shows a perspective view of another embodiment of the preferred belt assembly for holding retaining device components as disclosed. The main belt portion of this embodiment "w" is preferably made of non-stretch webbing, or the like. Part "a" (shown in FIG. 59) represents an exchangeable closure element. This element is preferably made primarily from stretch webbing "ab" and Velcro "vv" or the like is sewn to one side with a portion "aa" doubled back on itself and sewn to fasten through loops "bb" (this portion does not have Velcro). Portion "aa" as denoted represents a portion of the preferably stretchy webbing belt that does not have stretch-limiting means. Stretch-limiting means in this embodiment is provided by Velcro "vv" fastened locally and thus will provide some controlled stretch as determined by the stretch of the material primarily used for the foundation of "ab" and the size and geometry of portion "aa". Size adjusting means is provided by looping "w" through loop or the like "bb" and back on itself to preferably sew or the like to belt adjusting part "cc" which is assembled to "w" so that it slides and provides this adjusting means.
Figure 59:
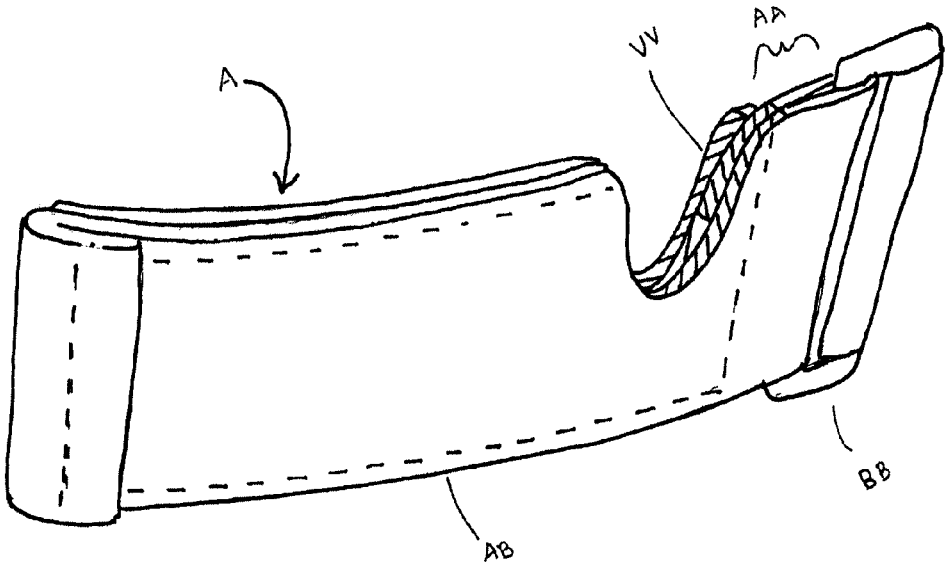
FIG. 59 shows a cut-away perspective view of the exchangeable closure element of the embodiment shown in FIG. 58. This exchangeable closure element preferably attached to belt "w" fixed there by loop "bb" and adjuster part "cc" (as shown in previous the figure).
Figure 60:
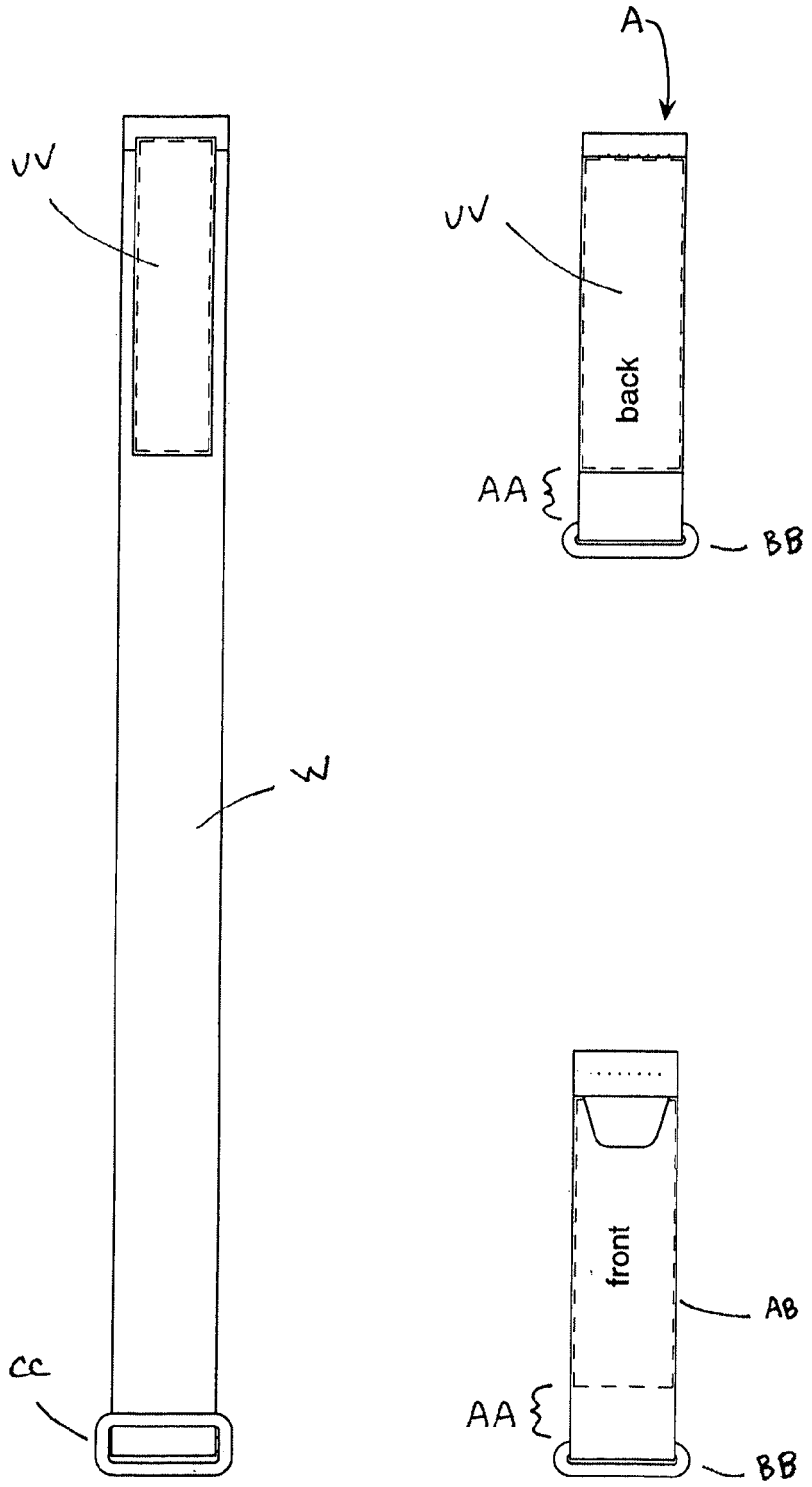
FIG. 60 shows front and back orthographic views of the exchangeable closure element "a" and belt portion for embodiment shown in FIG. 59.
Figure 61:
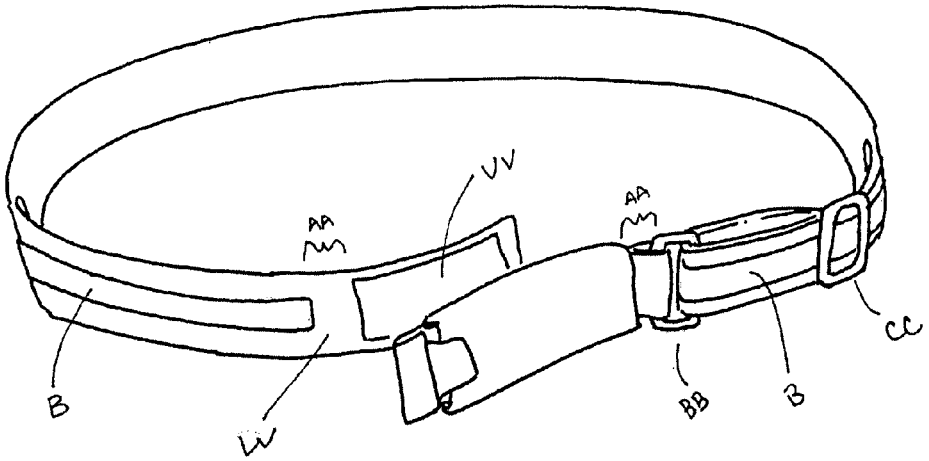
FIG. 61 shows a perspective view of another embodiment of the preferred belt assembly for holding retaining device components as disclosed. The main belt portion of this embodiment "w" is preferably made of stretch webbing or the like and the stretch limiter "b" is preferably made of substantially non-stretchy nylon or polypropylene webbing or the like. Part "b" is preferably sewn to part "w" around the perimeter of part "b" so that is fixed to part "w" and performs its function to limit the stretch of main belt "w". Portion "aa" as denoted represents a portion of the preferably stretchy webbing belt that does not have stretch limiting means (part "b" and Velcro or the like "vv") fastened locally and thus will provide some controlled stretch as determined by the stretch of the material used in portion "w", "ab" and the size and geometry of portion "aa", "vv" (Velcro or the like) provides fastening means of the belt to itself around the user as well as provides stretch limiting means along the portion of "w" and "a" where it is preferably sewn. Portion "ap" is preferably wrapped around "w" and sewn along its edges and along one of its short sides. This forms a pocket with closure tab "pc" part of "w" or an extension of folded over and sewn portion of "w" on to cover the unsewn opening formed by not sewing closed one of the short sides of portion "ap" and closure means preferably Velcro or the like or a snap or other fastener as pictured here. Extension "pc" is preferably Velcro or some other fabric, plastic, or rubber or the like part with Velcro portion or other fastener attached or integrally formed. Part "a" (shown in FIG. 62) represents an exchangeable closure element with pocket or the like forming means integrally formed. This element is preferably made primarily from stretch webbing "ab" and Velcro "vv" or the like is sewn to one side with a portion of "ab" doubled back on itself and sewn to fasten through loops "bb" (this portion does not have Velcro) forming stretch portion "aa". Portion "aa" as denoted represents a portion of the preferably stretchy webbing belt that does not have stretch-limiting means. Stretch-limiting means in this embodiment is provided by Velcro "vv" and on belt portion stretch-limiter "b" fastened locally and thus will provide some controlled stretch as determined by the stretch of the material primarily used for the foundation of "ab", "w" and the size and geometry of portion "aa". Size adjusting means is provided by looping "w" through loop or the like "bb" and back on itself to preferably sew or the like to belt adjusting part "cc" which is assembled to "w" so that it slides and provides this adjusting means.
Figure 62:
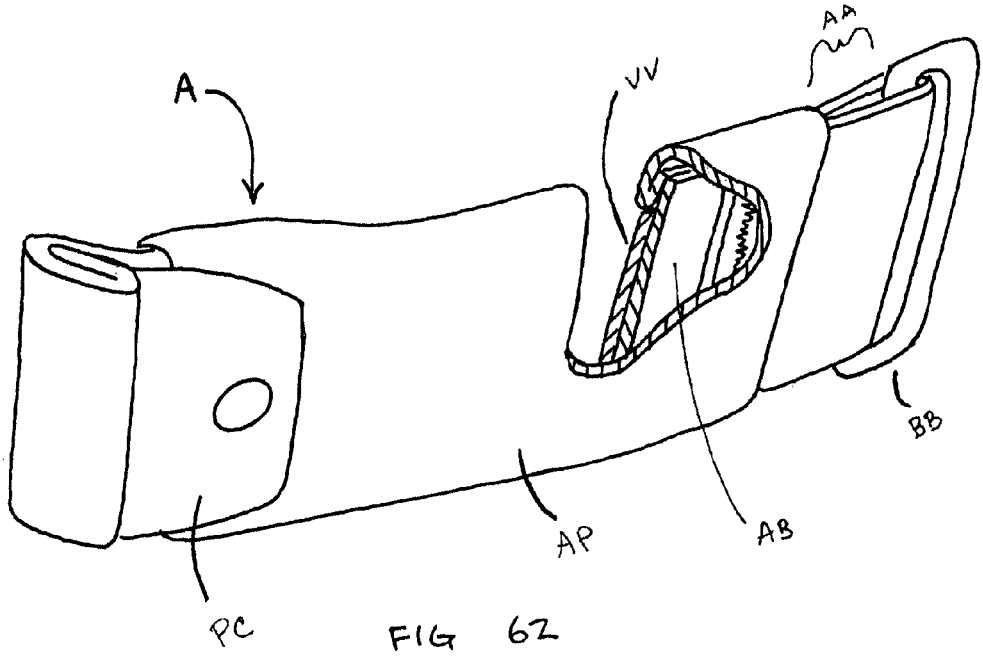
FIG. 62 shows a cut-away perspective view of the exchangeable closure element with pocket forming means of the embodiment shown in FIG. 61. This exchangeable closure element preferably attached to belt "w" fixed there by loop "bb" and adjuster part "cc" (as shown in previous Figure.)
Figure 63:
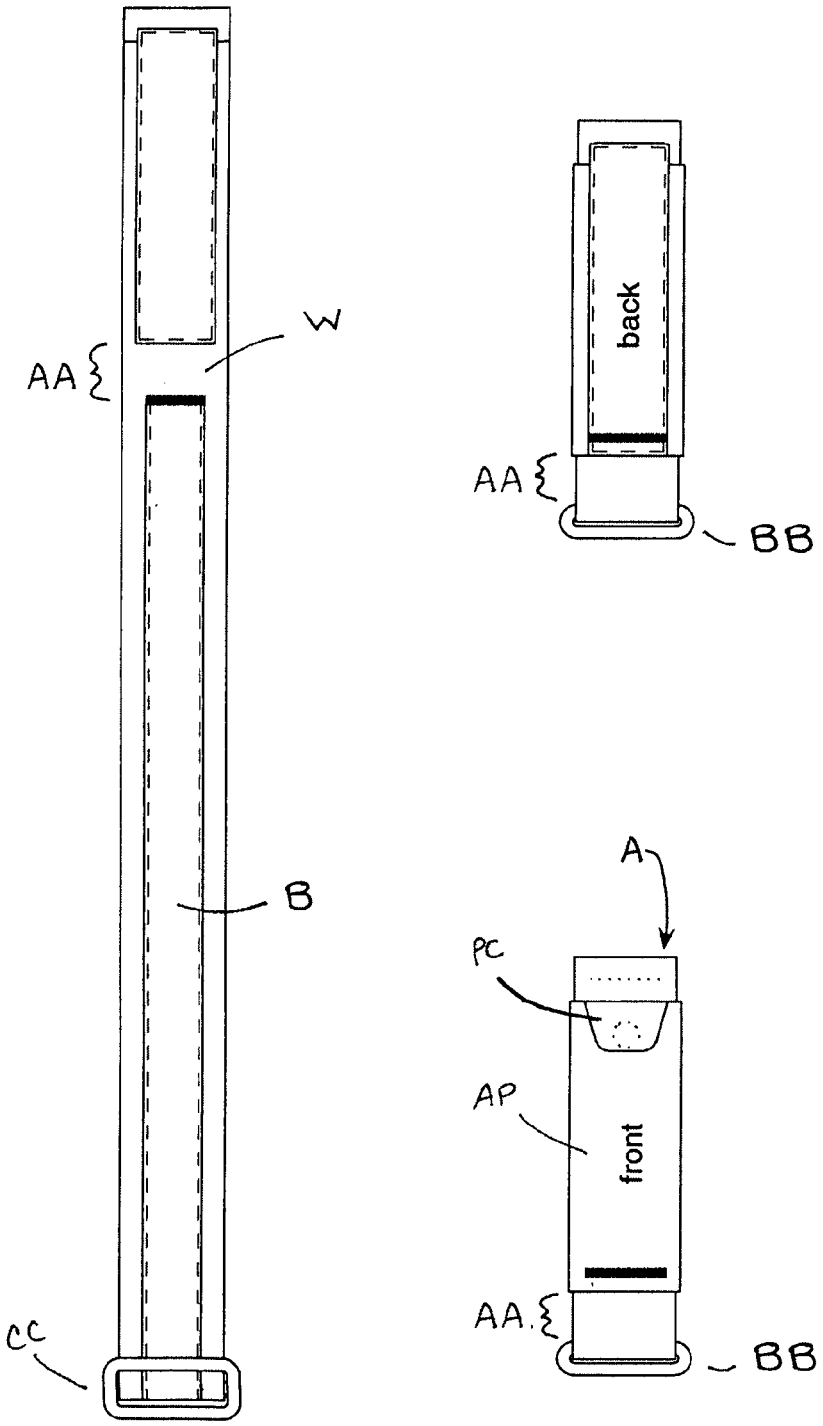
FIG. 63 shows front and back orthographic views of the exchangeable closure element "a" with integrally formed pocket forming means and belt portion for embodiment shown in FIG. 61.
Figure 64:
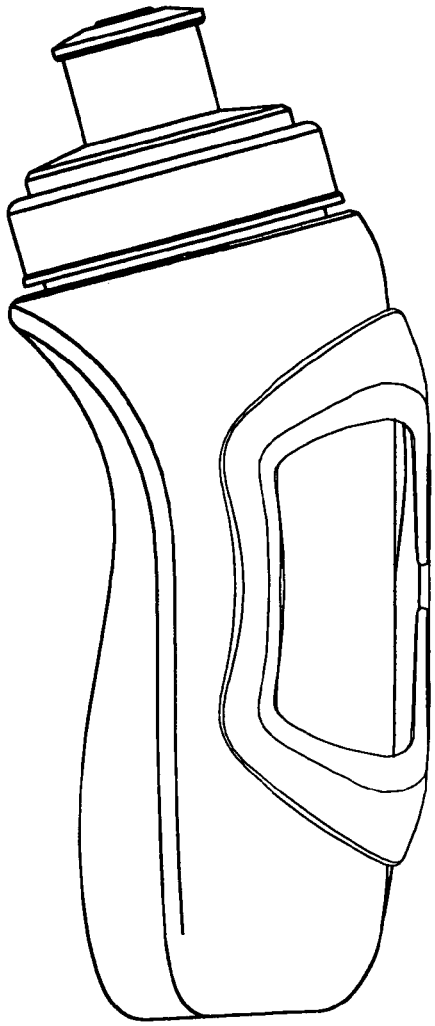
FIG. 64 shows a side view of a bottle installed with retaining device of the preferred embodiment of the invention.
Figure 65:
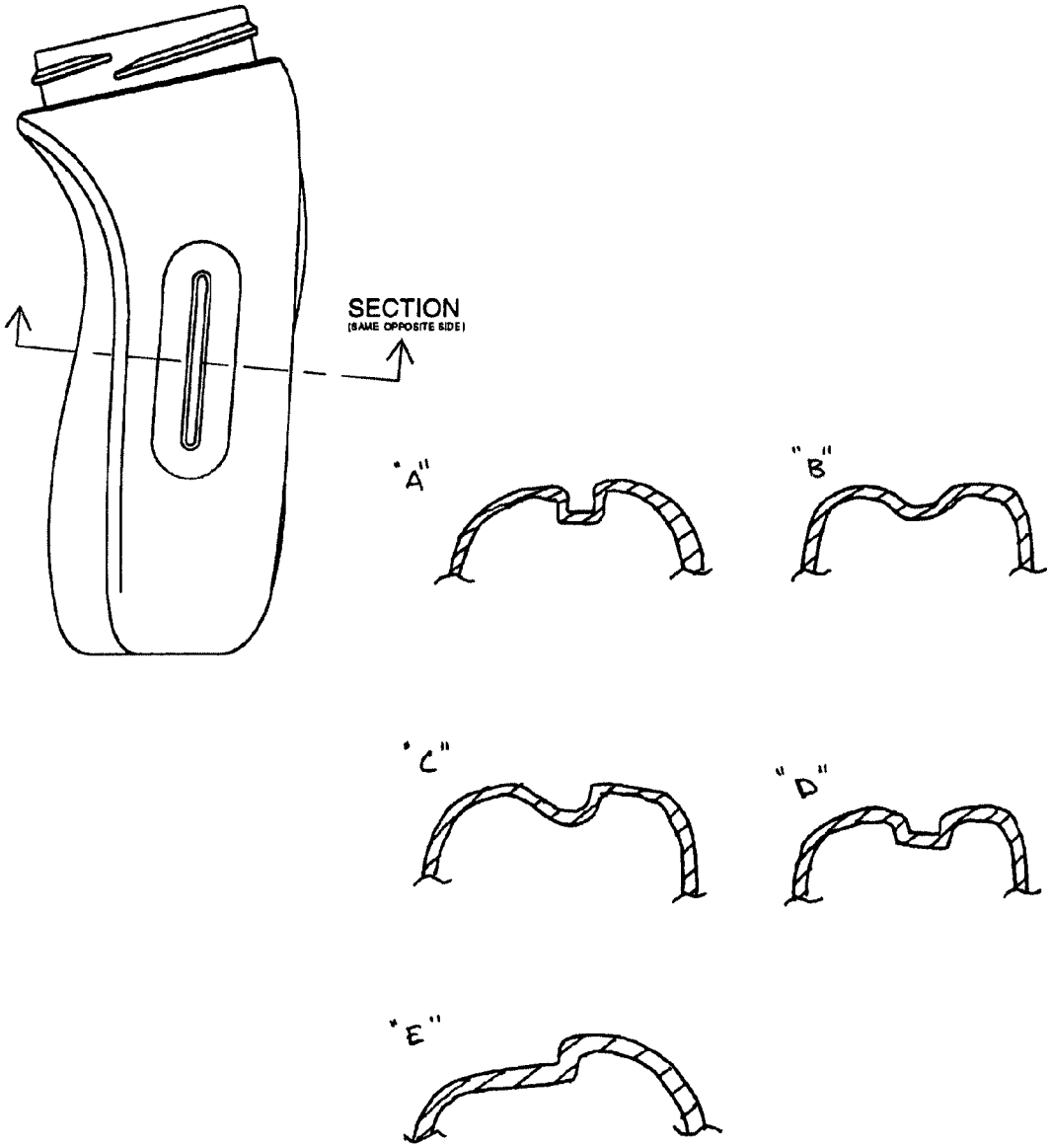
FIG. 65 shows a side view of a bottle of the preferred embodiment of the invention and a number of section views through the axis shown by the section line of the preferred concave bottle detent feature (to show examples of preferred features that are configured to mate with features on the disclosed retaining device).
Figure 66:
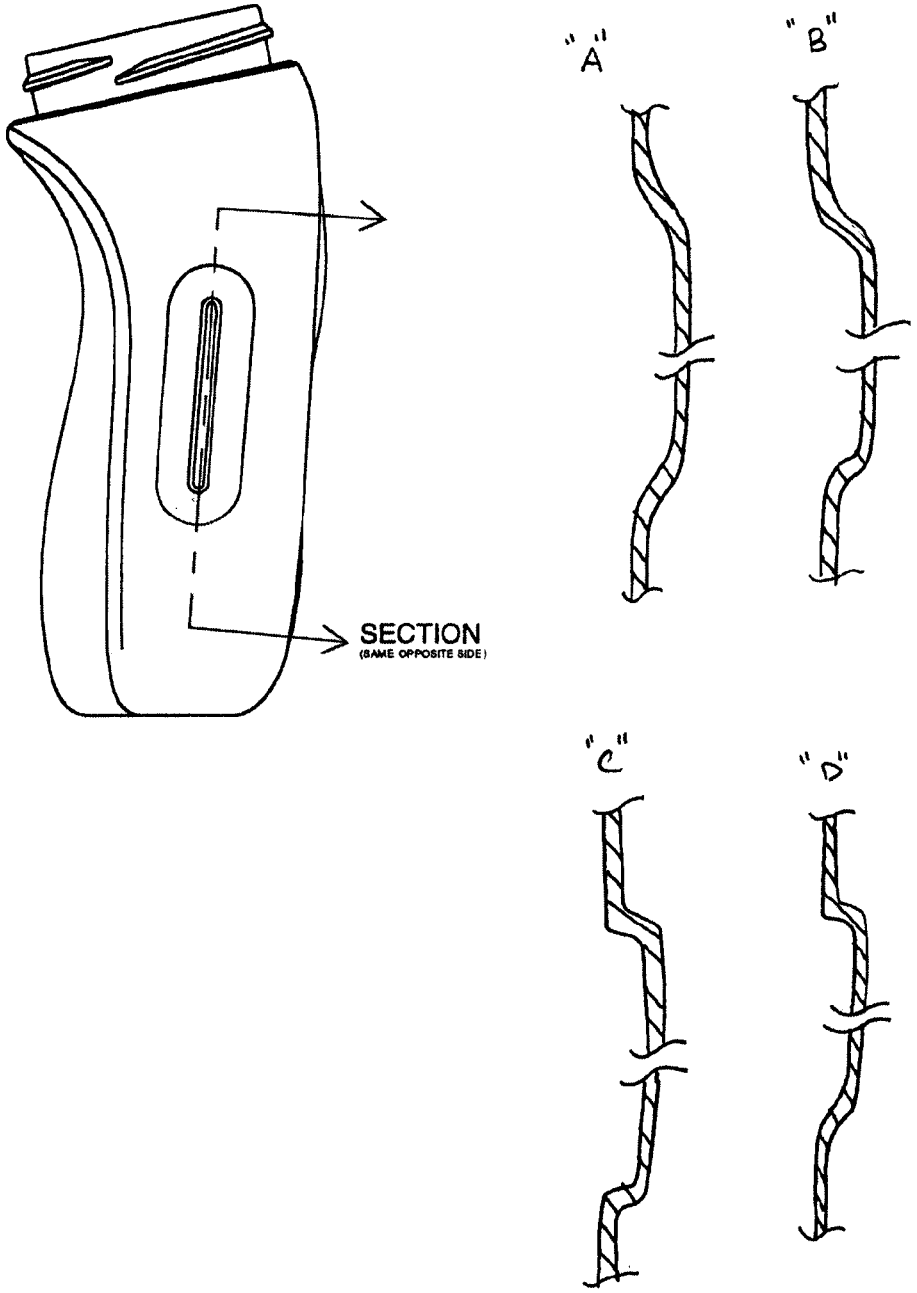
FIG. 66 shows a side view of a bottle of the preferred embodiment of the invention and a number of section views through the axis shown by the section line of the preferred concave bottle detent feature (to show examples of preferred features that are configured to mate with features on the disclosed retaining device).

"Energy bar or the like" pocket integrated into belt or the like (see FIG. 56 and others).

Figure 55:
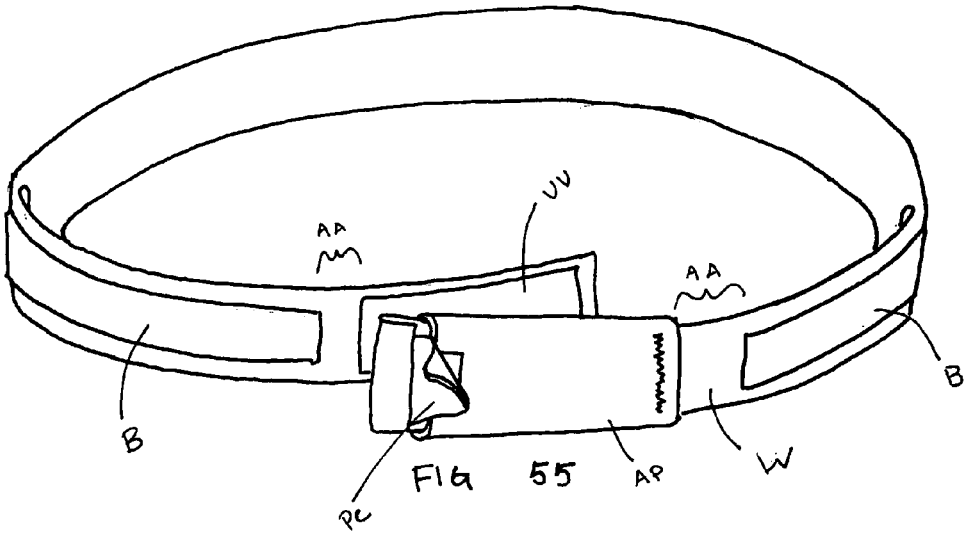
FIG. 55 shows a perspective view of the primary embodiment of the preferred belt assembly for holding retaining device components as disclosed. The main belt portion of this embodiment "w" is preferably made of stretch webbing or the like and the stretch limiter "b" is preferably made of substantially non-stretchy nylon or polypropylene webbing or the like. Part "b" is preferably sewn to part "w" around the perimeter of part "b" so that is fixed to part "w" and performs its function to limit the stretch of main belt "w". Portion "aa" as denoted represents a portion of the preferably stretchy webbing belt that does not have stretch limiting means (part "b") fastened locally and thus will provide some controlled stretch as determined by the stretch of the material used in portion "w" and the size and geometry of portion "aa", "vv" (Velcro or the like) provides fastening means of the belt to itself around the user as well as provides stretch limiting means along the portion of "w" where it is preferably sewn. Portion "ap" is preferably wrapped around "w" and sewn along its edges and along one of its short sides. This forms a pocket with closure tab "pc" part of "w" or an extension of folded over and sewn portion of "w" on to cover the unsewn opening formed by not sewing closed one of the short sides of portion "ap" and closure means preferably Velcro or the like "vw". Extension "pc" is preferably Velcro or some other fabric, plastic, or rubber or the like part with Velcro portion "vw" attached.

Another element that is believed to be a novel part the disclosed invention as well as uniquely novel by itself is the below disclosed item carrying means. This just mentioned item carrying means is intended to carry personal items or the like (items including but not limited to energy bars, energy gel, food items or the like, sunglasses, money, cards, key(s), electronic items, etc.) This novel item carrying means is preferably constructed primarily of a very stretchy or somewhat stretchy front panel or panels (preferably made of, but not limited to, Lycra spandex, stretch mesh or other very stretchy or somewhat stretchy material) and a more rigid back panel (preferably made of, but not limited to, webbing, Velcro, leather, or the like). The two halves of this item carrying means are preferably fastened along their edges preferably along either side of the long dimension of the belting/strapping or the like on which this item carrying means resides. This item carrying means is preferably fastened closed at both ends (closure means for one or both ends is preferably remateably closed with one or multiple snaps, overlap-type closure (commonly used in sandwich bags, saddle bags, purses, etc although configured sideways—see FIGS. 55, 56), Velcro, buttons or the like other closure fasteners, flaps or systems used. Closure or closures can be accomplished in a multitude of ways including using separate fasteners attached to the front and/or back panels and/or be formed from folding over the back panel onto the front and covering the front panel with the back sewing or otherwise attaching in place or an extension of the back, with separate sewn on or otherwise attached parts, etc. Also one end can be sewn, glued, heat sealed, grommeted, or the like closed so that only one end incorporates a remateable closure. Although not preferable for many applications, in some applications it may be desirable to not close either end (the stretchy-ness of the material of the front panel could be used to hold the item in place).

The novel item carrying means is intended to stretch to fit a variety of carried objects while itself being light, simple to manufacture and comfortably worn against the user. The preferably somewhat rigid (or more rigid than the front panel) back panel would preferably be worn against the user or against a somewhat flat surface/area and the stretchy front panel would stretch/conform outward to contain and conform to the carried item(s) so that a variety of objects could be carried alone or in combination comfortably constrained to minimize bounce and discomfort from sharp, bumpy objects poking into the user while maximizing the variety of what can be carried. Although in some cases a back panel constructed of materials only minimally padded like webbing, neoprene, somewhat stiff fabric, Velcro and the like are perfectly suited for cushioning/protecting the user from feeling/being poked by the items carried in the disclosed item carrying means it may be desirable in some cases to provide further cushioning integrated, sewn, trapped, glued or the like, etc. into this back panel in the form of foam padding or the like.

A preferable method of creating the herein disclosed item carrying/enclosing means that allows a favorable aesthetic and provides good expandability is herein described: in short the substantially or somewhat stretchy front panel(s) are preferably sewn, glued or otherwise attached along their long two sides (and in some cases one of the two short sides as well) to the substantially or somewhat rigid back panel to the back edges of this back panel. Then this assembly is inverted (turned right-side out, inverted on itself much like you would an inside-out sock, so that the stretch material wraps around and covers the sides of the somewhat rigid back panel.) A closure or closures is integrated to close one or both ends of the item carrying means as discussed above.

As herein disclosed and pictured this item carrying/enclosing means is preferably integrated into the end or attached to the end with a loop or in some other way to the end of the belt or belt-like element of the disclosed invention so that is part of the front closure of the belt or belt-like element. Although in some cases it is preferable to integrate this item carrying/enclosing means near the end of the belt or belt-like element in some instances it may be desirable to position it substantially away or somewhat in the middle or somewhere along the belt or belt-like element away from the end of the belt or belt-like element.

A pocket or pockets in another embodiment is incorporated into the closure/buckling/fastening means of the belt system in a more traditional top access/top opening manner. This pocket or pockets has a front and rear panel (the rear panel could be the belt or the like element itself) as well as can have an internal divider or dividers, pocket or pockets, etc.

Figure 51:
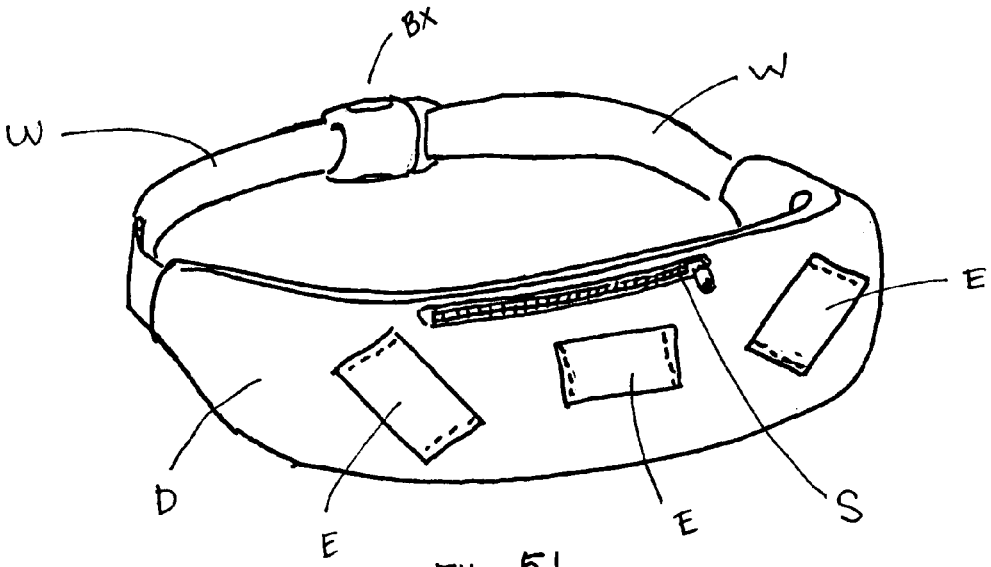
FIG. 51 shows a perspective view of belt assembly for holding retaining device components as disclosed. Figure shows components "w" and "e" for engaging with retaining device grip details. Zipper "s" closes a pocket in the pad/pocket portion "d". A traditional buckle-type fastener "bx" is incorporated to mate the belt around the user.
Figure 52:
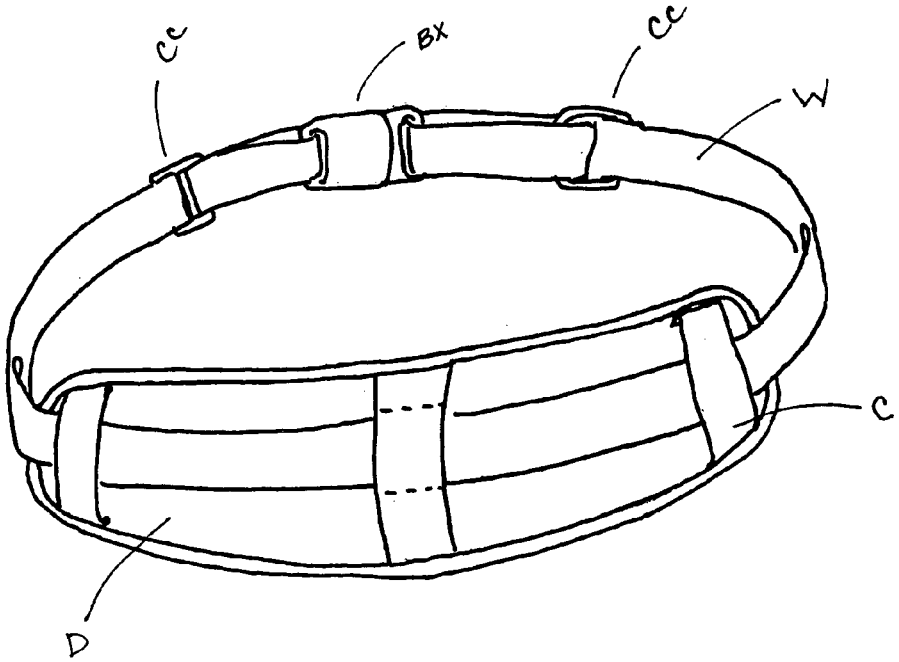
FIG. 52 shows a perspective view of belt assembly for holding retaining device components as disclosed. Figure shows the pad/pocket portion "d" and belt loop elements (one is labeled "c" for clarification). A traditional buckle-type fastener "bx" and optional adjustment loops "cc" are incorporated to mate the belt around the user.
Figure 53:
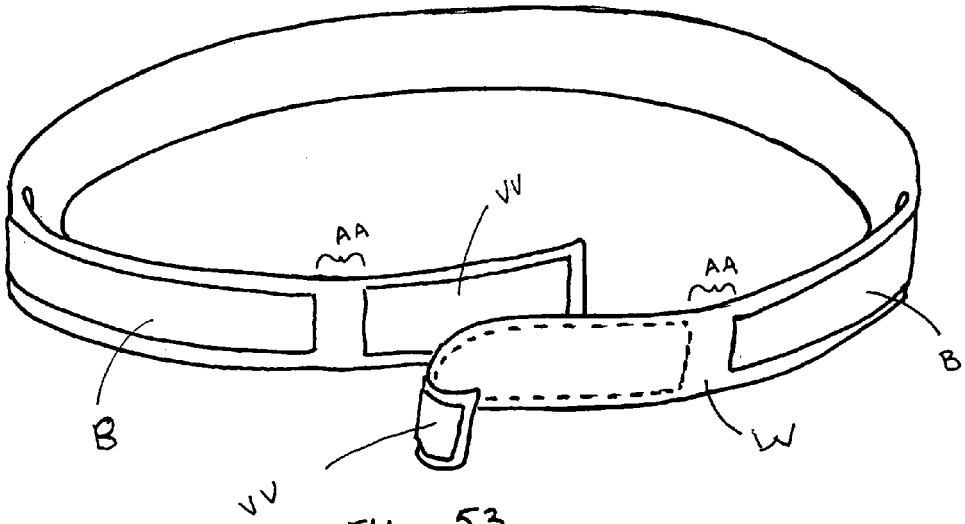
FIG. 53 shows a perspective view of an embodiment (secondary) of the preferred belt assembly for holding retaining device components as disclosed. The main belt portion of this embodiment "w" is preferably made of stretch webbing or the like and the stretch limiter "b" is preferably made of substantially non-stretchy nylon or polypropylene webbing or the like. Part "b" is preferably sewn to part "w" around the perimeter of part "b" so that is fixed to part "w" and performs its function to limit the stretch of main belt "w". Portion "aa" as denoted represents a portion of the preferably stretchy webbing belt that does not have stretch limiting means (part "b") fastened locally and thus will provide some controlled stretch as determined by the stretch of the material used in portion "w" and the size and geometry of portion "aa", "vv" (Velcro or the like) provides fastening means of the belt to itself around the user as well as provides stretch limiting means along the portion of "w" where it is preferably sewn.
Figure 54:
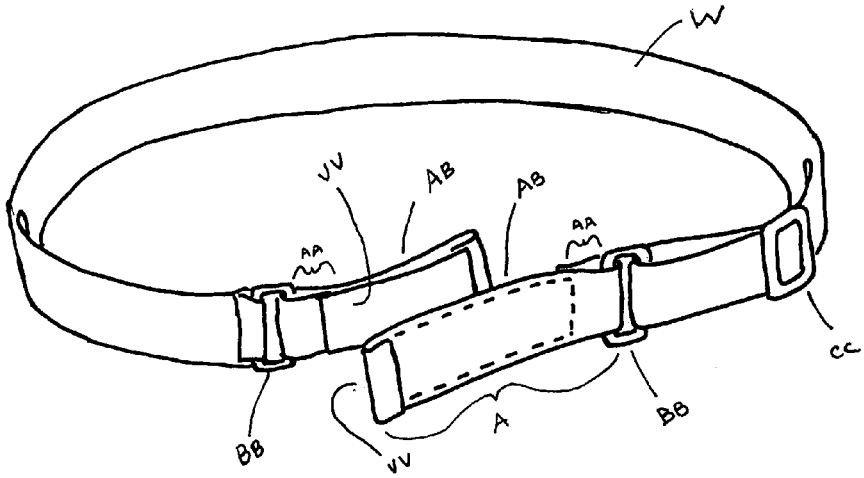
FIG. 54 shows a perspective view of another embodiment (secondary) of the preferred belt assembly for holding retaining device components as disclosed. The main belt portion of this embodiment "w" is preferably made of non-stretch webbing, or the like. Part "a" represents an exchangeable closure element (or elements). This element is preferably made primarily from stretch webbing "ab" and Velcro "vv" or the like is sewn to one side with a portion "aa" doubled back on itself and sewn to fasten through loops "bb" (this portion does not have Velcro). Portion "aa" as denoted represents a portion of the preferably stretchy webbing belt that does not have stretch-limiting means. Stretch-limiting means in this embodiment is provided by Velcro "vv" fastened locally and thus will provide some controlled stretch as determined by the stretch of the material primarily used for the foundation of "ab" and the size and geometry of portion "aa".

Pockets or the like can be added or incorporated into the belting system to carry items or the like. Pockets can be integrated into the belt itself (sewn, snapped, buttoned, fastened with Velcro or the like or otherwise attached see FIG. 51).

The belt system herein disclosed is preferably size-adjustable to fit a variety of body types and sizes. Adjusting for size can be accomplished many ways. A common traditional buckle with integrated or separate adjusters (labeled "cc" in Figs.) can be used to buckle the belting system in place on the body although the herein disclosed belt systems are more preferable. Hook and loop fabric/strapping is preferably incorporated into the belt in such a way that the belt system is not only remateable but also adjustable to fit a variety of sizes. The preferred embodiment uses hook and loop fabric strapping or the like integrated with the belt in a strip or strips at the belt's ends sewn glued or otherwise fastened with substantial length and width so that the belt is closeable and adjustable. Also the belting system can have a controlled amount of stretch so that the stretch itself can accommodate a range of waist sizes. In another preferable belt configuration the belt is more adjustable beyond just the Velcro closure and stretch size adjustment. Belt configurations are herein disclosed that have a secondary adjustment buckle to allow larger adjustments of the belt to fit a wider variety sizes (see FIGS. 58 through 63).

Also herein described and pictured is an exchangeable closure element or elements. For some embodiments of the disclosed invention an exchangeable closure element or elements is/are desirable. This novel exchangeable closure element is preferably constructed mainly of elastic, stretchy or somewhat stretchy, breathable, flexible webbing/belting examples of which are commonly found in the waist band of underwear, tights, compression tights, pants or the like also suspender strapping or the like. Also nylon, cotton, polypropylene or the like webbing could be used in another embodiment as well as a strip or strips of other fabric made of cotton, nylon, polyester or other natural or synthetic fiber materials or blends in combination with webbing, material, mesh or the like or by itself. Also although not preferable a strip or strips of leather, plastic or leather-like material or materials could be used for the main belt of the novel system. Once the webbing or the like element is preferably looped through a plastic loop part or the like and sewn or otherwise preferably fastened to itself, Velcro (substantially no-stretchy) or the like is preferably sewn or otherwise fastened on the back side providing fastening means for the belt system as well controlling the amount of stretch (labeled "aa" in drawings). This closure/adjuster element fits with the rest of the belt and can easily be removed/exchanged so that it can be separately inventoried, printed, etc. This is desirable for private labeling or to allow a different front closure element (with different features or to replace a broken or damaged component) to be easily added or exchanged. Also, for example other exchangeable front closure elements could be manufactured to incorporate different desirable features such as integrated flashlights/lights, visibility elements, electronic items, music players, medical monitoring devices, an Identification display, etc. or the like. The modularity of this element allows the disclosed novel belting system to have a degree of versatility other belts system do not have.

Another embodiment disclosed is an exchangeable closure element with integrated item carrying means. A pocket or pockets or the like can be added or integrated in some way to this exchangeable closure element. One preferable way of adding item carrying means is integrating the "Energy bar or the like pocket" into this closure element as previously described above and pictured in FIG. 62. Also although not preferable a pocket or pockets can be incorporated into the closure/buckling/fastening means of the belt system in a more traditional top access/top opening manner. This pocket or pockets has a front and rear panel (the rear panel could be the stretch belt or the like material element itself) and a top closure like Velcro, a zipper, etc or the like, as well as can have an internal divider or dividers, pocket or pockets, or other features for holding, displaying items or the like, etc.

An element integrated into the belt is herein disclosed which is attached substantially close to one of the belt systems ends that serves to confine the strap end so that it does not move around in an undesirable way (strap loop element).

Figure 8:
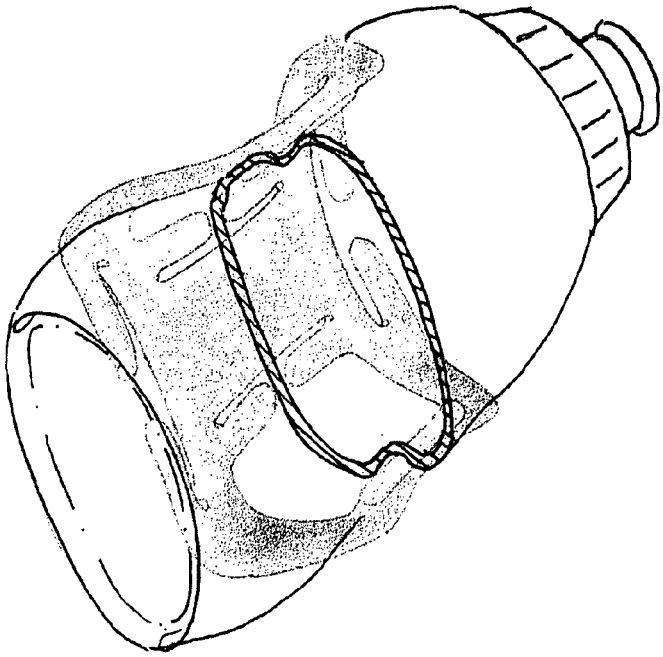
FIG. 8 shows a perspective view of an example bottle and retaining device of the preferred embodiment mated together. A section of the bottle through the mating area is shown for clarification.
Figure 80:
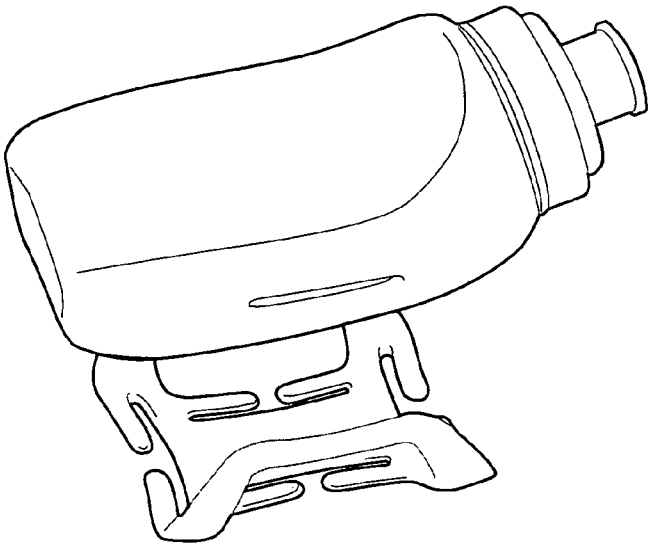
FIG. 80 shows a perspective exploded view of the bottle and retaining device of the preferred embodiment.

See FIGS. 16 through 21 for preferably assembling the belt or the like element to the retaining device or the like element (s). See FIGS. 8, 64, 69, 80 and others for assembling the bottle(s) or the like to the retaining device(s). The strap or the like element is preferably fed trough two opposing slots on the retaining device base (from the front or back) or through the upward curving opposing side cut-out arms. The bottle or the like is preferably snapped into place in the retaining device (pushing straight in until retaining device bottle grip elements engage mating bottle features)—see FIG. 8, FIG. 80.

Figure 88:
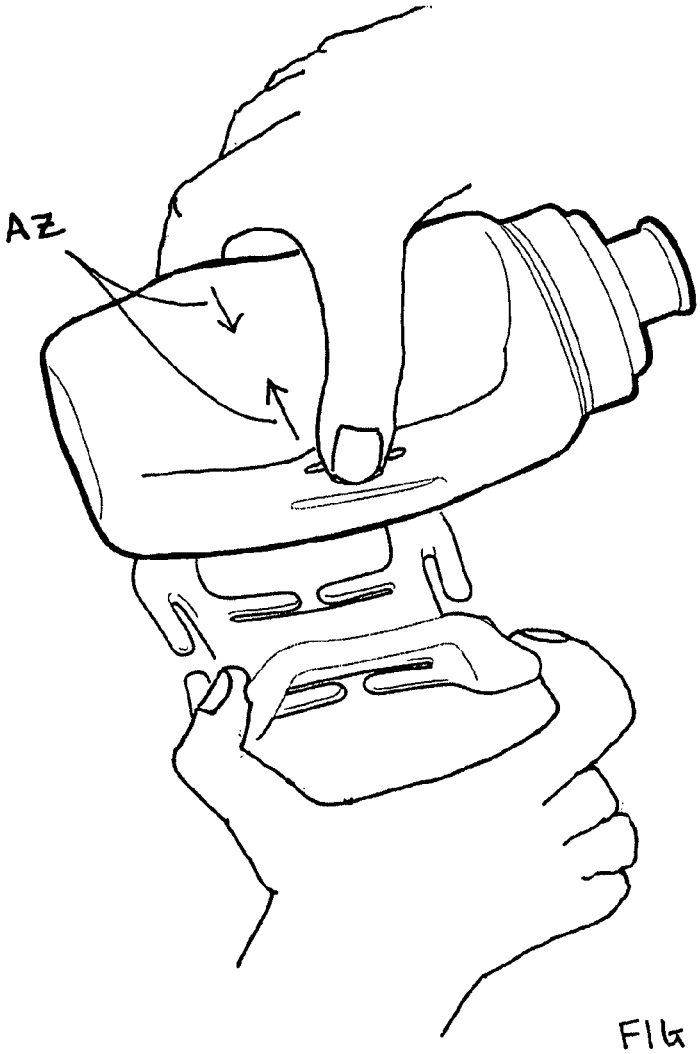
FIG. 88 shows a perspective view of a preferable embodiment of the retaining device and bottle of the invention and how it can be used/squeezed to remove by pinching in direction of arrows "AZ". Optional grip/pinch details are also depicted to facilitate gripping the bottle on removal. Belt or other "host item" is not shown for clarity of the drawing.
Figure 89:
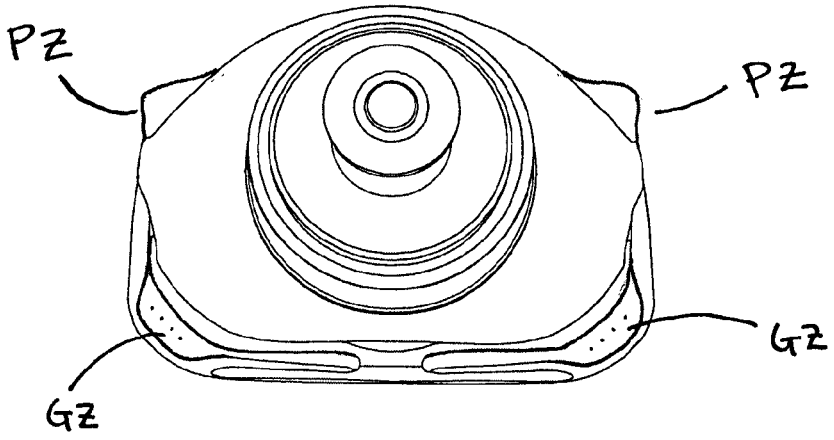
FIG. 89 shows an orthographic view of a desirable embodiment of the retaining device and bottle of the invention and how it can be used/squeezed to remove by pinching areas "PZ" together (also see FIG. 88). Optional grip/pinch bottle details "PZ" and retaining device grab details "GZ" are depicted to facilitate removing/replacing the bottle. Belt or other "host item" is not shown for clarity of the drawing.

FIG. 88 for how an embodiment of a bottle can be removed from the retaining device by pinching the sides of the bottle to flex the sides inward and away from the mating/holding areas freeing the bottle from being retained in the retaining device.

Summary Ramifications And Scope

Accordingly the reader will see that there are a number of advantages of the bottle, retaining device and associated elements for carrying containers and other items of this invention which make it more convenient to use, versatile, comfortable to carry a bottle, its contents and other items, easier and more comfortable to retrieve and replace the bottle, and keeps the bottle(s) securely in place while still allowing easy and superior access and retrieval of it.

Although the description above contains many specificities, these should not be construed as limiting the scope of the invention, but merely providing illustrations of some of the presently preferred embodiments of this invention. Combinations of the disclosed embodiments can be made with varying degrees of success.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiment of the invention in which an exclusive property or privilege is claimed are defined as follows:

1. A bottle and retaining clip, comprising;

a bottle having a bottom, a mouth, and sidewalls extending from the bottom to the mouth, the sidewalls comprising a first sidewall and an opposing second sidewall, and a third sidewall and an opposing fourth sidewall, the third and fourth sidewalls joining the first and second sidewalls, the first and second sidewalls each being wider than each of the third and fourth sidewalls, a first shoulder formed in the third sidewall and a second shoulder formed in the fourth sidewall;

a retaining clip comprising a base configured for removable attachment to a strap, the clip having:

(1) a first arm extending from the base and an opposing second arm extending from the base;

(2) a third arm extending from the base and an opposing fourth arm extending from the base;

(3) the first and the third arm joining to form a first surface for engaging the first shoulder formed in the third sidewall of the bottle; and, (4) the second and the fourth arm joining to form a second surface for engaging the second shoulder formed in the fourth sidewall of the bottle;

the base of the clip having a first elongated slot between the first and the second arm and a second elongated slot between the third and the fourth arm;

the first slot being formed by a first projection formed in the base and extending from a position adjacent a juncture of the first arm and the base, and a second projection formed in the base and extending from a position adjacent a juncture of the second arm and the base, the first projection extending toward the second projection and defining an opening between the first projection and the second projection to provide access to the first slot;

the second slot being formed by a third projection formed in the base and extending from a position adjacent a juncture of the third arm and the base, and a fourth projection formed in the base and extending from a position adjacent a juncture of the fourth arm and the base, the third projection extending toward the fourth projection and defining an opening between the third projection and the fourth projection to provide access to the second slot;

the bottle further having a central axis extending from the base of the bottle to the mouth;

the strap for retaining the clip having a pair of opposing distal ends and a length extending linearly between the pair of distal ends, the strap being removably inserted through both the first and the second slots to retain the clip to the strap, whereby the central axis of the bottle is parallel to a linear length of the strap between the pair of opposing distal ends;

whereby the bottle is configured for mating engagement with the clip and further wherein at least one of the bottle and the clip is configured and formed from a material that is sufficiently flexible to readily release the bottle from the retaining clip.

2. The bottle of claim 1, wherein the base of the clip further comprises a third elongated slot and a fourth elongated slot;

the third slot being formed by a fifth projection formed in the base and extending from a position adjacent a juncture of the first arm and the base, and a sixth projection formed in the base and extending from a position adjacent a juncture of the third arm and the base, the fifth projection extending toward the sixth projection and defining an opening between the fifth projection and the sixth projection to provide access to the third slot;

the fourth slot being formed by a seventh projection formed in the base and extending from a position adjacent a juncture of the second arm and the base, and an eighth projection formed in the base and extending from a position adjacent a juncture of the fourth arm and the base, the seventh projection extending toward the eighth projection and defining an opening between the seventh projection and the eighth projection to provide access to the fourth slot.

3. The clip of claim 2, wherein the third slot opening is positioned directly opposite the fourth slot opening.

4. The clip of claim 3, wherein the first slot opening is positioned directly opposite the second slot opening.

5. The bottle of claim 2, wherein the third slot and the fourth slot each extending in a direction nonparallel to at least one of the first slot and the second slot.

6. The clip of claim 2, wherein the strap has a length and a width, the length being longer than the width, wherein when the strap is inserted in one or more of either the first and second slots or the third and fourth slots, the strap width spans the base of the clip.

7. The clip of claim 1, wherein the first slot opening is positioned directly opposite the second slot opening.

8. The clip of claim 1, wherein the strap has a length and a width, the length being longer than the width, wherein when the strap is inserted in the first and second slots, the strap width spans the base of the clip.

9. A bottle and a retaining clip, comprising;

a bottle having a bottom, a mouth, and sidewalls extending from the bottom to the mouth; the sidewalls further comprising a first sidewall and an opposing second sidewall, and a third sidewall and an opposing fourth sidewall, the third and fourth sidewalls joining the first and second sidewalls, the first and second sidewalls each being wider than each of the third and fourth sidewalls;

a first shoulder formed in the third sidewall;

a second shoulder formed in the fourth sidewall;

a retaining clip comprising a base configured for removeable attachment to a strap, the clip having:

(1) a first arm extending from the base and an opposing second arm extending from the base;

(2) a third arm extending from the base and an opposing fourth arm extending from the base;

(3) the first and the third arm joining to form a first edge for engaging the first shoulder formed in the third sidewall of the bottle; and, (4) the second and the fourth arm joining to form a second edge for engaging second shoulder formed in the fourth sidewall of the bottle;

wherein the base of the clip comprises a first slot between the first and the third arm and a second slot between the second and the fourth arm, the first slot comprises a first slot width and a first slot length that is greater than the first slot width and the second slot comprises a second slot width and a second slot length that is greater than the second slot width, the first slot further having a first opening located centrally along the first slot length, the second slot having a second opening located centrally along the second slot length, such that the strap is selectively insertable through each of the first opening and the second opening and retained within the first slot and the second slots whereby the clip is retained to the strap, whereby the bottle is configured for mating engagement with the clip;

the base of the clip further having a third slot and a fourth slot, whereby the clip may be selectively attached to the strap by inserting the strap either between the first slot and the second slot or between the third slot and the fourth slot.

10. The clip of claim 9, wherein the third slot comprises a third slot width and a third slot length that is greater than the third slot width and the fourth slot comprises a fourth slot width and a fourth slot length that is greater than the fourth slot width, the third slot further having a third slot opening located centrally along the third slot length, the fourth slot having a fourth slot opening located centrally along the fourth slot length, such that the strap is selectively insertable through each of the third slot opening and the forth slot opening and retained within the third slot and the fourth slot.

11. The clip of claim 10, wherein the first slot opening is positioned directly opposite the second slot opening and the third slot opening is positioned directly opposite the fourth slot opening.

12. The clip of claim 10, wherein the first slot opening is adjacent the first edge for engaging the bottle and the second slot opening is adjacent the second edge for engaging the bottle.

13. The clip of claim 9, the bottle further having a central axis extending generally from the base of the bottle to the mouth, the strap for retaining the clip having two distal ends and a length measured between the two distal ends to define a strap axis between the two distal ends, wherein when the strap is alternately retained in the third and fourth slots, the central axis of the bottle is substantially parallel to the strap axis.

14. The clip of claim 13, wherein when the strap is inserted in the first and second slots, the central axis of the bottle is substantially perpendicular to the strap axis.

15. The clip of claim 9, wherein the first slot opening is positioned directly opposite the second slot opening.

16. The clip of claim 9, wherein the strap has a length and a width, the length being longer than the width, wherein when the strap is inserted in one or more of either the first and second slots or the third and fourth slots, the strap width spans the base of the clip.

17. A bottle comprising;

a base, a mouth, and sidewalls extending from the base to the mouth;

the sidewalls further comprising a first sidewall and an opposing second sidewall, and a third sidewall and an opposing fourth sidewall, the third and fourth sidewalls joining the first and second sidewalls, the first and second sidewalls each being wider than each of the third and fourth sidewalls;

a first shoulder formed in the third sidewall;

a second shoulder formed in the fourth sidewall;

a retaining clip comprising a base configured for removeable attachment to a strap, the clip having:

(1) a first arm extending from the base and an opposing second arm extending from the base;

(2) a third arm extending from the base and an opposing fourth arm extending from the base;

(3) the first and the third arm joining to form a first lip for engaging the first shoulder formed in the third sidewall of the bottle; and, (4) the second and the fourth arm joining to form a second lip for engaging second shoulder formed in the fourth sidewall of the bottle;

wherein the base of the clip comprises a first elongate slot having a first end and a second end, a second elongate slot having a third end and a fourth end, a third elongate slot having a fifth end and a sixth end, and a fourth elongate slot having a seventh end and an eighth end, the first slot and the second slot being positioned on opposite sides of the base, the third slot and the fourth slot being positioned on opposite sides of the base, the first slot further having a first slot opening located centrally along the first slot length, the second slot having a second slot opening located centrally along the second slot length, such that the strap is removably insertable through each of the first slot opening and the second slot opening and retained within the first slot and the second slot to attach the clip to the strap;

the first arm being connected to the base adjacent the first end and the fifth end, the second arm being connected to the base adjacent the second end and the seventh end, the third arm being connected to the base adjacent the third end and the sixth end, and the fourth arm being connected to the base adjacent the fourth end and the eighth end;

whereby the bottle is configured for mating engagement with the clip.

18. The clip of claim 17, the third slot further having a third slot opening, the fourth slot having a fourth slot opening, the third and fourth slots each being nonparallel with the first and second slots, such that the strap is alternately insertable in the third and fourth slots through each of the third slot opening and the fourth slot opening and retained within the third slot and the fourth slot.

19. The clip of claim 18, wherein the first slot opening is positioned directly opposite the second slot opening and the third slot opening is positioned directly opposite the fourth slot opening.

20. The clip of claim 18, wherein the strap has a length and a width, the length being longer than the width, wherein when the strap is inserted in one or more of either the first and second slots or the third and fourth slots, the strap width spans the base of the clip.

21. The clip of claim 18, wherein the third slot opening is adjacent the first lip for engaging the bottle and the fourth slot opening is adjacent the second lip for engaging the bottle.

22. The clip of claim 21, the bottle further having a central axis extending generally from the base of the bottle to the mouth, the strap for retaining the clip having two distal ends and a length measured between the two distal ends to define a strap axis between the two distal ends, whereby when the strap is inserted in the first and second slots, the central axis of the bottle is parallel to the strap axis and alternately when the strap is inserted in the third and fourth slots the central axis of the bottle is perpendicular to the strap axis.

23. The clip of claim 17, wherein the first slot opening is positioned directly opposite the second slot opening.

24. The clip of claim 17, wherein the strap has a length and a width, the length being longer than the width, wherein when the strap is inserted in the first and second slots, the strap width spans the base of the clip.

25. The clip of claim 17, the bottle further having a central axis extending generally from the base of the bottle to the mouth, the strap for retaining the clip having two distal ends and a length measured between the two distal ends to define a strap axis between the two distal ends, whereby when the strap is inserted in the first and second slots, the central axis of the bottle is substantially parallel to the strap axis.

* * * * *